US010549877B2

(12) United States Patent
Furusawa et al.

(10) Patent No.: US 10,549,877 B2
(45) Date of Patent: Feb. 4, 2020

(54) LAMINATED BOTTLE

(71) Applicants: Mitsuo Furusawa, Osaka (JP); Takayuki Abe, Osaka (JP)

(72) Inventors: Mitsuo Furusawa, Osaka (JP); Takayuki Abe, Osaka (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 1044 days.

(21) Appl. No.: 14/780,983

(22) PCT Filed: Mar. 25, 2014

(86) PCT No.: PCT/JP2014/058375
§ 371 (c)(1),
(2) Date: Sep. 28, 2015

(87) PCT Pub. No.: WO2014/157258
PCT Pub. Date: Oct. 2, 2014

(65) Prior Publication Data

US 2016/0052661 A1 Feb. 25, 2016

(30) Foreign Application Priority Data

Mar. 29, 2013 (JP) ..... 2013-071093
Mar. 29, 2013 (JP) ..... 2013-071094
(Continued)

(51) Int. Cl.
*B65D 1/00* (2006.01)
*B65D 1/02* (2006.01)

(52) U.S. Cl.
CPC ..... *B65D 1/0215* (2013.01)

(58) Field of Classification Search
CPC ..... B65D 1/0215; B65D 1/32; B65D 83/0072
(Continued)

(56) References Cited

U.S. PATENT DOCUMENTS 5,513,761 A 5/1996 Kobayashi et al.
2001/0032853 A1 10/2001 Kuehn et al.
2004/0069735 A1* 4/2004 Yoneyama ..... B29C 49/0073 215/12.1

FOREIGN PATENT DOCUMENTS

CN 1193297 A 9/1998
CN 1951776 A 4/2007
(Continued)

OTHER PUBLICATIONS

Nov. 8, 2016 Office Action issued in Japanese Patent Application No. 2013-071093.
(Continued)

*Primary Examiner* — Anthony D Stashick
*Assistant Examiner* — Raven Collins
(74) *Attorney, Agent, or Firm* — Oliff PLC

(57) ABSTRACT

The laminated bottle formed in a cylindrical shape with a bottom includes: an outer layer; and a flexible inner layer laminated onto an inner surface of the outer layer and being separable from the inner surface. A bottom section of the outer layer positioned at a bottle bottom portion is provided with: a holding rib pinching and holding the inner layer; an intake hole disposed at a position different from the holding rib and allowing outside air to be imported into a space between the outer and inner layers; and a surrounding wall surrounding the intake hole and extending outward of the bottle in a bottle axis direction.

4 Claims, 24 Drawing Sheets

(30) Foreign Application Priority Data

| | | |
|---|---|---|
| Apr. 30, 2013 | (JP) | 2013-095826 |
| Nov. 29, 2013 | (JP) | 2013-247641 |
| Nov. 29, 2013 | (JP) | 2013-247642 |

(58) Field of Classification Search
USPC ..... 215/12.2
See application file for complete search history.

(56) References Cited

FOREIGN PATENT DOCUMENTS

| | | | |
|---|---|---|---|
| EP | 1 026 086 | A2 | 8/2000 |
| JP | 3124620 | B2 | 1/2001 |
| JP | 2008-207860 | A | 9/2008 |
| JP | 2011-230817 | A | 11/2011 |
| JP | 2012-116519 | A | 6/2012 |
| WO | 93/23311 | A1 | 11/1993 |
| WO | 01/76849 | A1 | 10/2001 |

OTHER PUBLICATIONS

Nov. 8, 2016 Office Action issued in Chinese Patent Application No. 2013-071093.
Jun. 24, 2014 Search Report issued in International Patent Application No. PCT/JP2014/058375.
Jun. 27, 2016 Office Action issued in Chinese Patent Application No. 201480018743.X.

* cited by examiner

LAMINATED BOTTLE

TECHNICAL FIELD

The present invention relates to a laminated bottle.

Priority is claimed on Japanese Patent Application No. 2013-071093, filed Mar. 29, 2013, Japanese Patent Application No. 2013-071094, filed Mar. 29, 2013, Japanese Patent Application No. 2013-095826, filed Apr. 30, 2013, Japanese Patent Application No. 2013-247641, filed Nov. 29, 2013, and Japanese Patent Application No. 2013-247642, filed Nov. 29, 2013, the contents of which are incorporated herein by reference.

BACKGROUND ART

In the related art, a laminated bottle is known which includes an outer layer and a flexible inner layer, the inner layer containing contents and being capable of deforming while reducing the volume thereof in accordance with a decrease of the contents, and the inner layer is laminated onto an inner surface of the outer layer and is separable from the inner surface.

In a case where this kind of laminated bottle is combined with, for example, a dispenser which includes a pump and a push head, the pump having a suctioning pipe extending to the bottom of the laminated bottle, thereby configuring a discharge container, the inner layer may perform volume-reduction deformation in accordance with discharge of the contents and gradually moves upward (lift up), and may block the intake port of the suctioning pipe. Additionally, in a laminated bottle combined with no dispenser, the inner layers of laminated bottles after the volume-reduction deformation thereof may easily vary in shape, and the discharge of the contents may become unstable. In the laminated bottle in which the inner layer has lifted up in this way, a discharge failure or an increase in the amount of contents remaining (increase in the amount of contents remaining in the bottle at the time a discharge-disabled state is reached) may be caused.

Accordingly, a laminated bottle is known in which the bottle bottom portion of the bottle is provided with a locking part which holds the outer layer and the inner layer together, thereby limiting lift of the inner layer during the volume-reduction deformation (refer to Patent Document 1).

Additionally, in the related art, a laminated bottle is known which is disclosed in, for example, Patent Document 2.

This laminated bottle includes an outer layer and a flexible inner layer, the inner layer containing contents and being capable of performing volume-reduction deformation in accordance with a decrease in the amount of the contents. The inner layer is laminated onto an inner surface of the outer layer and is capable of being separated from the inner surface. A bottom section of the outer layer positioned at the bottle bottom portion is provided with an intake slit allowing outside air to be imported into a space between the outer and inner layers.

In this laminated bottle, outside air is imported from the intake slit into the space between the outer and inner layers at the time the contents contained in the inner layer are discharged, and thereby the inner layer performs the volume-reduction deformation while the original shape of the outer layer is maintained.

DOCUMENT OF RELATED ART

Patent Document

[Patent Document 1] Japanese Patent Granted Publication No. 3124620

[Patent Document 2] Japanese Unexamined Patent Application, First Publication No. 2008-207860

SUMMARY OF INVENTION

Technical Problem

However, even if the laminated bottle disclosed in Patent Document 1 is used, the holding of the inner layer may be insufficient, and the inner layer may lift up in accordance with the volume-reduction deformation thereof. Therefore, a possibility that the discharge failure or the like is caused may still be left.

The present invention has been made in view of the above circumstances, and an object thereof is to provide a laminated bottle which can efficiently limit lift of the inner layer.

Additionally, the laminated bottle disclosed in Patent Document 2 has room for improvement in smoothly importing outside air into a space between the outer and inner layers. Incidentally, if outside air is not imported into the space between the outer and inner layers, for example, it may become difficult to discharge to outside of the bottle, the contents contained in the inner layer.

The present invention has been made in view of the above circumstances, and an object thereof is to provide a laminated bottle which can smoothly import outside air into a space between the outer and inner layers.

Solution to Problem

The present invention shows the following means in order to solve the above problems.

A first aspect of the present invention is a laminated bottle formed in a cylindrical shape with a bottom, the laminated bottle including: an outer layer; and a flexible inner layer in which contents are contained and which is configured to perform volume-reduction deformation in accordance with a decrease of the contents. The inner layer is laminated onto an inner surface of the outer layer and is separable from the inner surface. A bottom section of the outer layer positioned at a bottle bottom portion is provided with: a holding rib pinching and holding the inner layer, an intake hole disposed at a position different from the holding rib and allowing outside air to be imported into a space between the outer layer and the inner layer, and a surrounding wall surrounding the intake hole and extending outward of the bottle in a bottle axis direction.

According to the laminated bottle of the first aspect of the present invention, since outside air can be imported into a space between the outer and inner layers through the intake hole, only the inner layer can be separated from the outer layer, thereby causing volume-reduction deformation (shrinkage deformation) of the inner layer, and thus the contents can be discharged. At this time, since the holding rib formed in the bottom section of the outer layer pinches and holds the inner layer, it is possible to efficiently prevent lift of the inner layer during the volume-reduction deformation thereof.

In this way, since the lift of the inner layer can be efficiently limited, it is possible to accurately control the volume-reduction deformation of the inner layer. Additionally, when the laminated bottle is attached with a dispenser having a suctioning pipe extending to the vicinity of the bottle bottom portion, the inner layer can be prevented from blocking the suctioning port of the suctioning pipe. Accordingly, it is possible to prevent a discharge failure or an increase in the amount of contents remaining.

Furthermore, since the bottom section of the outer layer is provided with the surrounding wall, when the finger of a user or the supporting surface on which the laminated bottle is put contacts the bottle bottom portion, the surrounding wall can prevent the finger or the supporting surface from reaching the intake hole. Accordingly, water, dust or the like can be prevented from entering a space between the outer layer and the inner layer through the intake hole, and blockage of the intake hole by filling the intake hole with water, dust or the like can be prevented. Thus, it is possible to reliably cause volume-reduction deformation to the inner layer.

The bottom section may be provided with a first recess disposed at a position different from the holding rib, a bottom wall of the first recess is provided with the intake hole, and a side wall of the first recess forms the surrounding wall.

In this case, the bottom wall of the first recess is provided with the intake hole, and the side wall of the first recess forms the surrounding wall. Therefore, it is possible to simplify the structure and manufacture of the laminated bottle.

In addition, since the intake hole is formed in the bottom wall of the first recess, an area of the bottom section of the outer layer in which the intake hole is formed can be reinforced with the recess and rib effect (a recess and rib structure) of the first recess. Therefore, an unexpected increase of the opening area of the intake hole due to an external force added to the outer layer at the time the inner layer performs volume-reduction deformation can be limited. Thus the inner layer can accurately perform the volume-reduction deformation.

The holding rib may be provided extending in a bottle radial direction. In addition, the intake hole may be provided on an extended line from the holding rib within the bottom section, and may extend along the extended line.

In this case, since the holding rib is formed in the bottle radial direction radiating from the bottle axis, the holding rib can be easily formed in the outer layer, and can easily pinch the inner layer, thereby reliably holding the inner layer, during the manufacture of the laminated bottle. Furthermore, since it is only necessary to form the intake hole on the extended line from the holding rib along the extended line, the holding rib and the intake hole can be easily formed at the same time.

In addition, since the intake hole is formed in the bottle bottom portion, it is possible to hide the intake hole during the normal placement of the bottle, and the bottle body portion can have a smooth surface on the entire circumference thereof. Accordingly, it is possible to prevent deterioration in appearance or in acceptability of decoration of the laminated bottle.

The bottom section may be provided with a pair of second recesses extending parallel to the intake hole and disposed so that the intake hole is interposed between the second recesses.

In this case, since the pair of second recesses extend parallel to the intake hole and are disposed so that the intake hole is interposed between the second recesses, an unexpected increase of the opening area of the intake hole can be prevented by reinforcing the bottom section of the outer layer with the recess and rib effect (a recess and rib structure) of the second recesses, and the intake hole can become unnoticeable by disposing the second recesses in the bottom section of the outer layer so that the intake hole is interposed between the second recesses. Accordingly, it is possible to improve the appearance of the laminated bottle, and to easily design a laminated bottle having an excellent exterior.

In addition, since the intake hole is interposed between the pair of the second recesses, at the time the finger of a user contacts the bottle bottom portion, it is possible to cause flexural deformation to areas of the outer layer in which the second recesses are formed, and to reliably prevent the finger from reaching the intake hole.

The bottle bottom portion may include: a grounding portion positioned at an outer circumferential edge part of the bottle bottom portion, and a recessed portion connected to the grounding portion from inside of the bottle in a bottle radial direction and positioned on an inner side of the bottle than the grounding portion. In addition, the holding rib and the intake hole may be formed in the recessed portion.

In this case, since the holding rib and the intake hole are formed in the recessed portion of the bottle bottom portion positioned on an inner side of the bottle, even if the holding rib is formed projecting outward of the bottle, it is possible to prevent the holding rib from contacting the supporting surface at the time the laminated bottle is put on the supporting surface, and to secure placing stability of the laminated bottle. In addition, the inflow of outside air through the intake hole is not easily disturbed, and water, dust or the like is less likely to enter a space between the outer layer and the inner layer through the intake hole.

The holding rib may be disposed at a position different from a bottle axis. A part of the outer layer in a bottle circumferential direction and a part of the inner layer in the bottle circumferential direction may be fixed to each other through a fixing part. In addition, the fixing part may be positioned on a side of the bottle opposite to the holding rib in a bottle radial direction across the bottle axis.

In this case, the holding rib and the fixing part hold the inner layer on the outer layer at two parts positioned to be opposite to each other in the bottle radial direction across the bottle axis. Therefore, it is possible to crush the inner layer flatwise and uniformly in the vicinity of the center of the bottle in accordance with the volume-reduction deformation thereof, and to further reduce the remaining amount of contents.

The outer layer may be configured to accept squeeze deformation.

In this case, since the outer layer is formed to accept squeeze deformation, it is possible to increase the internal pressure of the inner layer by applying the squeeze deformation to the outer layer, and thus to discharge through the bottle mouth portion, the contents contained in the inner layer. Therefore, the laminated bottle can be applied to various uses.

A second aspect of the present invention is a laminated bottle formed in a cylindrical shape with a bottom, the laminated bottle including: an outer layer; and a flexible inner layer in which contents are contained and which is configured to perform volume-reduction deformation in accordance with a decrease of the contents. The inner layer is laminated onto an inner surface of the outer layer and is separable from the inner surface. A bottom section of the outer layer positioned at a bottle bottom portion is provided with: an intake slit allowing outside air to be imported into a space between the outer layer and the inner layer, and a projecting part projecting inward of the laminated bottle. At least part of the projecting part extends in a cross direction crossing a direction in which the intake slit extends. In addition, the projecting part is arranged next to the intake slit in the cross direction.

According to the second aspect of the present invention, since the bottom section of the outer layer is provided with the projecting part, it is possible to make the adhesion strength between the outer layer and the inner layer differ between an area in which the projecting part is arranged and other areas within the bottom section, and to form in the bottle bottom portion, the distribution of the adhesion strength between the outer layer and the inner layer. Therefore, it is possible to easily form a starting-point part serving as the starting point of separation between the inner layer and the outer layer at the time of causing volume-reduction deformation of the inner layer, and to reliably separate the inner layer from the outer layer.

Since at least part of the projecting part extends in the cross direction, it is possible to form the starting-point part in the cross direction so that the starting-point part is along the projecting part. For example, separation spaces formed between the inner layer and the outer layer by the separation occurring in the starting-point part can be extended within the bottle bottom portion from the opening edge part of the intake slit toward the outer circumferential edge part of the bottle.

In addition, since the projecting part is arranged next to the intake slit in the cross direction, outside air can be promptly imported into the separation space from the intake slit.

As a result, at the time the inner layer is subjected to volume-reduction deformation, it is possible to form the separation space extending along the projecting part within the bottle bottom portion, and to easily make outside air taken in from the intake slit flow toward the outer circumferential edge part of the bottle bottom portion through the separation space. That is, outside air can be smoothly taken in into the space between the inner layer and the outer layer from the intake slit. Therefore, it is possible to obtain appropriate discharge of the contents, an improvement of the operability of the bottle, the prevention of breakage of the inner layer, or the like.

In this kind of laminated bottle, after part of the contents contained in the inner layer have been discharged and the inner layer has performed volume-reduction deformation, the inner layer may be deformed toward the bottom section of the outer layer due to the load of the contents remaining inside the inner layer, and may be laminated again onto the outer layer.

Additionally, in order to adjust the degree of force required for separating the inner layer from the outer layer, after the laminated bottle has been molded and before contents are contained in the inner layer, for example, air inside the inner layer is exhausted to outside of the bottle and the inner layer is subjected to volume-reduction deformation, thereby separating the inner layer from the outer layer, and thereafter air is supplied into the inner layer and the inner layer is subjected to swelling deformation, thereby laminating the inner layer again onto the outer layer, whereby the degree of adhesion between the outer surface of the inner layer and the inner surface of the outer layer may be adjusted.

As described above, in this kind of laminated bottle, after the inner layer has performed the volume-reduction deformation and has separated from the bottom section of the outer layer, due to a load added to the inner layer from the contents, air supplied into the inner layer, or the like, the inner layer may be laminated again onto the bottom section of the bottom section of the outer layer.

At this time, since the projecting parts are formed in the bottom section of the outer layer, at the time the inner layer is laminated again onto the bottom section of the outer layer, the surfaces of the projecting parts of the outer layer can be prevented from being brought into close contact with surfaces of the inner layer, whereby it is possible to easily form intermediate gaps therebetween. In this laminated bottle, since the intermediate gap can be formed in the cross direction along the projecting part similar to the separation space, when volume-reduction deformation is caused again to the inner layer, outside air imported from the intake slit can easily flow through the intermediate gap toward the outer circumferential edge part of the bottle bottom portion. Thus, even in a case where the bottom section of the inner layer has been laminated again onto the bottom section of the outer layer after the inner layer has separated therefrom, outside air can be smoothly imported into a space between the inner layer and the outer layer from the intake slit.

The projecting part may linearly extend in the cross direction.

In this case, since the projecting part linearly extends in the cross direction, the separation space and the intermediate gap can be linearly formed in the cross direction, and outside air can easily and smoothly flow through the separation space and the intermediate gap.

The projecting part may be provided in each of areas which are disposed within the bottom section so that the intake slit is interposed between the areas.

In this case, since the plurality of projecting parts are arranged so that the intake slit is interposed between the projecting parts, the separation spaces and the intermediate gaps can be formed in a wide range of the bottle bottom portion, and outside air can be further smoothly imported into a space between the inner layer and the outer layer from the intake slit.

The bottom section may be provided with a surrounding wall surrounding the intake slit and extending outward of the bottle in a bottle axis direction.

In this case, since the bottom section of the outer layer is provided with the surrounding wall, when the finger of a user or the supporting surface on which the laminated bottle is put contacts the bottle bottom portion, the surrounding wall can prevent the finger or the supporting surface from reaching the intake slit. Accordingly, water, dust or the like can be prevented from entering a space between the outer layer and the inner layer through the intake slit, and blockage of the intake slit by filling the intake slit with water, dust or the like can be prevented. Thus, it is possible to reliably cause volume-reduction deformation to the inner layer.

The bottom section may be provided with a first recess, a bottom wall of the first recess is provided with the intake slit, and a side wall of the first recess forms the surrounding wall.

In this case, the bottom wall of the first recess is provided with the intake slit, and the side wall of the first recess forms the surrounding wall. Therefore, it is possible to simplify the structure and manufacture of the laminated bottle.

Since the intake slit is formed in the bottom wall of the first recess, an area of the bottom section of the outer layer in which the intake slit is formed can be reinforced with the recess and rib effect (a recess and rib structure) of the first recess. Therefore, an unexpected increase of the opening area of the intake slit due to an external force added to the outer layer at the time the inner layer performs volume-reduction deformation can be limited. Thus the inner layer can accurately perform the volume-reduction deformation.

The bottom section may be provided with a pair of second recesses extending parallel to the intake slit and disposed so that the intake slit is interposed between the second recesses.

In this case, since the pair of second recesses extend parallel to the intake slit and are disposed so that the intake slit is interposed between the second recesses, an unexpected increase of the opening area of the intake slit can be prevented by reinforcing the bottom section of the outer layer with the recess and rib effect (a recess and rib structure) of the second recesses, and the intake slit can become unnoticeable by disposing the second recesses in the bottom section of the outer layer so that the intake slit is interposed between the second recesses. Accordingly, it is possible to improve the appearance of the laminated bottle, and to easily design the laminated bottle to have an excellent design.

Since the intake slit is interposed between the pair of the second recesses, for example, at the time the finger of a user contacts the bottle bottom portion, it is possible to cause large flexural deformation to areas of the outer layer in which the second recesses are formed, while the deformation of each of the second recesses is maintained to be small. Thus, in a case where the surrounding wall is formed, the finger can be reliably prevented from reaching the intake slit.

A holding rib pinching and holding the inner layer may be provided at a part of the bottom section positioned on an extended line from the intake slit, and may extend along the extended line.

In this case, since the holding rib is provided at a part of the bottom section of the outer layer positioned on the extended line and extends along the extended line, both of the intake slit and the holding rib can be disposed on a parting line of molds which mold the laminated bottle, and thus the intake slit and the holding rib can be easily and accurately formed.

The outer layer may be configured to accept squeeze deformation.

In this case, since the outer layer is formed to accept squeeze deformation, it is possible to increase the internal pressure of the inner layer by applying the squeeze deformation to the outer layer, and thus to discharge through the bottle mouth portion, the contents contained in the inner layer. Therefore, the laminated bottle can be applied to various uses.

A third aspect of the present invention is a laminated bottle formed in a cylindrical shape with a bottom, the laminated bottle including: an outer layer; and a flexible inner layer in which contents are contained and which is configured to perform volume-reduction deformation in accordance with a decrease of the contents. The inner layer is laminated onto an inner surface of the outer layer and is separable from the inner surface. A bottom section of the outer layer positioned at a bottle bottom portion is provided with a holding rib pinching and holding the inner layer. A part of the outer layer is provided with an intake hole allowing outside air to be imported into a space between the outer layer and the inner layer. In addition, the holding rib is provided in each of a pair of areas which are disposed within the bottom section at an interval such that a bottle axis is interposed between the areas in a bottle radial direction.

According to the third aspect of the present invention, since outside air can be imported into a space between the outer layer and the inner layer through the intake hole, only the inner layer can be separated from the outer layer, thereby causing volume-reduction deformation (shrinkage deformation) of the inner layer, and thus the contents can be discharged. At this time, since the holding rib formed in the bottom section of the outer layer pinches and holds the inner layer, lift of the inner layer during the volume-reduction deformation thereof can be efficiently prevented. Furthermore, since the pair of holding ribs are disposed at an interval across the bottle axis in the bottle radial direction within the bottom section of the outer layer, it is possible to reliably hold two areas of the bottom section of the inner layer which are disposed so that the bottle axis is interposed between the two areas. Thus, during the volume-reduction deformation of the inner layer, it is possible to prevent lift of one of two areas of the bottom section of the inner layer which are positioned so that the bottle axis is interposed between the two areas, and to accurately control the volume-reduction deformation of the inner layer.

As a result, since the lift of the inner layer can be efficiently limited and the volume-reduction deformation of the inner layer can be accurately controlled, even in a case where the laminated bottle is attached with a dispenser having a suctioning pipe extending to the vicinity of the bottle bottom portion, the inner layer can be prevented from blocking the suctioning port of the suctioning pipe. Accordingly, it is possible to prevent a discharge failure or an increase in the amount of contents remaining.

Since the holding ribs hold two areas of the bottom section of the inner layer which are disposed so that the bottle axis is interposed between the two areas, a wide range of the bottom section of the inner layer can be held. Therefore, the other area not held (the area capable of lifting up) of the bottom section of the inner layer can be further decreased. Thus, the lift of the inner layer together with the contents remaining in the bottom section of the inner layer can be prevented, and it can also be expected to effect a decrease in the amount of contents remaining in this regard.

A pair of holding ribs may be provided on one straight line extending in the bottle radial direction and may extend along the straight line. In addition, the intake hole may be provided in a part of the bottom section positioned between the pair of holding ribs and may extend along the straight line.

In this case, the pair of holding ribs are provided on one straight line extending in the bottle radial direction and extend along the straight line, and each holding rib is formed in the bottle radial direction radiating from the bottle axis. Therefore, during the manufacture of the laminated bottle, the holding ribs can be easily formed in the outer layer, and can easily pinch the inner layer, thereby reliably holding the inner layer. Furthermore, since it is only necessary to form the intake hole on the straight line on which the pair of holding ribs are disposed, the holding ribs and the intake hole can be easily formed at the same time.

Since the intake hole is formed in the bottle bottom portion, the intake hole can be hidden during the normal placement of the bottle, and the bottle body portion can have a smooth surface on the entire circumference thereof. Accordingly, it is possible to prevent deterioration in appearance or in decoration acceptability of the bottle.

Since the intake hole is provided at a part positioned between the pair of the holding ribs within the bottom section of the outer layer and extends along the straight line, while the pair of holding ribs efficiently limits lift of the inner layer, outside air imported from the intake hole positioned between the holding ribs can reach every part between the inner layer and the outer layer uniformly in the bottle circumferential direction, and the inner layer can further accurately perform volume-reduction deformation.

As described above, since two areas of the bottom section of the inner layer disposed so that the bottle axis is interposed between the two areas in the bottle radial direction can be reliably held, it is possible to reliably prevent lift of another area of the bottom section of the inner layer which is positioned between the above two areas and faces the intake hole, as well as the two areas. In addition, since the intake hole is disposed between the pair of holding ribs, unexpected expansion of the intake hole in the bottle radial direction along the straight line can be limited, and for example, it is possible to secure appearance of the laminated bottle. Furthermore, even in a case where the contents are discharged by applying squeeze deformation to the laminated bottle in the bottle radial direction and a large external force is added to the outer layer during discharge of the contents, the above-described expansion of the intake hole can be limited. Therefore, it is possible to secure appearance of the laminated bottle, and when the squeeze deformation is caused to the laminated bottle, large part of outside air which has been imported into a space between the outer layer and the inner layer can be efficiently prevented from flowing back into outside of the bottle through the intake hole, and thus the contents can be smoothly discharged.

The bottle bottom portion may include: a grounding portion positioned at an outer circumferential edge part of the bottle bottom portion, and a recessed portion connected to the grounding portion from inside of the bottle in the bottle radial direction and positioned on an inner side of the bottle than the grounding portion. In addition, the holding ribs and the intake hole may be formed in the recessed portion.

In this case, since the holding ribs and the intake hole are formed in the recessed portion of the bottle bottom portion positioned on an inner side of the bottle than the grounding portion, even if the holding ribs are formed projecting outward of the bottle, the holding ribs can be prevented from contacting a supporting surface when the laminated bottle is put on the supporting surface, and the placement stability of the laminated bottle can be secured. In addition, the inflow of outside air through the intake hole is not easily disturbed, and water, dust or the like is less likely to enter a space between the outer layer and the inner layer through the intake hole.

Effects of Invention

According to the laminated bottle of the present invention, it is possible to efficiently limit lift of an inner layer, and to prevent a discharge failure or an increase in the amount of contents remaining.

In addition, according to the laminated bottle of the present invention, outside air can be smoothly imported into a space between an inner layer and an outer layer.

DESCRIPTION OF EMBODIMENTS (First Embodiment)

Hereinafter, a first embodiment of a laminated bottle of the present invention is described with reference to the drawings.

(Structure of Laminated Bottle)

Figure 1:
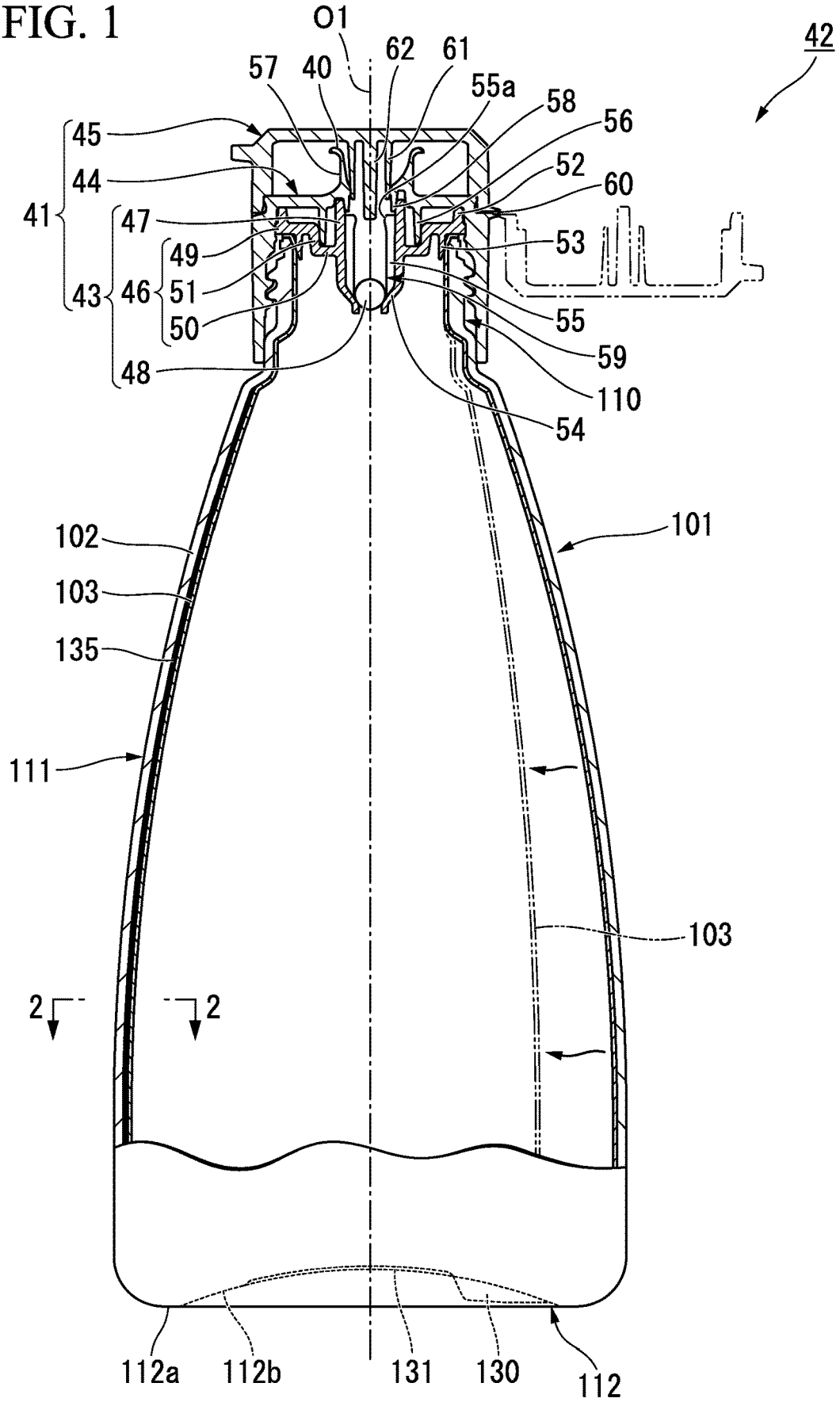
FIG. 1 is a view showing a first embodiment of a laminated bottle of the present invention and is a vertical cross-sectional view (partial side view) showing a state where a discharge cap is attached to the bottle.
Figure 2:
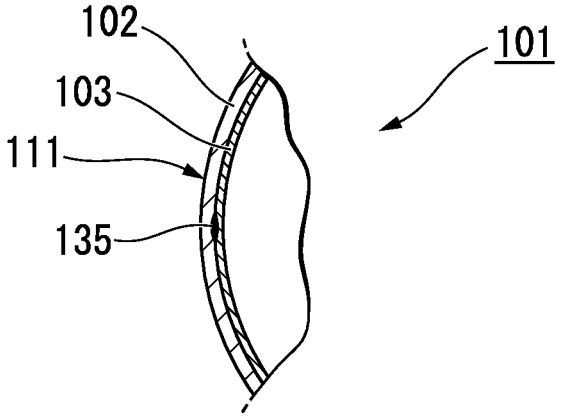
FIG. 2 is a cross-sectional view taken along 2-2 line in FIG. 1.

As shown in FIGS. 1 and 2, a laminated bottle 101 of this embodiment includes an outer layer 102 configured to accept squeeze deformation, and a flexible inner layer 103 in which contents (not shown) are contained and which is configured to perform volume-reduction deformation (shrinkage deformation) in accordance with a decrease in the amount of contents. The laminated bottle 101 is a delamination bottle (a lamination-separable container) formed in a cylindrical shape with a bottom, in which the inner layer 103 is laminated onto an inner surface of the outer layer 102 and is separable from the inner surface.

In this embodiment, the "outer layer" denotes an outer container forming an outer portion of the laminated bottle 101, and the "inner layer" denotes an inner container (inner bag) forming an inner portion of the laminated bottle 101. Although both of the outer layer 102 and the inner layer 103 have flexibility, the outer layer 102 has a rigidity sufficient for self-standing. The "squeeze deformation" denotes the deformation that an intermediate part in the longitudinal direction of the outer layer 102 (the outer container) is crushed (the width of the intermediate part is reduced) by fingers or the like of a user.

The outer layer 102 and the inner layer 103 are formed of, for example, a polyester resin such as a polyethylene terephthalate resin or a polyethylene naphthalate resin, a polyolefin resin such as a polyethylene resin or a polypropylene resin, a polyamide resin such as nylon, or an ethylene vinyl alcohol copolymer resin. A combination of these resins is used so that the outer layer 102 and the inner layer 103 are separable from each other (so that these layers have no compatibility).

The laminated bottle 101 includes a bottle mouth portion 110, a bottle body portion 111, and a bottle bottom portion 112 which are continuously provided in this order in a bottle axis O1 direction. In this embodiment, the side of the bottle close to the bottle mouth portion 110 in the bottle axis O1 direction is called the upper side thereof, the side of the bottle close to the bottle bottom portion 112 in the bottle axis O1 direction is called the lower side thereof, a direction orthogonal to the bottle axis O1 is called a bottle radial direction, and a direction going around the bottle axis O1 is called a bottle circumferential direction. The bottle axis O1 denotes the central axis of the laminated bottle 101.

The diameter of the bottle body portion 111 gradually increases from the upper side to the lower side of the bottle body portion 111. The bottle body portion 111 in vertical cross-section of the laminated bottle 101 in the bottle axis O1 direction is formed in a convex-curved shape projecting outward of the bottle in the bottle radial direction.

The outer layer 102 is a container configured to accept squeeze deformation, and the squeeze deformation of the outer layer 102 causes volume-reduction deformation to the inner layer 103. The outer layer 102 is configured to be resiliently deformable, and a body section of the outer layer 102 positioned at the bottle body portion 111 is configured to be resiliently deformable inward of the bottle in the bottle radial direction. That is, even in a case where an external force is added to the outer layer 102 and thereby the squeeze deformation is caused thereto, if the added external force is released, the outer layer 102 can return to the shape shown in FIG. 1.

The bottle mouth portion 110 extends upward from the upper end opening of the bottle body portion 111 and is disposed coaxial with the bottle body portion 111.

The bottle mouth portion 110 is attached with a discharge cap 41 having a discharge port 40, and the laminated bottle 101 and the discharge cap 41 compose a discharge container 42 which discharges from the discharge port 40, the contents of the laminated bottle 101.

The discharge cap 41 switches communication and blockage between the inside of the inner layer 103 and the discharge port 40 in accordance with the internal pressure of the inner layer 103. The discharge cap 41 includes an internal stopper 43, a main body 44, and a cover 45.

The internal stopper 43 includes a base portion 46 disposed on the upper end opening of the bottle mouth portion 110, a housing cylinder 47 penetrating the base portion 46 in the bottle axis O1 direction, and a valve body 48 accommodated in the housing cylinder 47. Both of the base portion 46 and the housing cylinder 47 are disposed coaxial with the bottle axis O1, and the base portion 46 and the housing cylinder 47 are integrally formed.

The base portion 46 is formed in an annular plate-shape whose front and back surfaces are perpendicular to the bottle axis O1 direction. The base portion 46 includes an outer circumferential part 49 positioned on an outer side of the base portion 46 in the bottle radial direction, an inner circumferential part 50 positioned on an inner side thereof in the bottle radial direction, and a stepped part 51 extending in the bottle axis O1 direction and connecting the outer circumferential part 49 and the inner circumferential part 50. The inner circumferential part 50 is positioned to be lower than the outer circumferential part 49.

The outer circumferential part 49 is provided with a rising cylindrical part 52 and a first seal cylindrical part 53 which are disposed coaxial with the bottle axis O1. The rising cylindrical part 52 extends upward from the outer circumferential part 49. The first seal cylindrical part 53 extends downward from the outer circumferential part 49 and is liquid-tightly fitted into the bottle mouth portion 110.

A middle part of the outer circumferential surface of the housing cylinder 47 in the bottle axis O1 direction is connected to the inner circumferential edge of the base portion 46, and the housing cylinder 47 projects from the base portion 46 into two sides (upper and lower sides) of the base portion 46 in the bottle axis O1 direction. A portion of the housing cylinder 47 positioned to be lower than the middle part of the housing cylinder 47 in the bottle axis O1 direction is provided with a diameter-decreasing part 54 (a valve seat) having a diameter that gradually decreases from the upper side to the lower side of the housing cylinder 47.

The inner circumferential surface of the housing cylinder 47 is provided with projecting ribs 55 extending in the bottle axis O1 direction. The projecting ribs 55 are provided at intervals in the bottle circumferential direction and compose an annular rib-row. The projecting rib 55 extends upward from the diameter-decreasing part 54, and the upper end part of the projecting rib 55 is positioned to be upper than the middle part of the housing cylinder 47 in the bottle axis O1 direction. The upper end part of the projecting rib 55 is provided with a stopper 55*a* projecting inward of the housing cylinder 47 in the bottle radial direction.

The valve body 48 is accommodated in the housing cylinder 47 and is movable in the bottle axis O1 direction. The valve body 48 is configured to be slidable in the bottle axis O1 direction inside the rib-row on the surfaces of the projecting ribs 55 facing inward of the housing cylinder 47 in the bottle radial direction, and is seated on the inner circumferential surface of the diameter-decreasing part 54 and is movable upward of the inner circumferential surface. The valve body 48 is a so-called ball valve formed in a spherical shape.

The main body 44 is formed in a cylindrical shape with a top and is externally attached to the bottle mouth portion 110. The inside of the upper end part of the main body 44 is fitted with the base portion 46, and the other part of the main body 44 positioned to be lower than the upper end part thereof is screwed on the outer circumferential surface of the bottle mouth portion 110.

The main body 44 is provided with a drooping cylindrical part 56 and a discharge cylindrical part 57. The drooping cylindrical part 56 extends downward from the main body 44 and is fitted into the inside of the stepped part 51. The discharge cylindrical part 57 has a smaller diameter than that of the drooping cylindrical part 56 and extends upward from the main body 44.

The diameter of the inner circumferential surface of the discharge cylindrical part 57 gradually increases from the lower side to the upper side thereof. The axis of the discharge cylindrical part 57 extends along the bottle axis O1 and is shifted from the bottle axis O1 in the bottle radial direction.

Hereinafter, a direction orthogonal to the axis of the discharge cylindrical part 57 and to the bottle axis O1 is called a front-and-rear direction, the side of the bottle close to the axis of the discharge cylindrical part 57 in the front-and-rear direction is called the rear side thereof, and the side of the bottle close to the bottle axis O1 in the front-and-rear direction is called the front side thereof. That is, the left side of FIG. 1 is the front side of the bottle, and the right side of FIG. 1 is the rear side of the bottle.

The discharge cylindrical part 57 is capable of communicating with the inside of the inner layer 103 through the housing cylinder 47, and the inside of the upper end part of the discharge cylindrical part 57 is provided with the discharge port 40. The discharge cylindrical part 57 is provided with a second seal cylindrical part 58 which communicates between the inside of the discharge cylindrical part 57 and the inside of the housing cylinder 47. The second seal cylindrical part 58 extends downward from the inner circumferential surface of the discharge cylindrical part 57. The second seal cylindrical part 58 is disposed coaxial with the bottle axis O1 and is fitted into the inside of the upper end part of the housing cylinder 47.

The discharge port 40 and the inside of the inner layer 103 are capable of communicating with each other through a communication passageway 59 which is formed of the insides of the housing cylinder 47, the second seal cylindrical part 58, and the discharge cylindrical part 57. The communication between the discharge port 40 and the inside of the inner layer 103 through the communication passageway 59 is blocked by the valve body 48 seated on the diameter-decreasing part 54.

The cover 45 is formed in a cylindrical shape with a top. The cover 45 is externally fitted to the upper end part of the main body 44 and is attachable thereto and detachable therefrom. The cover 45 covers the discharge port 40 from outside thereof. The cover 45 seals the discharge port 40 and is capable of opening and closing the discharge port 40. The cover 45 is connected to the main body 44 via a hinge part 60. The hinge part 60 connects parts of the main body 44 and of the cover 45 to each other, these parts being positioned on the rear side of the bottle. The hinge part 60 connects the cover 45 to the main body 44 so that the cover 45 is rotatable around the hinge part 60 between the front side and the rear side of the hinge part 60.

The cover 45 is provided with a third seal cylindrical part 61 and a restriction part 62. Both of the third seal cylindrical part 61 and the restriction part 62 are disposed coaxial with the bottle axis O1.

The lower end part of the third seal cylindrical part 61 is fitted into the second seal cylindrical part 58 and is attachable thereto and detachable therefrom, and blocks the communication between the inside of the inner layer 103 and the discharge port 40 through the communication passageway 59.

The restriction part 62 is disposed coaxial with the bottle axis O1 and is formed in a rod shape extending along the bottle axis O1. The restriction part 62 is formed having a smaller diameter than that of the third seal cylindrical part 61. The lower end part of the restriction part 62 is positioned inside the housing cylinder 47 and is disposed at approximately the same position as the stopper 55*a* in the bottle axis O1 direction. The restriction part 62 restricts the upward movement of the valve body 48.

As shown in FIGS. 1 to 4, the bottle bottom portion 112 includes a grounding portion 112*a* and a recessed portion 112*b*. The grounding portion 112*a* is connected to the bottle body portion 111 and is positioned at the outer circumferential edge part of the bottle bottom portion 112. The recessed portion 112*b* is connected to the grounding portion 112*a* from inside of the bottle in the bottle radial direction and is positioned on an inner side of the bottle than the grounding portion 112*a*.

A bottom section of the outer layer 102 positioned at the bottle bottom portion 112 is provided with a holding rib 130 pinching and integrally holding the inner layer 103, an intake hole 131 (intake gap) allowing outside air to be imported into a space between the outer layer 102 and the inner layer 103, and a first recess 136 and second recesses 137 which are recessed inward of the bottle in the bottle axis O1 direction. The holding rib 130, the intake hole 131, the first recess 136 and the second recesses 137 are formed in the recessed portion 112*b* of the bottle bottom portion 112.

The holding rib 130 projects downward (outward of the bottle) from the recessed portion 112*b*. The rib height of the holding rib 130 is set so that the holding rib 130 is accommodated in the internal space of the recessed portion 112*b*.

Figure 4:
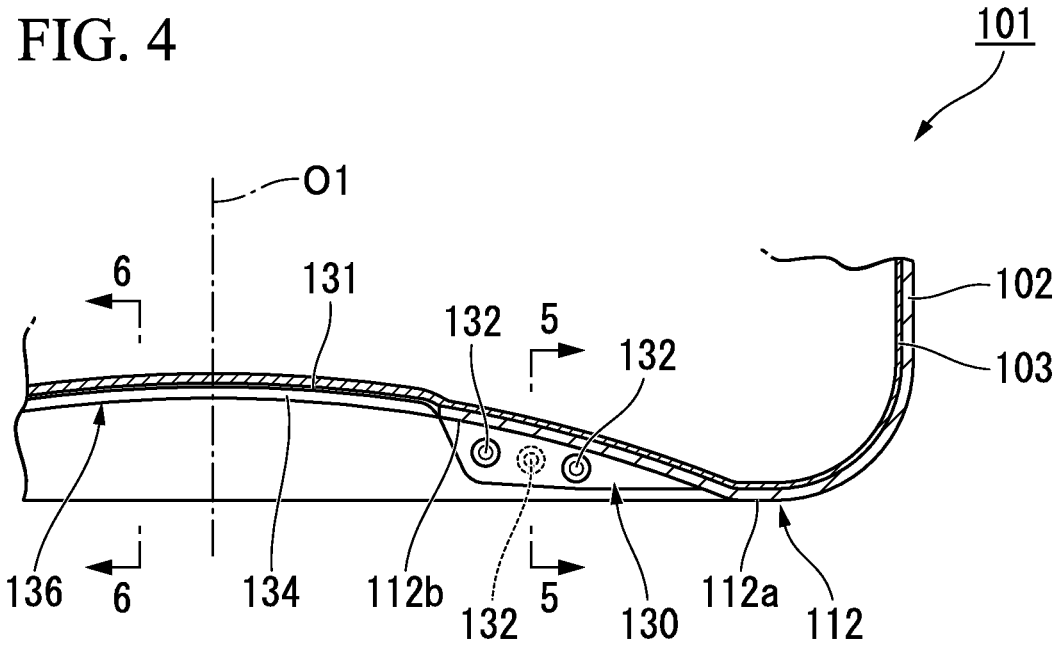
FIG. 4 is a cross-sectional view taken along 4-4 line of the bottle bottom portion shown in FIG. 3.

As shown in FIG. 4, the holding rib 130 is provided extending in the bottle radial direction, and the length of the holding rib 130 in the bottle radial direction is less than the radius of the bottle bottom portion 112. Only one holding rib 130 is provided at a position apart from the bottle axis O1 (at a position different from the bottle axis O1). The outer end part of the holding rib 130 positioned on an outer side of the bottle in the bottle radial direction is connected to the inner circumferential edge of the grounding portion 112*a*, and the inner end part of the holding rib 130 positioned on an inner side of the bottle in the bottle radial direction extends so as to be a linear shape inclining relative to the bottle axis O1. In addition, the upper side of FIG. 4 is the upper side of the bottle in the vertical direction.

Figure 5:
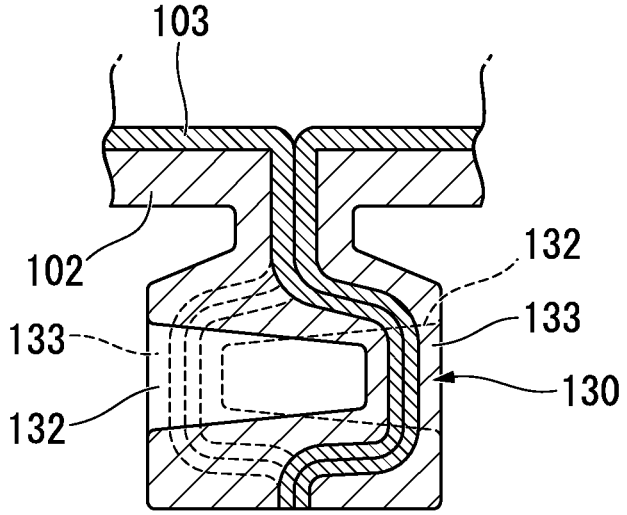
FIG. 5 is a cross-sectional view taken along 5-5 line of a holding rib shown in FIG. 4.

The outer layer 102 and the inner layer 103 are molded through, for example, blow molding into a lamination-separable state, and thereafter, as shown in FIG. 5, an external force is added to a part of the bottom section of the outer layer 102 from two sides of the part in a bottle radial direction in a state where the part of the bottom section of the outer layer 102 pinches a part of a bottom section of the inner layer 103, whereby the parts are united to each other, and thus the holding rib 130 is formed.

It is preferable that the holding rib 130 be formed by pinch-off parts of molds pinching a part to be formed into the holding rib 130 at the time of blow molding. In this case, the holding rib 130 is formed on a parting line of the molds along the parting line. In addition, it is further preferable that at the time of forming the holding rib 130, using pins provided on the pinch-off parts and projecting therefrom, recessed holes 132 having a horizontal-hole shape be formed to be arranged in the longitudinal direction of the holding rib 130 so that adjacent recessed holes 132 open in opposing directions. That is, the recessed holes 132 are alternately formed on two side surfaces of the holding rib 130. Therefore, pressure-uniting parts 133 (intruding parts), in which the outer layer 102 and the inner layer 103 are united to each other through pressure, can be alternately disposed along the holding rib 130, and thus the reliability of holding the inner layer 103 can be efficiently improved.

Figure 3:
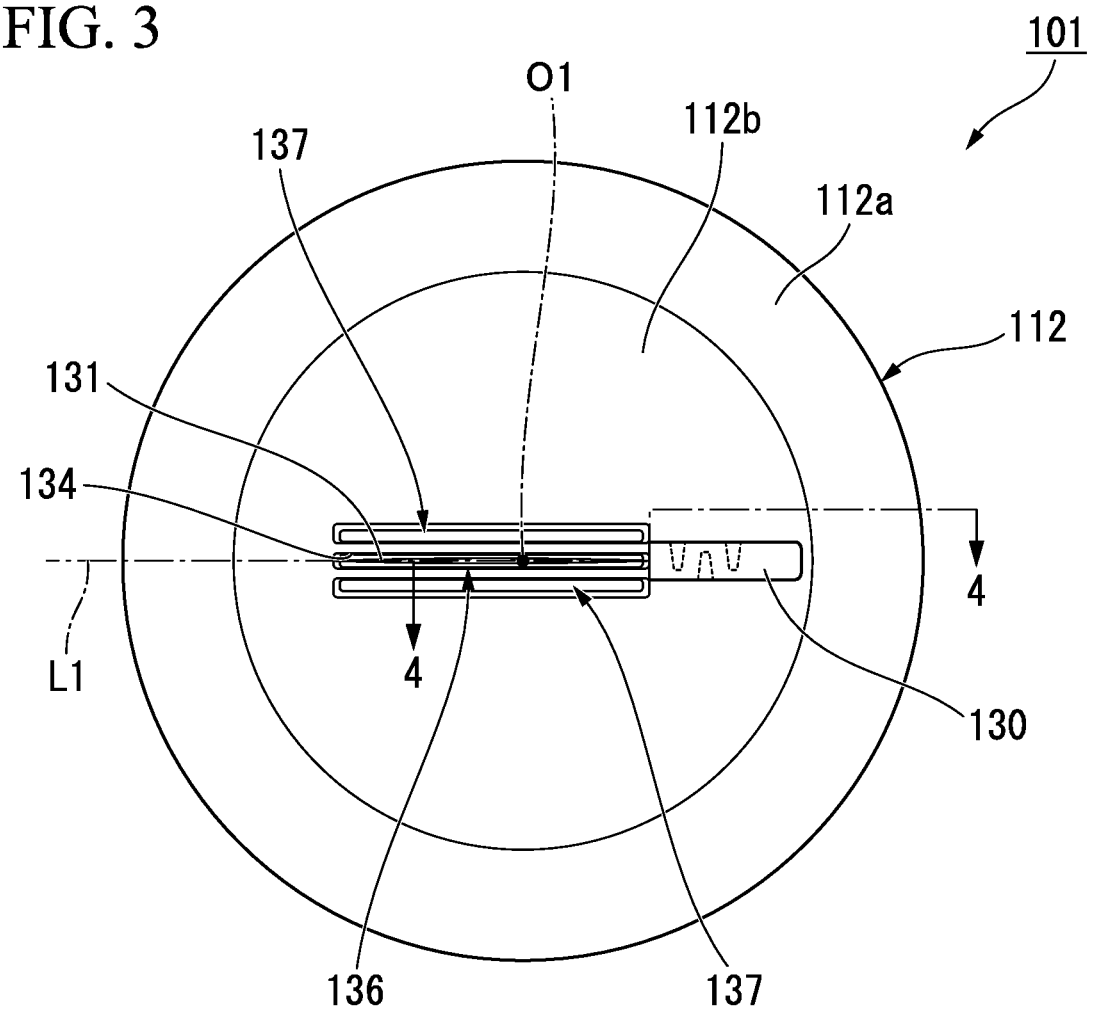
FIG. 3 is a bottom view of a bottle bottom portion of the laminated bottle shown in FIG. 1.

As shown in FIGS. 3 and 4, the first recess 136 is formed in the bottom section of the outer layer 102 at a position apart from the holding rib 130 (at a position different from the holding rib 130). The first recess 136 is formed within the bottom section of the outer layer 102 on an extended line L1 from the holding rib 130, and extends along the extended line L1. The first recess 136 traverses the bottle axis O1 in the bottle radial direction. In addition, the extended line L1 is disposed at an equivalent position to the above-described parting line.

A pair of second recesses 137 extend parallel to the first recess 136 and are disposed next to the first recess 136 so that the first recess 136 is interposed between the second recesses 137. The length and width of the second recess 137 are set to be equivalent to the length and width of the first recess 136.

Figure 6:
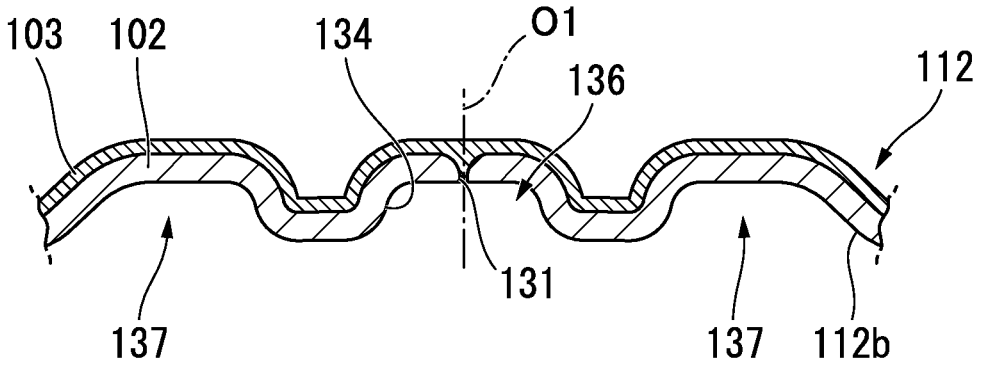
FIG. 6 is a cross-sectional view taken along 6-6 line of the bottle bottom portion shown in FIG. 4.
Figure 7:
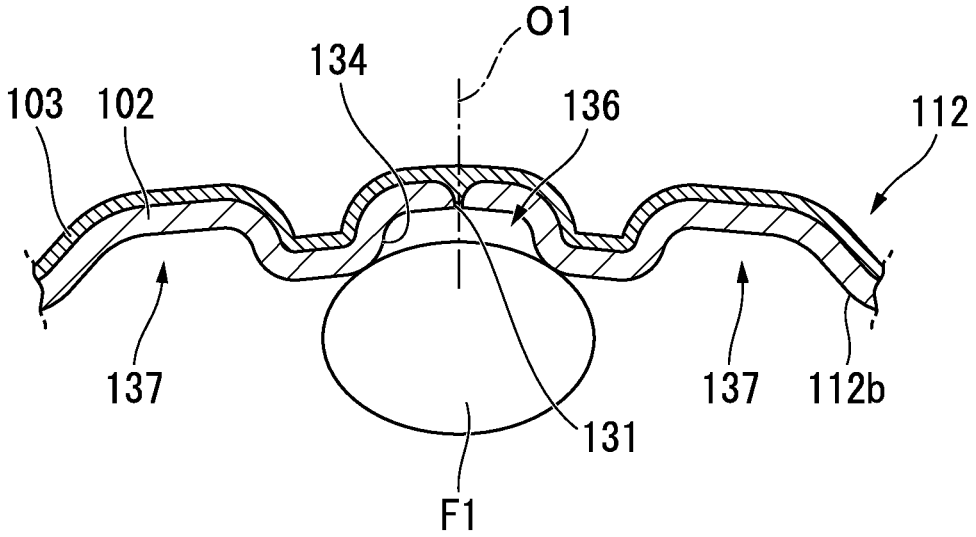
FIG. 7 is a cross-sectional view taken along 6-6 line of the bottle bottom portion shown in FIG. 4 and is a view showing a state where a finger of a user contacts the bottle bottom portion.

As shown in FIG. 6, the first recess 136 and the second recesses 137 are recessed by parts of the bottle bottom portion 112 projecting inward of the bottle in the bottle axis O1 direction. The width of each of the first recess 136 and the second recesses 137 gradually decreases inward from outside of the bottle in the bottle axis O1 direction. As shown in FIG. 7, the width of each of the first recess 136 and the second recesses 137 is set to be less than the width of a finger of a user, and thereby a finger F1 cannot enter each inside of the first recess 136 and the second recesses 137.

As shown in FIG. 3, the intake hole 131 is formed in the bottom section of the outer layer 102 at a position apart from the holding rib 130 (at a positioned different from the holding rib 130). The intake hole 131 is formed in a bottom wall surface (a bottom wall) of the first recess 136. The intake hole 131 is formed within the bottom wall surface of the first recess 136 on the extended line L1 from the holding rib 130, and extends along the extended line L1. As shown in FIGS. 3 and 4, the intake hole 131 is a linearly extending slit, and extends on the entire length (the entire length in the longitudinal direction) of the bottom wall surface of the first recess 136, thereby traversing the bottle axis O1 in the bottle radial direction.

In this embodiment, the bottom section of the outer layer 102 is provided with a surrounding wall 134 which is disposed in an opening edge part of the intake hole 131 on the entire circumference thereof. The surrounding wall 134 extends (projects) outward of the bottle in the bottle axis O1 direction and surrounds the periphery of the intake hole 131. In the example shown in the drawings, the surrounding wall 134 is formed of a side wall surface (a side wall) of the first recess 136 and continuously encircles the periphery of the intake hole 131 on the entire circumference thereof. In addition, as shown in FIG. 6, although the surrounding wall 134 surrounds the intake hole 131, the surrounding wall 134 is disposed apart from the opening edge of the intake hole 131. That is, the diameter (opening width) of the opening formed of the surrounding wall 134 is set to be greater than the diameter (opening width) of the intake hole 131.

As shown in FIGS. 1 and 2, a part of the outer layer 102 in the bottle circumferential direction and a part of the inner layer 103 in the bottle circumferential direction are fixed to each other via a fixing part 135. The fixing part 135 is, for example, a bonding layer, and bonds the inner layer 103 to the outer layer 102 so that the inner layer 103 is inseparable from the outer layer 102. The fixing part 135 is formed in a strip shape extending in the bottle axis O1 direction on the entire length (the entire length in the longitudinal direction) of the bottle body portion 111, and is positioned on a side of the bottle opposite to the holding rib 130 in the bottle radial direction across the bottle axis O1.

Furthermore, in this embodiment, the fixing part 135 extends inward of the bottle in the bottle radial direction from the lower end part of the bottle body portion 111 connected to the bottle bottom portion 112, and thus is also formed in the bottle bottom portion 112. That is, the fixing part 135 is provided in both of the bottle body portion 111 and the bottle bottom portion 112.

(Operation of Laminated Bottle)

Next, a case where contents are discharged from the discharge container 42 including the laminated bottle 101 having the above configurations is described.

In this case, as shown in FIG. 1, the cover 45 of the discharge cap 41 is rotated around the hinge part 60, thereby opening the discharge port 40, and thereafter, for example, squeeze deformation (resilient deformation) is applied to the outer layer 102 of the laminated bottle 101, whereby the inner layer 103 is deformed together with the outer layer 102 so as to reduce the volume of the inner layer 103, and the internal pressure of the inner layer 103 is increased. Therefore, the valve body 48 separates from the diameter-decreasing part 54, the inside of the inner layer 103 and the discharge port 40 are communicated with each other through the communication passageway 59, and the contents contained in the inner layer 103 are discharged from the discharge port 40 through the communication passageway 59.

Thereafter, when increase of the internal pressure of the inner layer 103 stops or the internal pressure thereof decreases by stopping or releasing the squeeze deformation of the laminated bottle 101, the valve body 48 returns to the original position thereof and is seated on the diameter-decreasing part 54, and thus discharge of the contents is stopped.

At this time, when the squeeze deformation of the laminated bottle 101 is released, although the outer layer 102 begins to deform and returns to the original shape thereof, outside air does not easily flow into the inner layer 103 through the diameter-decreasing part 54 because the valve body 48 is seated on the diameter-decreasing part 54, whereby a negative pressure occurs in a space between the outer layer 102 and the inner layer 103, and thus outside air is imported into the space between the outer layer 102 and the inner layer 103 through the intake hole 131. Therefore, as shown by dashed double-dotted lines in FIG. 1, even when the outer layer 102 returns to the original shape thereof, the volume-reduction deformation of the inner layer 103 can be maintained by the inner layer 103 being separated from the outer layer 102. At this time, since the holding rib 130 formed in the bottom section of the outer layer 102 pinches and integrally holds the inner layer 103, it is possible to efficiently prevent lift of the inner layer 103. Furthermore, in this embodiment, since the fixing part 135, which is positioned on a side of the bottle opposite to the holding rib 130 in the bottle radial direction across the bottle axis O1 and extends in the bottle axis O1 direction on the entire length of the bottle body portion 111, is also disposed in the lower end part of the bottle body portion 111 connected to the bottle bottom portion 112, the fixing part 135 can prevent lift of the inner layer 103 as well as the holding rib 130.

In addition, since the fixing part 135 in this embodiment is positioned on a side of the bottle opposite to the holding rib 130 in the bottle radial direction across the bottle axis O1 and is provided in both of the bottle body portion 111 and the bottle bottom portion 112, it is possible to further efficiently prevent lift of the inner layer 103.

In the above way, in a state where an intermediate space is formed between the outer layer 102 and the inner layer 103 by separating the inner layer 103 from the outer layer 102, when squeeze deformation is applied again to the outer layer 102 of the laminated bottle 101 in order to discharge the contents, the internal pressure of the intermediate space is increased, and thus the outer layer 102 indirectly presses the inner layer 103 via the intermediate space (via gas inside the intermediate space), thereby causing volume-reduction deformation of the inner layer 103. Additionally, at this time, if the internal pressure (internal gas) of the intermediate space is released outward of the bottle through the intake hole 131, the inner circumferential surface of the outer layer 102 can contact the outer circumferential surface of the inner layer 103 by shrinking or eliminating the intermediate space, and thus the outer layer 102 can directly press the inner layer 103, thereby causing volume-reduction deformation of the inner layer 103.

As described above, according to the laminated bottle 101 of this embodiment, since the lift of the inner layer 103 can be efficiently limited, it is possible to accurately control the volume-reduction deformation of the inner layer 103. Accordingly, it is possible to prevent a discharge failure or an increase in the amount of contents remaining.

In addition, since the outer layer 102 is formed to accept squeeze deformation, it is possible to increase the internal pressure of the inner layer 103 by applying the squeeze deformation to the outer layer 102, and thus to discharge through the bottle mouth portion 110, the contents contained in the inner layer 103. Therefore, the laminated bottle 101 can be applied to various uses.

Since the bottom section of the outer layer 102 is provided with the surrounding wall 134, as shown in FIG. 7, when the finger F1 of a user or the supporting surface (not shown) on which the laminated bottle 101 is put contacts the bottle bottom portion 112, the surrounding wall 134 can prevent the finger F1 or the supporting surface from reaching the intake hole 131. Accordingly, water, dust or the like can be prevented from entering a space between the outer layer 102 and the inner layer 103 through the intake hole 131, and blockage of the intake hole 131 by filling the intake hole 131 with water, dust or the like can be prevented. Since an air flow through the intake hole 131 can be appropriately maintained, it is possible to reliably cause volume-reduction deformation to the inner layer 103 by inflow of outside air.

The bottom wall surface of the first recess 136 is provided with the intake hole 131, and the side wall surface of the first recess 136 forms the surrounding wall 134. Therefore, it is possible to simplify the structure and manufacture of the laminated bottle 101.

Since the intake hole 131 is formed in the bottom wall surface of the first recess 136, an area of the bottom section of the outer layer 102 in which the intake hole 131 is formed can be reinforced with the recess and rib effect of the first recess 136. Therefore, an unexpected increase of the opening area of the intake hole 131 due to an external force added to the outer layer 102 at the time the inner layer 103 performs volume-reduction deformation can be limited, and thus the inner layer 103 can accurately perform the volume-reduction deformation.

Since the holding rib 130 is formed in the bottle radial direction radiating from the bottle axis O1, the holding rib 130 can be easily formed in the outer layer 102, and can easily pinch the inner layer 103, thereby reliably holding the inner layer 103, during the manufacture of the laminated bottle 101. Furthermore, since it is only necessary to form the intake hole 131 on the extended line L1 from the holding rib 130 along the extended line L1, the holding rib 130 and the intake hole 131 can be easily formed at the same time.

Since the intake hole 131 is provided on the extended line L1 from the holding rib 130 and extends along the extended line L1, it is possible to easily and accurately adjust the length of the intake hole 131 by altering the length of the holding rib 130. Therefore, for example, when a space between the outer layer 102 and the inner layer 103 has a negative pressure, it is possible to easily and accurately control the degree of opening of the intake hole 131, and to prevent unexpected large opening of the intake hole 131.

Since the intake hole 131 is formed in the bottle bottom portion 112, it is possible to hide the intake hole 131 during the normal placement of the bottle, and the bottle body portion can have a smooth surface on the entire circumference thereof. Accordingly, it is possible to prevent deterioration in appearance or in decoration acceptability of the laminated bottle 101.

Since the pair of second recesses 137 extend parallel to the intake hole 131 and are disposed next to the intake hole 131 so that the intake hole 131 is interposed between the second recesses 137, an unexpected increase of the opening area of the intake hole 131 can be prevented by reinforcing the bottom section of the outer layer 102 with the recess and rib effect of the second recesses 137, and the intake hole 131 can become unnoticeable by disposing the second recesses 137 in the bottom section of the outer layer 102 so that the intake hole 131 is interposed between the second recesses 137. Accordingly, it is possible to improve the appearance of the laminated bottle 101, and to easily design the laminated bottle 101 to have an excellent design.

Since the intake hole 131 is interposed between the pair of the second recesses 137, as shown in FIG. 7, at the time the finger F1 of a user contacts the bottle bottom portion 112, it is possible to cause flexural deformation to areas of the outer layer 102 in which the second recesses 137 are formed, and to reliably prevent the finger F1 from reaching the intake hole 131.

Since the holding rib 130 and the intake hole 131 are formed in the recessed portion 112*b* of the bottle bottom portion 112 positioned on an inner side of the bottle, even if the holding rib 130 is formed projecting outward of the bottle, it is possible to prevent the holding rib 130 from contacting the supporting surface at the time the laminated bottle 101 is put on the supporting surface, and to secure placing stability of the laminated bottle 101. In addition, the inflow of outside air through the intake hole 131 is not easily disturbed, and water, dust or the like is less likely to enter a space between the outer layer 102 and the inner layer 103 through the intake hole 131.

Since the holding rib 130 and the fixing part 135 hold the inner layer 103 on the outer layer 102 at two parts positioned to be opposite to each other in the bottle radial direction across the bottle axis O1, it is possible to crush the inner layer 103 flatwise and uniformly in the vicinity of the center of the bottle in accordance with the volume-reduction deformation thereof, and to further reduce the amount of contents remaining.

As shown in FIGS. 1 and 2, since one fixing part 135 is formed in the bottle body portion 111 and is formed into a strip shape extending in the bottle axis O1 direction, the outer layer 102 and the inner layer 103 can be separated from each other in a wide area corresponding to approximately the entire area of the bottle body portion 111 in the bottle circumferential direction except for a part of the bottle body portion 111 in which the fixing part 135 is formed. Thus, when outside air imported into a space between the outer layer 102 and the inner layer 103 from the intake hole 131 reaches the bottle body portion 111, it is possible to prevent the outside air from concentrating into a part of the bottle body portion 111 in the bottle circumferential direction, and to easily make the outside air reach every part on the enter circumference of the bottle. Therefore, the import of air from the intake hole 131 can be smoothly performed.

(Second Embodiment)

Hereinafter, a second embodiment of the laminated bottle of the present invention is described with reference to the drawings.

(Structure of Laminated Bottle)

Figure 8:
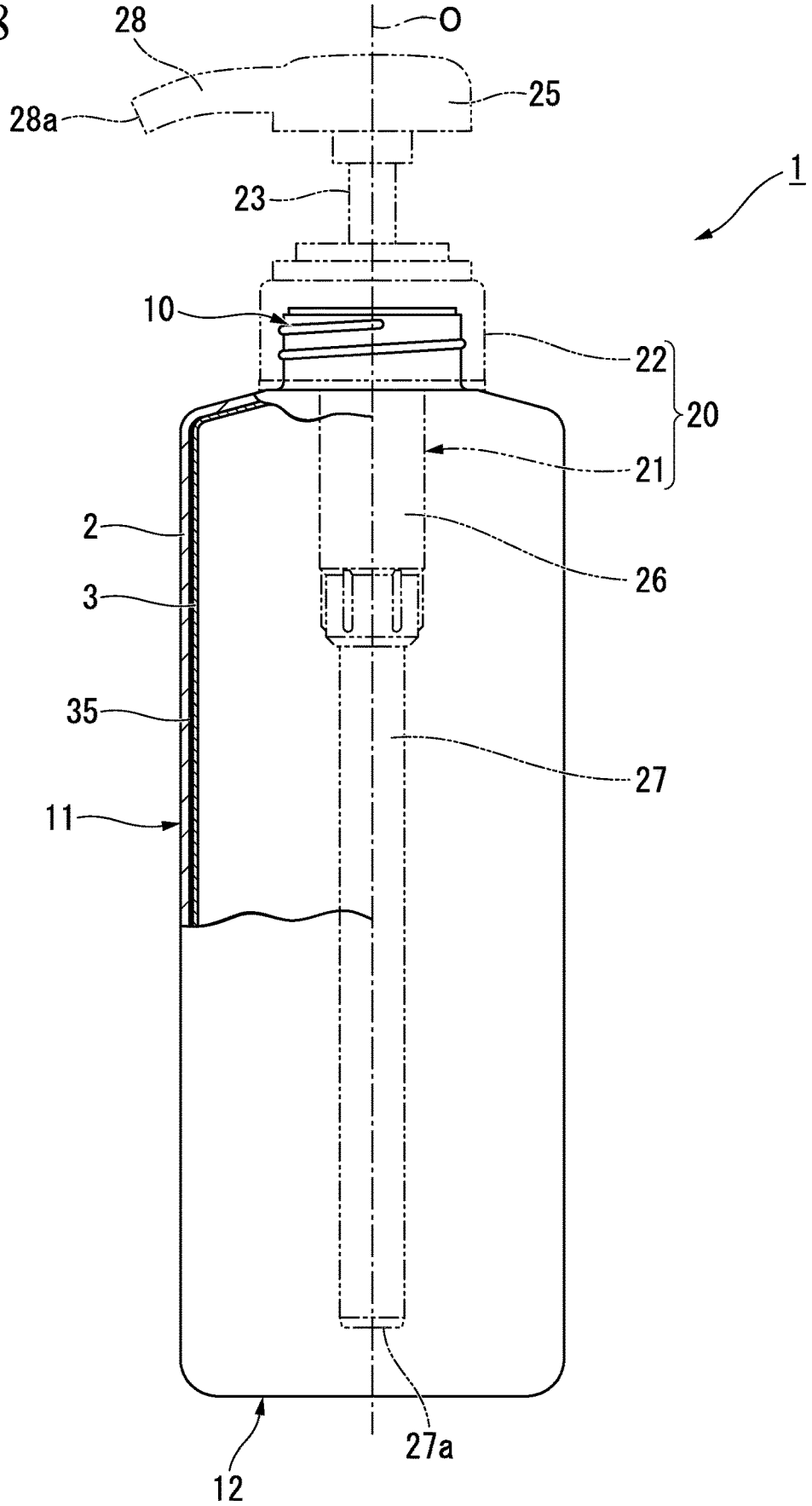
FIG. 8 is a view showing a second embodiment of the laminated bottle of the present invention and is a side view (partial cross-sectional view) showing a state where a dispenser is attached to the bottle.
Figure 9:
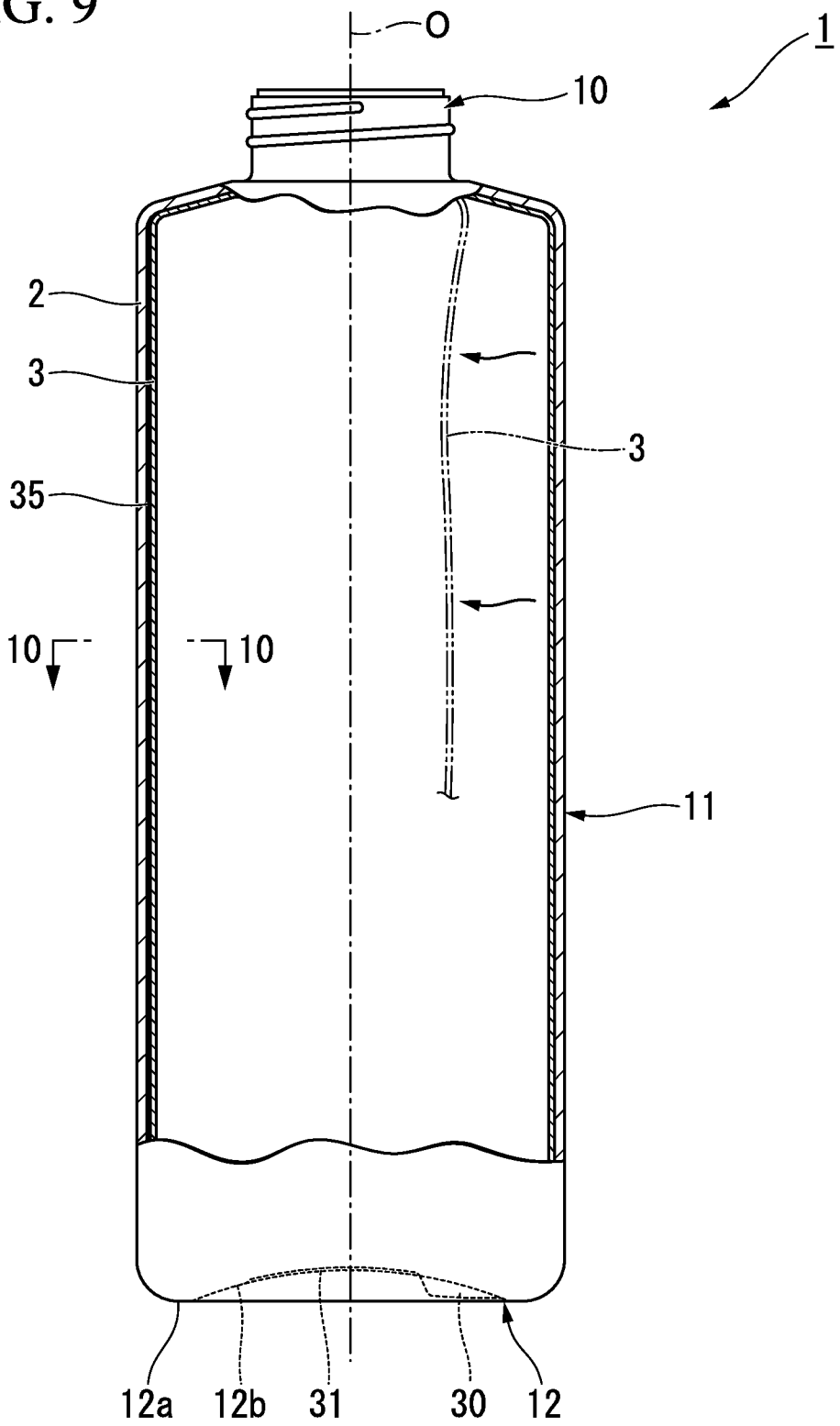
FIG. 9 is a cross-sectional view (partial side view) of the laminated bottle shown in FIG. 8.
Figure 10:
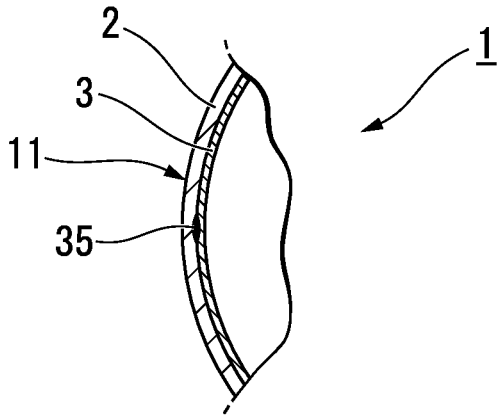
FIG. 10 is a cross-sectional view taken along 10-10 line in FIG. 9.

As shown in FIGS. 8 to 10, a laminated bottle 1 of this embodiment includes an outer layer 2, and a flexible inner layer 3 in which contents (not shown) are contained and which is configured to perform volume-reduction deformation (shrinkage deformation) in accordance with a decrease in the amount of contents. The laminated bottle 1 is a delamination bottle (a lamination-separable container) formed in a cylindrical shape with a bottom, in which the inner layer 3 is separably laminated onto an inner surface of the outer layer 2.

In this embodiment, the "outer layer" denotes an outer container forming an outer portion of the laminated bottle 1, and the "inner layer" denotes an inner container (inner bag) forming an inner portion of the laminated bottle 1.

The outer layer 2 and the inner layer 3 are formed of, for example, a polyester resin such as a polyethylene terephthalate resin or a polyethylene naphthalate resin, a polyolefin resin such as a polyethylene resin or a polypropylene resin, a polyamide resin such as nylon, or an ethylene vinyl alcohol copolymer resin. A combination of these resins is used so that the outer layer 2 and the inner layer 3 are separable from each other (so that these layers have no compatibility).

The laminated bottle 1 includes a bottle mouth portion 10, a bottle body portion 11, and a bottle bottom portion 12 which are continuously provided in this order in a bottle axis O direction. In this embodiment, the side of the bottle close to the bottle mouth portion 10 in the bottle axis O direction is called the upper side thereof, the side of the bottle close to the bottle bottom portion 12 in the bottle axis O direction is called the lower side thereof, a direction orthogonal to the bottle axis O is called a bottle radial direction, and a direction going around the bottle axis O is called a bottle circumferential direction. The bottle axis O denotes the central axis of the laminated bottle 1.

The bottle mouth portion 10 is attached with a dispenser 20. The dispenser 20 is a pump-type dispenser which discharges contents using a pump. The dispenser 20 includes a dispenser main body 21, and an attachment cap 22 which screws the dispenser main body 21 on the bottle mouth portion 10.

The dispenser main body 21 includes a pump portion having an erect stem 23 capable of being pushed downward in a state where an upward force is always added to the stem 23, and a push head 25 attached to the upper end part of the stem 23.

The pump portion is an extruder which extrudes contents by the stem 23 being pushed down. The pump portion has a cylindrical pipe 26 integrally attached to the attachment cap 22, and a piston pipe (not shown) inserted into the cylindrical pipe 26 and being movable vertically.

The stem 23 is attached to the upper part of the piston pipe and communicates with the piston pipe. The piston pipe and the stem 23 always receive an upward force from a coil spring (not shown).

The lower end part of the cylindrical pipe 26 is attached with a suctioning pipe 27 extending to the vicinity of the bottle bottom portion 12 of the laminated bottle 1.

The push head 25 is an operation member formed in a cylindrical shape with a top, which is used to push down the stem 23.

The push head 25 is provided with a discharge nozzle 28 having a discharge port 28*a* which communicates with the stem 23 and opens outward of the bottle in the bottle radial direction.

As shown in FIGS. 9 to 12, the bottle bottom portion 12 includes a grounding portion 12*a* and a recessed portion 12*b*. The grounding portion 12*a* is connected to the bottle body portion 11 and is positioned at the outer circumferential edge part of the bottle bottom portion 12. The recessed portion 12*b* is connected to the grounding portion 12*a* from inside of the bottle in the bottle radial direction and is positioned on an inner side of the bottle than the grounding portion 12*a*.

A bottom section of the outer layer 2 positioned at the bottle bottom portion 12 is provided with a holding rib 30 pinching and integrally holding the inner layer 3, an intake hole 31 (intake gap) allowing outside air to be imported into a space between the outer layer 2 and the inner layer 3, and a first recess 36 and second recesses 37 which are recessed inward of the bottle in the bottle axis O direction. The holding rib 30, the intake hole 31, the first recess 36 and the second recesses 37 are formed in the recessed portion 12*b* of the bottle bottom portion 12.

The holding rib 30 projects downward (outward of the bottle) from the recessed portion 12*b*. The rib height of the holding rib 30 is set so that the holding rib 30 is accommodated in the internal space of the recessed portion 12*b*.

Figure 12:
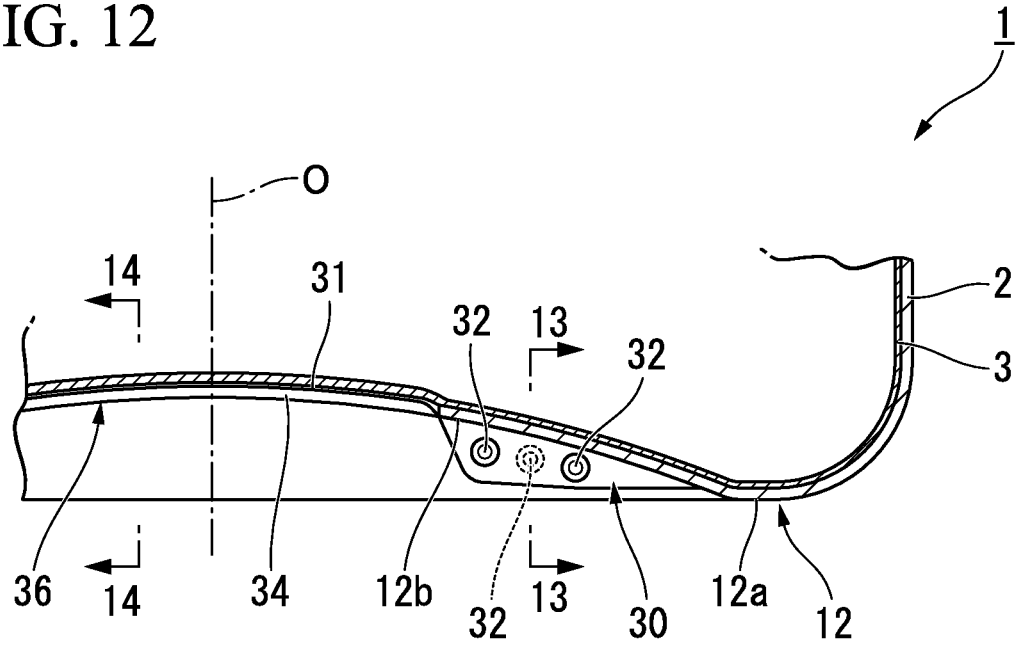
FIG. 12 is a cross-sectional view taken along 12-12 line of the bottle bottom portion shown in FIG. 11.

As shown in FIG. 12, the holding rib 30 is provided extending in the bottle radial direction, and the length of the holding rib 30 in the bottle radial direction is less than the radius of the bottle bottom portion 12. Only one holding rib 30 is provided at a position apart from the bottle axis O (at a position different from the bottle axis O). The outer end part of the holding rib 30 positioned on an outer side of the bottle in the bottle radial direction is connected to the inner circumferential edge of the grounding portion 12*a*, and the inner end part of the holding rib 30 positioned on an inner side of the bottle in the bottle radial direction extends so as to be a linear shape inclining relative to the bottle axis O. In addition, the upper side of FIG. 12 is the upper side of the bottle in the vertical direction.

Figure 13:
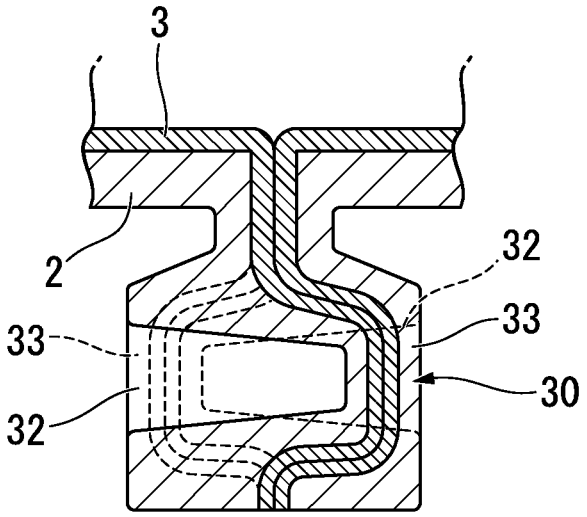
FIG. 13 is a cross-sectional view taken along 13-13 line of a holding rib shown in FIG. 12.

The outer layer 2 and the inner layer 3 are molded through, for example, blow molding in a lamination-separable state, and thereafter, as shown in FIG. 13, an external force is added to a part of the bottom section of the outer layer 2 from two sides of the part in a bottle radial direction in a state where the part of the bottom section of the outer layer 2 pinches a part of a bottom section of the inner layer 3, whereby the parts are united to each other, and thus the holding rib 30 is formed.

It is preferable that the holding rib 30 be formed by pinch-off parts of molds pinching a part to be formed into the holding rib 30 at the time of blow molding. In this case, the holding rib 30 is formed on a parting line of the molds along the parting line. In addition, it is further preferable that at the time of forming the holding rib 30, using pins provided on the pinch-off parts and projecting therefrom, recessed holes 32 having a horizontal-hole shape be formed to be arranged in the longitudinal direction of the holding rib 30 so that adjacent recessed holes 32 open in opposing directions. That is, the recessed holes 32 are alternately formed on two side surfaces of the holding rib 30. Therefore, pressure-uniting parts 33 (intruding parts), in which the outer layer 2 and the inner layer 3 are united to each other through pressure, can be alternately disposed along the holding rib 30, and thus the reliability of holding the inner layer 3 can be efficiently improved.

Figure 11:
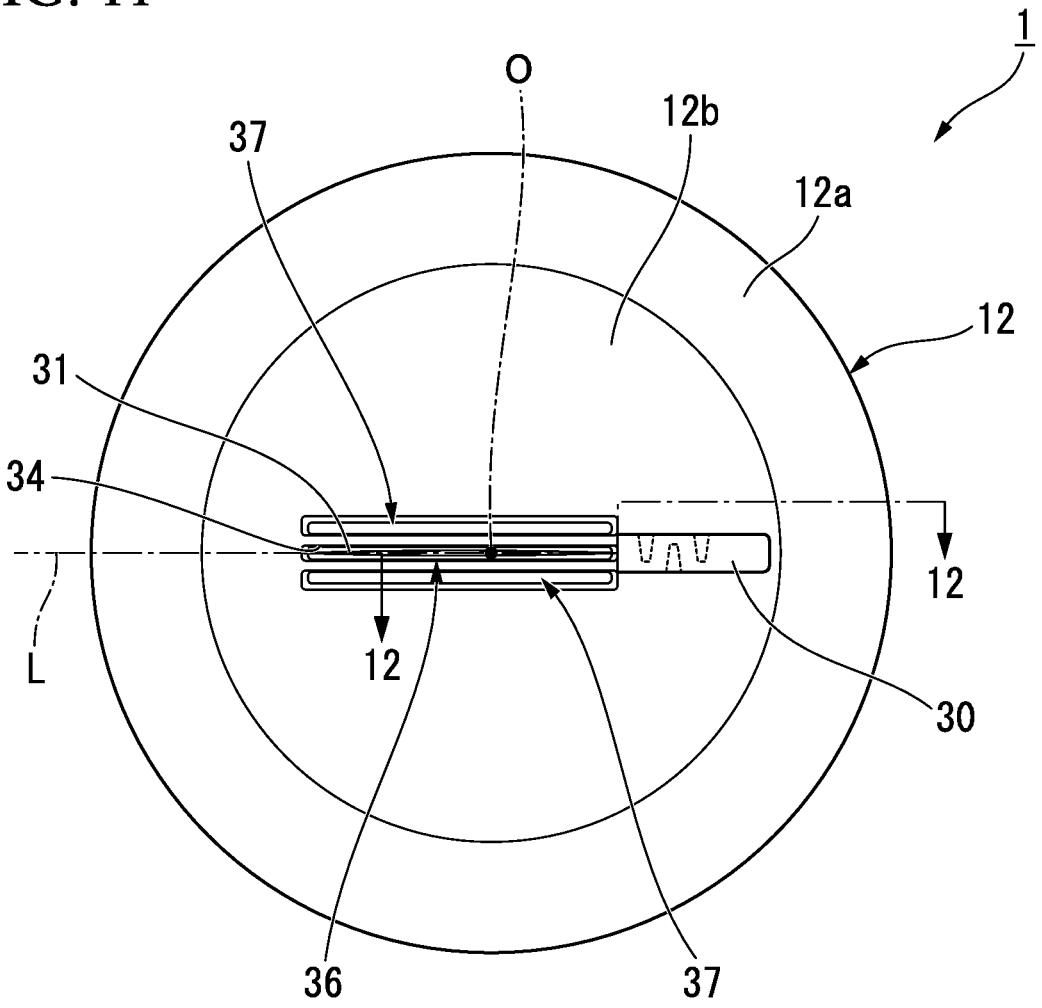
FIG. 11 is a bottom view of a bottle bottom portion of the laminated bottle shown in FIG. 9.

As shown in FIGS. 11 and 12, the first recess 36 is formed in the bottom section of the outer layer 2 at a position apart from the holding rib 30 (at a position different from the holding rib 30). The first recess 36 is formed within the bottom section of the outer layer 2 on an extended line L from the holding rib 30, and extends along the extended line L. The first recess 36 traverses the bottle axis O in the bottle radial direction. In addition, the extended line L is disposed at an equivalent position to the above-described parting line.

A pair of second recesses 37 extend parallel to the first recess 36 and are disposed next to the first recess 36 so that the first recess 36 is interposed between the second recesses 37. The length and width of the second recess 37 are set to be equivalent to the length and width of the first recess 36.

Figure 14:
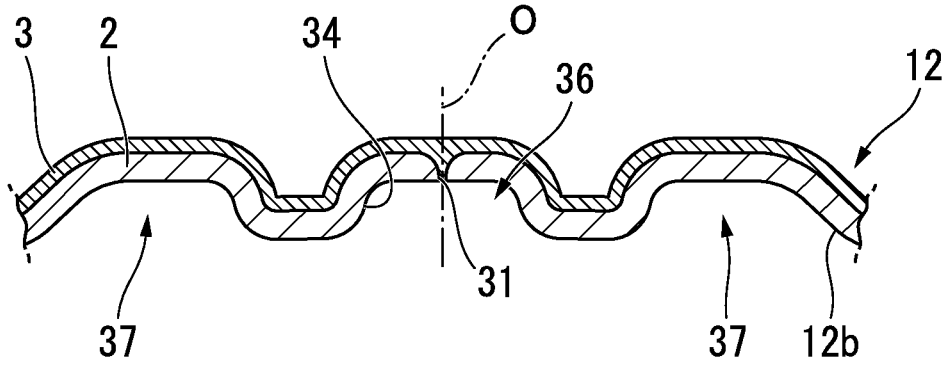
FIG. 14 is a cross-sectional view taken along 14-14 line of the bottle bottom portion shown in FIG. 12.
Figure 15:
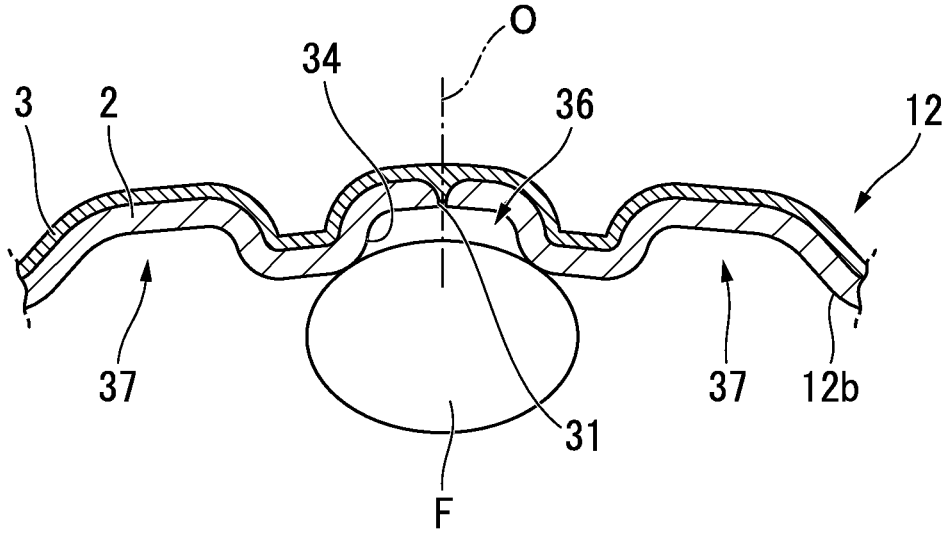
FIG. 15 is a cross-sectional view taken along 14-14 line of the bottle bottom portion shown in FIG. 12 and is a view showing a state where a finger of a user contacts the bottle bottom portion.

As shown in FIG. 14, the first recess 36 and the second recesses 37 are recessed by parts of the bottle bottom portion 12 projecting inward of the bottle in the bottle axis O direction. The width of each of the first recess 36 and the second recesses 37 gradually decreases inward from outside of the bottle in the bottle axis O direction. As shown in FIG. 15, the width of each of the first recess 36 and the second recesses 37 is set to be less than the width of a finger of a user, and thereby a finger F cannot enter each inside of the first recess 36 and the second recesses 37.

As shown in FIG. 11, the intake hole 31 is formed in the bottom section of the outer layer 2 at a position apart from the holding rib 30 (at a positioned different from the holding rib 30). The intake hole 31 is formed in a bottom wall surface (a bottom wall) of the first recess 36. The intake hole 31 is formed within the bottom wall surface of the first recess 36 on the extended line L from the holding rib 30, and extends along the extended line L. As shown in FIGS. 11 and 12, the intake hole 31 is a linearly extending slit, and extends on the entire length (the entire length in the longitudinal direction) of the bottom wall surface of the first recess 36, thereby traversing the bottle axis O in the bottle radial direction.

In this embodiment, the bottom section of the outer layer 2 is provided with a surrounding wall 34 which is disposed in an opening edge part of the intake hole 31 on the entire circumference thereof. The surrounding wall 34 extends (projects) outward of the bottle in the bottle axis O direction and surrounds the periphery of the intake hole 31. In the example shown in the drawings, the surrounding wall 34 is formed of a side wall surface (a side wall) of the first recess 36 and continuously encircles the periphery of the intake hole 31 on the entire circumference thereof. In addition, as shown in FIG. 14, although the surrounding wall 34 surrounds the intake hole 31, the surrounding wall 34 is disposed apart from the opening edge of the intake hole 31. That is, the diameter (opening width) of the opening formed of the surrounding wall 34 is set to be greater than the diameter (opening width) of the intake hole 31.

As shown in FIGS. 9 and 10, a part of the outer layer 2 in the bottle circumferential direction and a part of the inner layer 3 in the bottle circumferential direction are fixed to each other via a fixing part 35. The fixing part 35 is, for example, a bonding layer, and bonds the inner layer 3 to the outer layer 2 so that the inner layer 3 is inseparable from the outer layer 2. The fixing part 35 is formed in a strip shape extending in the bottle axis O direction on the entire length (the entire length in the longitudinal direction) of the bottle body portion 11 and is positioned on a side of the bottle opposite to the holding rib 30 in the bottle radial direction across the bottle axis O.

(Operation of Laminated Bottle)

Next, a case where contents are discharged using the dispenser 20 attached to the laminated bottle 1 having the above configurations is described.

In this case, the stem 23 is pushed down by a push-down operation of the push head 25, and thus the contents contained in the inner layer 3 are suctioned up from a suctioning port 27*a* which opens at the lower end of the suctioning pipe 27. Then, the suctioned contents are injected into the discharge nozzle 28 of the push head 25 through the stem 23. Therefore, it is possible to discharge the contents outward of the bottle through the discharge port 28*a* of the discharge nozzle 28.

When the contents are suctioned up, although the inner layer 3 begins to perform volume-reduction deformation as shown by dashed double-dotted lines in FIG. 9, the shape of the outer layer 2 is maintained, whereby a negative pressure occurs in a gap between the inner layer 3 and the outer layer 2. Thus, outside air is imported into the gap between the outer layer 2 and the inner layer 3 through the intake hole 31. Therefore, it is possible to separate only the inner layer 3 from the outer layer 2 in accordance with discharge of the contents without deforming the outer layer 2, thereby causing volume-reduction deformation to the inner layer 3. At this time, since the holding rib 30 formed in the bottom section of the outer layer 2 pinches and integrally holds the inner layer 3, it is possible to efficiently prevent lift of the inner layer 3 during the volume-reduction deformation thereof. Furthermore, in this embodiment, since the fixing part 35, which is positioned on a side of the bottle opposite to the holding rib 30 in the bottle radial direction across the bottle axis O and extends in the bottle axis O direction on the entire length of the bottle body portion 11, is also disposed in the lower end part of the bottle body portion 11 connected to the bottle bottom portion 12, the fixing part 35 can prevent lift of the inner layer 3 as well as the holding rib 30.

As described above, according to the laminated bottle 1 of this embodiment, since the lift of the inner layer 3 can be efficiently limited, it is possible to accurately control the volume-reduction deformation of the inner layer 3. Additionally, even when as shown in this embodiment, the laminated bottle 1 is attached with the dispenser 20 having the suctioning pipe 27 extending to the vicinity of the bottle bottom portion 12, it is possible to prevent the inner layer 3 from blocking the suctioning port of the suctioning pipe 27. Accordingly, it is possible to prevent a discharge failure or an increase in the amount of contents remaining.

Since the bottom section of the outer layer 2 is provided with the surrounding wall 34, as shown in FIG. 15, when the finger F of a user or the supporting surface (not shown) on which the laminated bottle 1 is put contacts the bottle bottom portion 12, the surrounding wall 34 can prevent the finger F or the supporting surface from reaching the intake hole 31. Accordingly, water, dust or the like can be prevented from entering a space between the outer layer 2 and the inner layer 3 through the intake hole 31, and blockage of the intake hole 31 by filling the intake hole 31 with water, dust or the like can be prevented. Since an air flow through the intake hole 31 can be appropriately maintained, it is possible to reliably cause volume-reduction deformation to the inner layer 3 by inflow of outside air.

The bottom wall surface of the first recess 36 is provided with the intake hole 31, and the side wall surface of the first recess 36 forms the surrounding wall 34. Therefore, it is possible to simplify the structure and manufacture of the laminated bottle 1.

Since the intake hole 31 is formed in the bottom wall surface of the first recess 36, an area of the bottom section of the outer layer 2 in which the intake hole 31 is formed can be reinforced with the recess and rib effect of the first recess 36. Therefore, an unexpected increase of the opening area of the intake hole 31 due to an external force added to the outer layer 2 at the time the inner layer 3 performs volume-reduction deformation can be limited, and thus the inner layer 3 can accurately perform the volume-reduction deformation.

Since the holding rib 30 is formed in the bottle radial direction radiating from the bottle axis O, the holding rib 30 can be easily formed in the outer layer 2, and can easily pinch the inner layer 3, thereby reliably holding the inner layer 3, during the manufacture of the laminated bottle 1. Furthermore, since it is only necessary to form the intake hole 31 on the extended line L from the holding rib 30 along the extended line L, the holding rib 30 and the intake hole 31 can be easily formed at the same time.

Since the intake hole 31 is provided on the extended line L from the holding rib 30 and extends along the extended line L, it is possible to easily and accurately adjust the length of the intake hole 31 by altering the length of the holding rib 30. Therefore, for example, when a space between the outer layer 2 and the inner layer 3 has a negative pressure, it is possible to easily and accurately control the degree of opening of the intake hole 31, and to prevent unexpected large opening of the intake hole 31.

Since the intake hole 31 is formed in the bottle bottom portion 12, it is possible to hide the intake hole 31 during the normal placement of the bottle, and the bottle body portion can have a smooth surface on the entire circumference thereof. Accordingly, it is possible to prevent deterioration in appearance or in decoration acceptability of the laminated bottle 1.

Since the pair of second recesses 37 extend parallel to the intake hole 31 and are disposed next to the intake hole 31 so that the intake hole 31 is interposed between the second recesses 37, an unexpected increase of the opening area of the intake hole 31 can be prevented by reinforcing the bottom section of the outer layer 2 with the recess and rib effect of the second recesses 37, and the intake hole 31 can become unnoticeable by disposing the second recesses 37 in the bottom section of the outer layer 2 so that the intake hole 31 is interposed between the second recesses 37. Accordingly, it is possible to improve the appearance of the laminated bottle 1, and to easily design the laminated bottle 1 to have an excellent design.

Since the intake hole 31 is interposed between the pair of the second recesses 37, as shown in FIG. 15, at the time the finger F of a user contacts the bottle bottom portion 12, it is possible to cause flexural deformation to areas of the outer layer 2 in which the second recesses 37 are formed, and to reliably prevent the finger F from reaching the intake hole 31.

Since the holding rib 30 and the intake hole 31 are formed in the recessed portion 12*b* of the bottle bottom portion 12 positioned on an inner side of the bottle, even if the holding rib 30 is formed projecting outward of the bottle, it is possible to prevent the holding rib 30 from contacting the supporting surface at the time the laminated bottle 1 is put on the supporting surface, and to secure placing stability of the laminated bottle 1. In addition, the inflow of outside air through the intake hole 31 is not easily disturbed, and water, dust or the like is less likely to enter a space between the outer layer 2 and the inner layer 3 through the intake hole 31.

Since the holding rib 30 and the fixing part 35 hold the inner layer 3 on the outer layer 2 at two parts positioned to be opposite to each other in the bottle radial direction across the bottle axis O, it is possible to crush the inner layer 3 flatwise and uniformly in the vicinity of the center of the bottle in accordance with the volume-reduction deformation thereof, and to further reduce the amount of contents remaining.

As shown in FIGS. 8 and 10, since one fixing part 35 is formed in the bottle body portion 11 and is formed into a strip shape extending in the bottle axis O direction, the outer layer 2 and the inner layer 3 can be separated from each other in a wide area corresponding to approximately the entire area of the bottle body portion 11 in the bottle circumferential direction except for a part of the bottle body portion 11 in which the fixing part 35 is formed. Thus, when outside air imported into a space between the outer layer 2 and the inner layer 3 from the intake hole 31 reaches the bottle body portion 11, it is possible to prevent the outside air from concentrating into a part of the bottle body portion 11 in the bottle circumferential direction, and to easily make the outside air reach every part on the enter circumference of the bottle. Therefore, the import of air from the intake hole 31 can be smoothly performed.

The technical scope of the present invention is not limited to the first and second embodiments, and various modifications can be adopted within the scope of and not departing from the gist of the present invention.

Although in the above embodiments, one fixing part 35 or 135 is provided at a part of the bottle body portion 11 or 111 positioned on a side of the bottle opposite to the holding rib 30 or 130 in the bottle radial direction across the bottle axis O or O1, the present invention is not limited thereto. For example, a plurality of fixing parts may be provided in the bottle, and the position of a fixing part may be different from that of the above embodiments.

A fixing part formed in a strip shape extending in the bottle axis direction may continuously extend on the entire range thereof in the bottle axis direction, or may discontinuously extend thereon. That is, the fixing part may be configured of one strip on the entire range thereof in the bottle axis direction, or may be configured of a plurality of strip pieces which are disposed at intervals on the entire range of the fixing part in the bottle axis direction. Furthermore, the fixing part may be configured of a plurality of thin strips which extend in the bottle axis direction and are disposed to be close to each other in the bottle circumferential direction.

The fixing part 35 or 135 or the second recess 37 or 137 may not be provided in the bottle.

Furthermore, an annular ridge, which is disposed at the opening edge part of an intake hole on the entire circumference of the intake hole and projects outward of the bottle in the bottle axis direction so as to surround the periphery of the intake hole, may be provided in the bottom section of an outer layer, instead of the first recess 36 or 136. That is, the configuration of the above embodiments may be changed into another configuration in which a surrounding wall, that is disposed at the opening edge part of an intake hole on the entire circumference of the intake hole and extends outward of the bottle in the bottle axis direction so as to surround the periphery of the intake hole, is formed in the bottom section of an outer layer.

Although in the above embodiments, the intake hole 31 or 131 extends on the extended line L or L1 from the holding rib 30 or 130 along the extended line L or L1, the present invention is not limited thereto.

For example, an intake hole may extend so as to cross the above extended line. Furthermore, an intake hole may be formed to be parallel to a holding rib. That is, the configuration of the above embodiments may be changed into another configuration in which an intake hole is formed within the bottom section of an outer layer at a position different from a holding rib.

Although in the above embodiments, the holding rib 30 or 130 extends in the bottle radial direction, the present invention is not limited thereto. For example, a holding rib may extend so as to cross the bottle radial direction.

Furthermore, although in the above embodiments, only one holding rib 30 or 130 is provided at a position different from the bottle axis O, the present invention is not limited thereto, and two or more holding ribs may be provided in the bottle.

Furthermore, a component of the above embodiments can be replaced with another well-known component within the scope of and not departing from the gist of the present invention, and the above modifications may be combined with each other.

(Third Embodiment)

Hereinafter, a third embodiment of the laminated bottle of the present invention is described with reference to the drawings.

(Structure of Laminated Bottle)

Figure 16:
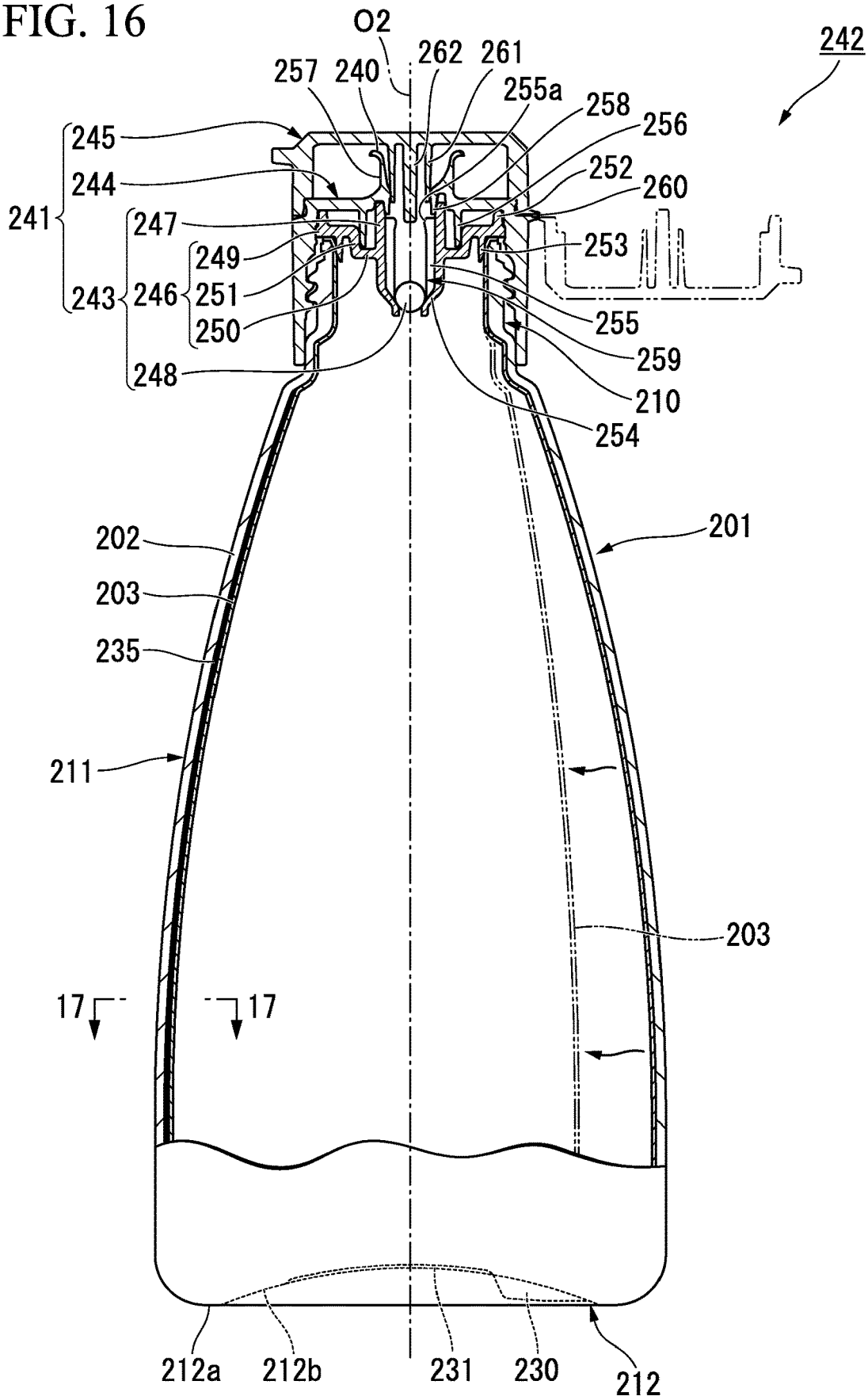
FIG. 16 is a view showing a third embodiment of the laminated bottle of the present invention and is a vertical cross-sectional view (partial side view) showing a state where a discharge cap is attached to the bottle.
Figure 17:
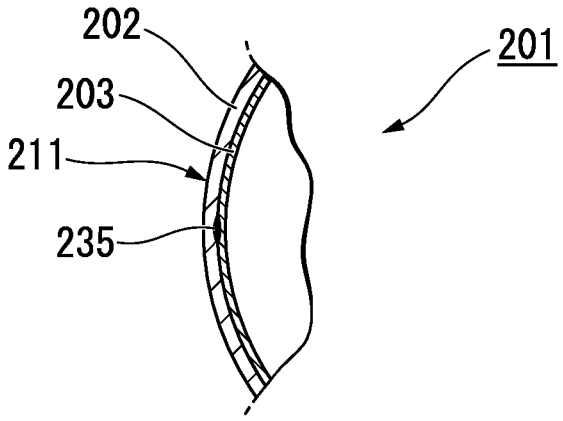
FIG. 17 is a cross-sectional view taken along 17-17 line in FIG. 16.

As shown in FIGS. 16 and 17, a laminated bottle 201 of this embodiment includes an outer layer 202 configured to accept squeeze deformation, and a flexible inner layer 203 in which contents (not shown) are contained and which is configured to perform volume-reduction deformation (shrinkage deformation) in accordance with a decrease in the amount of contents. The laminated bottle 201 is a delamination bottle (a lamination-separable container) formed in a cylindrical shape with a bottom, in which the inner layer 203 is separably laminated onto an inner surface of the outer layer 202.

In this embodiment, the "outer layer" denotes an outer container which forms an outer portion of the laminated bottle 201, and the "inner layer" denotes an inner container (inner bag) which forms an inner portion of the laminated bottle 201. Although both of the outer layer 202 and the inner layer 203 have flexibility, the outer layer 202 has a rigidity sufficient for self-standing. The "squeeze deformation" denotes the deformation that an intermediate part in the longitudinal direction of the outer layer 202 (the outer container) is crushed (the width of the intermediate part is reduced) by fingers or the like of a user.

The outer layer 202 and the inner layer 203 are formed of, for example, a polyester resin such as a polyethylene terephthalate resin or a polyethylene naphthalate resin, a polyolefin resin such as a polyethylene resin or a polypropylene resin, a polyamide resin such as nylon, or an ethylene vinyl alcohol copolymer resin. A combination of these resins is used so that the outer layer 202 and the inner layer 203 are separable from each other (so that these layers have no compatibility).

The laminated bottle 201 includes a bottle mouth portion 210, a bottle body portion 211, and a bottle bottom portion 212 which are continuously provided in this order in a bottle axis O2 direction. In this embodiment, the side of the bottle close to the bottle mouth portion 210 in the bottle axis O2 direction is called the upper side thereof, the side of the bottle close to the bottle bottom portion 212 in the bottle axis O2 direction is called the lower side thereof, a direction orthogonal to the bottle axis O2 is called a bottle radial direction, and a direction going around the bottle axis O2 is called a bottle circumferential direction. The bottle axis O2 denotes the central axis of the laminated bottle 201.

The diameter of the bottle body portion 211 gradually increases from the upper side to the lower side of the bottle body portion 211. The bottle body portion 211 in vertical cross-section of the laminated bottle 201 in the bottle axis O2 direction is formed in a convex-curved shape projecting outward of the bottle in the bottle radial direction.

The outer layer 202 is a container configured to accept squeeze deformation, and the squeeze deformation of the outer layer 202 causes volume-reduction deformation to the inner layer 203. The outer layer 202 is configured to be resiliently deformable, and a body section of the outer layer 202 positioned at the bottle body portion 211 is configured to be resiliently deformable inward of the bottle in the bottle radial direction. That is, even in a case where an external force is added to the outer layer 202 and thereby the squeeze deformation is caused thereto, if the added external force is released, the outer layer 202 can return to the shape shown in FIG. 16.

The bottle mouth portion 210 extends upward from the upper end opening of the bottle body portion 211 and is disposed coaxial with the bottle body portion 211.

The bottle mouth portion 210 is attached with a discharge cap 241 having a discharge port 240, and the laminated bottle 201 and the discharge cap 241 compose a discharge container 242 which discharges from the discharge port 240, the contents contained in the laminated bottle 201.

The discharge cap 241 switches communication and blockage between the inside of the inner layer 203 and the discharge port 240 in accordance with the internal pressure of the inner layer 203. The discharge cap 241 includes an internal stopper 243, a main body 244, and a cover 245.

The internal stopper 243 includes a base portion 246 disposed on the upper end opening of the bottle mouth portion 210, a housing cylinder 247 penetrating the base portion 246 in the bottle axis O2 direction, and a valve body 248 accommodated in the housing cylinder 247. Both of the base portion 246 and the housing cylinder 247 are disposed coaxial with the bottle axis O2, and the base portion 246 and the housing cylinder 247 are integrally formed.

The base portion 246 is formed in an annular plate-shape whose front and back surfaces are perpendicular to the bottle axis O2 direction. The base portion 246 includes an outer circumferential part 249 positioned on an outer side of the base portion 246 in the bottle radial direction, an inner circumferential part 250 positioned on an inner side thereof in the bottle radial direction, and a stepped part 251 extending in the bottle axis O2 direction and connecting the outer circumferential part 249 and the inner circumferential part 250. The inner circumferential part 250 is positioned to be lower than the outer circumferential part 249.

The outer circumferential part 249 is provided with a rising cylindrical part 252 and a first seal cylindrical part 253 which are disposed coaxial with the bottle axis O2. The rising cylindrical part 252 extends upward from the outer circumferential part 249. The first seal cylindrical part 253 extends downward from the outer circumferential part 249 and is liquid-tightly fitted into the bottle mouth portion 210.

A middle part of the outer circumferential surface of the housing cylinder 247 in the bottle axis O2 direction is connected to the inner circumferential edge of the base portion 246, and the housing cylinder 247 projects from the base portion 246 into two sides (upper and lower sides) of the base portion 246 in the bottle axis O2 direction. A portion of the housing cylinder 247 positioned to be lower than the middle part of the housing cylinder 247 in the bottle axis O2 direction is provided with a diameter-decreasing part 254 (a valve seat) having a diameter that gradually decreases from the upper side to the lower side of the housing cylinder 247.

The inner circumferential surface of the housing cylinder 247 is provided with projecting ribs 255 extending in the bottle axis O2 direction. The projecting ribs 255 are provided at intervals in the bottle circumferential direction and compose an annular rib-row. The projecting rib 255 extends upward from the diameter-decreasing part 254, and the upper end part of the projecting rib 255 is positioned to be upper than the middle part of the housing cylinder 247 in the bottle axis O2 direction. The upper end part of the projecting rib 255 is provided with a stopper 255*a* projecting inward of the housing cylinder 247 in the bottle radial direction.

The valve body 248 is accommodated in the housing cylinder 247 and is movable in the bottle axis O2 direction. The valve body 248 is configured to be slidable in the bottle axis O2 direction inside the rib-row on the surfaces of the projecting ribs 255 facing inward of the housing cylinder 247 in the bottle radial direction, and is seated on the inner circumferential surface of the diameter-decreasing part 254 so as to be movable upward of the inner circumferential surface. The valve body 248 is a so-called ball valve formed in a spherical shape.

The main body 244 is formed in a cylindrical shape with a top and is externally attached to the bottle mouth portion 210. The inside of the upper end part of the main body 244 is fitted with the base portion 246, and the other part of the main body 244 positioned to be lower than the upper end part thereof is screwed on the outer circumferential surface of the bottle mouth portion 210.

The main body 244 is provided with a drooping cylindrical part 256 and a discharge cylindrical part 257. The drooping cylindrical part 256 extends downward from the main body 244 and is fitted into the inside of the stepped part 251. The discharge cylindrical part 257 has a smaller diameter than that of the drooping cylindrical part 256 and extends upward from the main body 244.

The diameter of the inner circumferential surface of the discharge cylindrical part 257 gradually increases from the lower side to the upper side thereof. The axis of the discharge cylindrical part 257 extends along the bottle axis O2 and is shifted from the bottle axis O2 in the bottle radial direction.

Hereinafter, a direction orthogonal to the axis of the discharge cylindrical part 257 and to the bottle axis O2 is called a front-and-rear direction, a side of the bottle close to the axis of the discharge cylindrical part 257 in the front-and-rear direction is called a rear side thereof, and a side of the bottle close to the bottle axis O2 in the front-and-rear direction is called a front side thereof.

The discharge cylindrical part 257 is capable of communicating with the inside of the inner layer 203 through the housing cylinder 247, and the inside of the upper end part of the discharge cylindrical part 257 is provided with the discharge port 240. The discharge cylindrical part 257 is provided with a second seal cylindrical part 258 which communicates between the inside of the discharge cylindrical part 257 and the inside of the housing cylinder 247. The second seal cylindrical part 258 extends downward from the inner circumferential surface of the discharge cylindrical part 257. The second seal cylindrical part 258 is disposed coaxial with the bottle axis O2 and is fitted into the inside of the upper end part of the housing cylinder 247.

The discharge port 240 and the inside of the inner layer 203 are capable of communicating with each other through a communication passageway 259 which is formed of the insides of the housing cylinder 247, the second seal cylindrical part 258, and the discharge cylindrical part 257. The communication between the discharge port 240 and the inside of the inner layer 203 through the communication passageway 259 is blocked by the valve body 248 seated on the diameter-decreasing part 254.

The cover 245 is formed in a cylindrical shape with a top. The cover 245 is externally fitted to the upper end part of the main body 244 and is attachable thereto and detachable therefrom. The cover 245 covers the discharge port 240 from outside thereof. The cover 245 seals the discharge port 240 and is capable of opening and closing the discharge port 240. The cover 245 is connected to the main body 244 via a hinge part 260. The hinge part 260 connects parts of the main body 244 and of the cover 245 to each other, these parts being positioned on the rear side of the bottle. The hinge part 260 connects the cover 245 to the main body 244 so that the cover 245 is rotatable around the hinge part 260 between the front side and the rear side of the hinge part 260.

The cover 245 is provided with a third seal cylindrical part 261 and a restriction part 262. Both of the third seal cylindrical part 261 and the restriction part 262 are disposed coaxial with the bottle axis O2.

The lower end part of the third seal cylindrical part 261 is fitted into the second seal cylindrical part 258 so as to be attachable thereto and detachable therefrom, and blocks the communication between the inside of the inner layer 203 and the discharge port 240 through the communication passageway 259.

The restriction part 262 is disposed coaxial with the bottle axis O2 and is formed in a rod shape extending along the bottle axis O2. The restriction part 262 is formed having a smaller diameter than that of the third seal cylindrical part 261. The lower end part of the restriction part 262 is positioned inside the housing cylinder 247 and is disposed at approximately the same position as the stopper 255*a* in the bottle axis O2 direction. The restriction part 262 restricts the upward movement of the valve body 248.

As shown in FIGS. 16 to 19, the bottle bottom portion 212 includes a grounding portion 212*a* and a recessed portion 212*b*. The grounding portion 212*a* is connected to the bottle body portion 211 and is positioned at the outer circumferential edge part of the bottle bottom portion 212. The recessed portion 212*b* is connected to the grounding portion 212*a* from inside of the bottle in the bottle radial direction and is positioned on an inner side of the bottle than the grounding portion 212*a*.

As shown in FIGS. 16 to 23, a bottom section of the outer layer 202 positioned at the bottle bottom portion 212 is provided with a holding rib 230 pinching and integrally holding the inner layer 203, an intake slit 231 (an intake hole, an intake gap) allowing outside air to be imported into a space between the outer layer 202 and the inner layer 203, first recess 236 and second recesses 237 which are recessed inward of the bottle in the bottle axis O2 direction, and projecting parts 238 projecting inward of the laminated bottle 201. The holding rib 230, the intake slit 231, the first recess 236, the second recesses 237 and the projecting parts 238 are formed in the recessed portion 212*b* of the bottle bottom portion 212.

Figure 18:
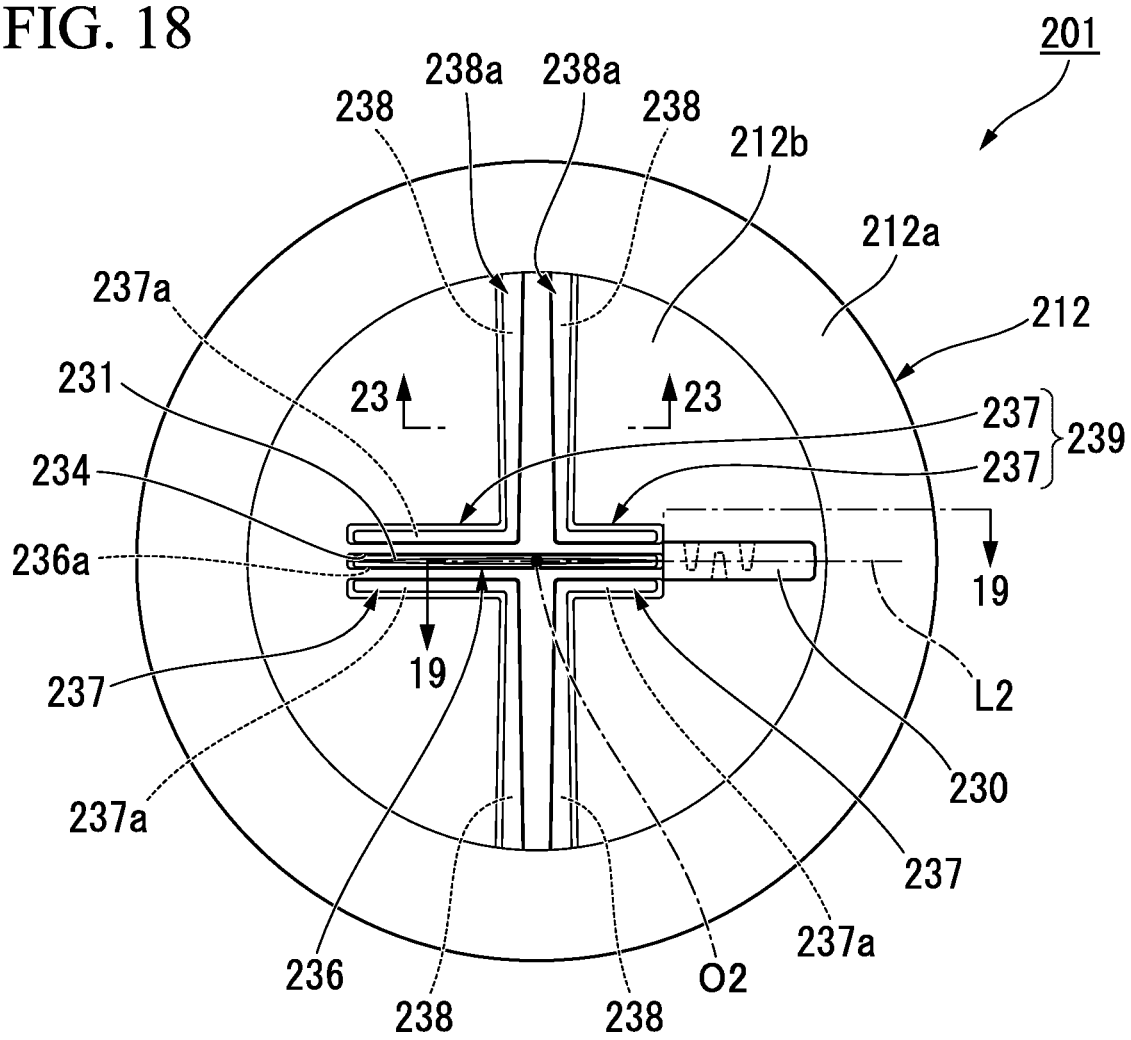
FIG. 18 is a bottom view of a bottle bottom portion of the laminated bottle shown in FIG. 16.
Figure 19:
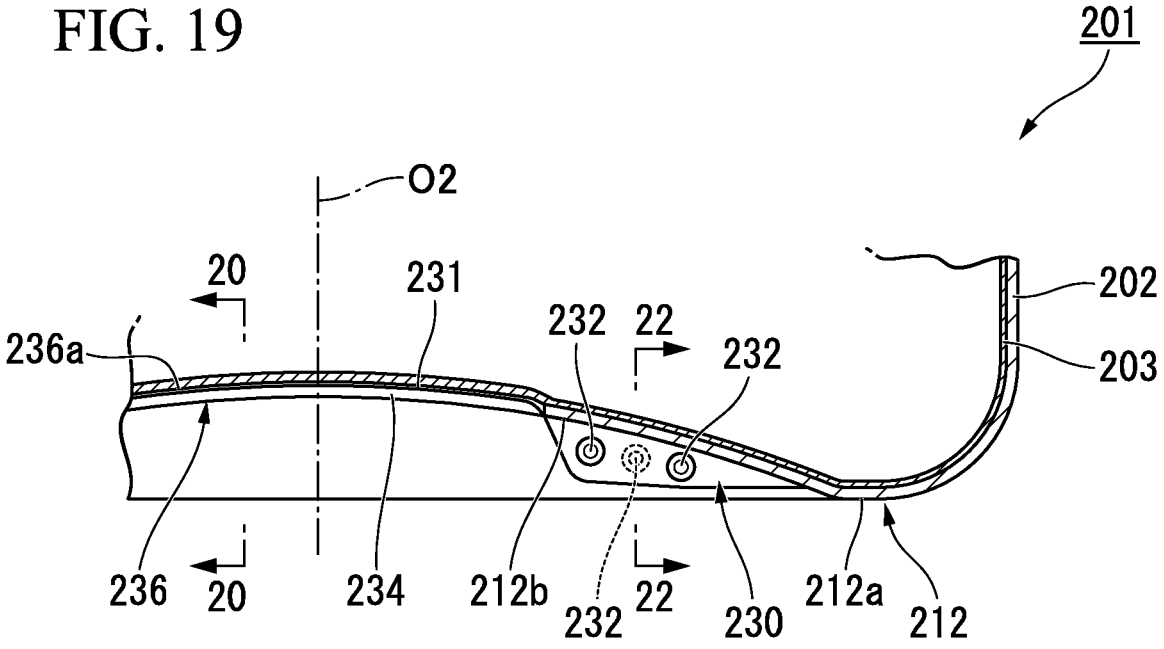
FIG. 19 is a cross-sectional view taken along 19-19 line of the bottle bottom portion shown in FIG. 18.

As shown in FIGS. 18 and 19, the first recess 236 linearly extends in the bottle radial direction and traverses the bottle axis O2. Two end parts of the first recess 236 in the bottle radial direction are separated inward in the bottle radial direction from the grounding portion 212*a*.

The intake slit 231 is formed in a bottom wall surface (a bottom wall) of the first recess 236. The intake slit 231 is a linearly extending slit, and extends on the entire length (on the entire length in the longitudinal direction) of the bottom wall surface of the first recess 236 and traverses the bottle axis O2 in the bottle radial direction. The extending direction of the intake slit 231 is the same as the extending direction of the first recess 236.

In this embodiment, the bottom section of the outer layer 202 is provided with a surrounding wall 234 which is disposed in an opening edge part of the intake slit 231 on the entire circumference thereof and extends outward of the bottle in the bottle axis O2 direction so as to surround the periphery of the intake slit 231. In the example shown in the drawings, the surrounding wall 234 is formed of a side wall surface (a side wall) of the first recess 236 and continuously encircles the periphery of the intake slit 231 on the entire circumference thereof.

A pair of second recesses 237 extend parallel to the intake slit 231 and are disposed next to the intake slit 231 so that the intake slit 231 is interposed between the second recesses 237. The pair of second recesses 237 extend in the extending direction of the intake slit 231 and are disposed so that the first recess 236 is interposed between the second recesses 237 in the orthogonal direction (the up-and-down direction of FIG. 18) to the extending direction. The lengths and widths of the pair of second recesses 237 are equivalent to each other, the length of the second recess 237 is less than the length of the first recess 236, and the width of the second recess 237 is equivalent to the width of the first recess 236.

Two pairs of second recesses 237 are disposed at an interval in the extending direction. A recess row 239 configured of two second recesses 237 which are disposed at an interval in the extending direction is formed in each of a first-side area and a second-side area, the first-side area (for example, an upper-side area of the first recess 236 in FIG. 18) being positioned on a first side of the first recess 236 in the orthogonal direction within the bottom section of the outer layer 202, and the second-side area (for example, a lower-side area of the first recess 236 in FIG. 18) being positioned on a second side of the first recess 236 in the orthogonal direction within the bottom section of the outer layer 202.

Figure 20:
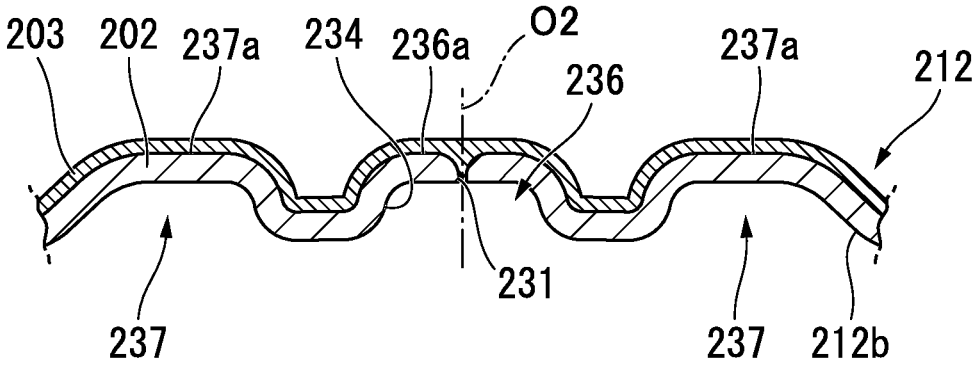
FIG. 20 is a cross-sectional view taken along 20-20 line of the bottle bottom portion shown in FIG. 19.
Figure 21:
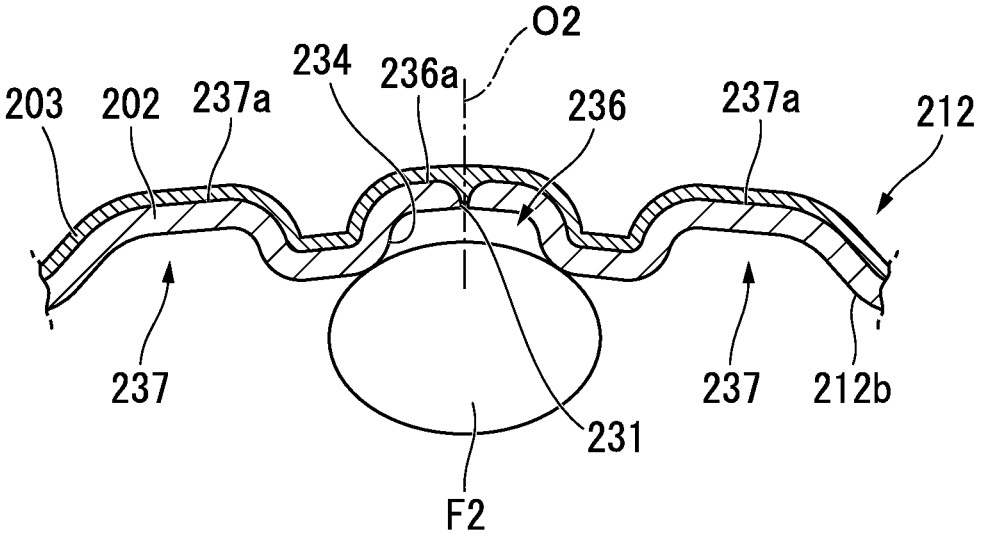
FIG. 21 is a cross-sectional view taken along 20-20 line of the bottle bottom portion shown in FIG. 19 and is a view showing a state where a finger of a user contacts the bottle bottom portion.

As shown in FIGS. 20 and 21, the width of each of the first recess 236 and the second recesses 237 gradually decreases inward from outside of the bottle in the bottle axis O2 direction. The width of each of the first recess 236 and the second recesses 237 is set to be less than the width of a finger of a user, and a finger F2 cannot enter the first recess 236 or the second recess 237.

The first recess 236 and the second recesses 237 are recessed by parts of the bottle bottom portion 212 projecting inward of the bottle in the bottle axis O2 direction, and parts of the outer layer 202, in which the first recess 236 and the second recesses 237 are formed, form a first projection 236*a* and second projections 237*a*, respectively.

As shown in FIGS. 18 and 19, the holding rib 230 projects downward (outward of the bottle) from the recessed portion 212*b*. The rib height of the holding rib 230 is set so that the holding rib 230 is accommodated in the internal space of the recessed portion 212*b*.

The holding rib 230 is formed on the extended line L2 from the intake slit 231 formed in the bottom wall surface of the first recess 236 and is formed along the extended line L2. The holding rib 230 extends in the extending direction, and the length in the extending direction of the holding rib 230 is less than the radius of the bottle bottom portion 212. Only one holding rib 230 is provided at a position apart from the bottle axis O2 (at a position different from the bottle axis O2). The inner end part of the holding rib 230 positioned on an inner side of the bottle in the bottle radial direction extends so as to be a linear shape inclining relative to the bottle axis O2.

Figure 22:
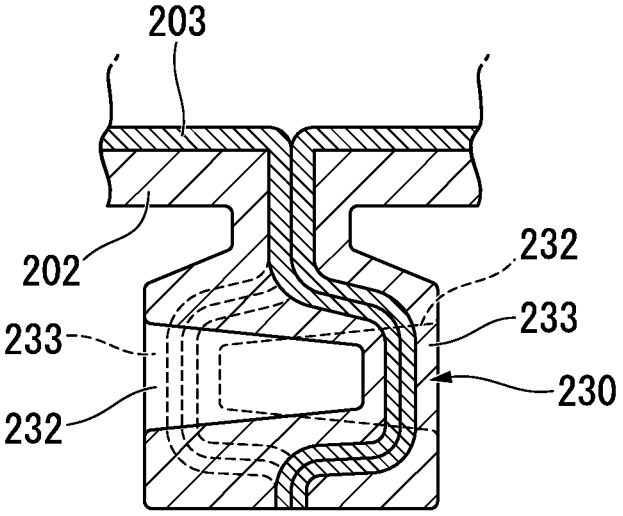
FIG. 22 is a cross-sectional view taken along 22-22 line of a holding rib shown in FIG. 19.

The outer layer 202 and the inner layer 203 are molded through, for example, blow molding in a lamination-separable state, and thereafter, as shown in FIG. 22, an external force is added to a part of the bottom section of the outer layer 202 from two sides of the part in a bottle radial direction in a state where the part of the bottom section of the outer layer 202 pinches a part of a bottom section of the inner layer 203, whereby the parts are united to each other, and thus the holding rib 230 is formed. The holding rib 230 may be formed by pinch-off parts of molds pinching a part to be formed into the holding rib 230 at the time of blow molding. In this case, the extended line L2 is disposed at an equivalent position to a parting line of the molds, and the holding rib 230 is formed on and along the parting line.

As shown in FIG. 22, at the time of forming the holding rib 230, using pins provided on the pinch-off parts and projecting therefrom, recessed holes 232 having a horizontal-hole shape may be formed to be arranged in the extending direction of the holding rib 230 so that adjacent recessed holes 232 open in opposing directions. That is, the recessed holes 232 are alternately formed on two side surfaces of the holding rib 230. In this case, pressure-uniting parts 233 (intruding parts), in which the outer layer 202 and the inner layer 203 are united to each other through pressure, can be alternately disposed along the holding rib 230, and thus the reliability of holding the inner layer 203 can be efficiently improved.

As shown in FIGS. 16 and 17, a part of the outer layer 202 in the bottle circumferential direction and a part of the inner layer 203 in the bottle circumferential direction are fixed to each other via a fixing part 235. The fixing part 235 is, for example, a bonding layer, and bonds the inner layer 203 to the outer layer 202 so that the inner layer 203 is inseparable from the outer layer 202. The fixing part 235 is formed in a strip shape extending in the bottle axis O2 direction on the entire length (the entire length in the longitudinal direction) of the bottle body portion 211 and is positioned on a side of the bottle opposite to the holding rib 230 in the bottle radial direction across the bottle axis O2.

Furthermore, in this embodiment, the fixing part 235 extends inward of the bottle in the bottle radial direction from the lower end part of the bottle body portion 211 connected to the bottle bottom portion 212, and thus is also formed in the bottle bottom portion 212. That is, the fixing part 235 is provided in both of the bottle body portion 211 and the bottle bottom portion 212.

Figure 23:
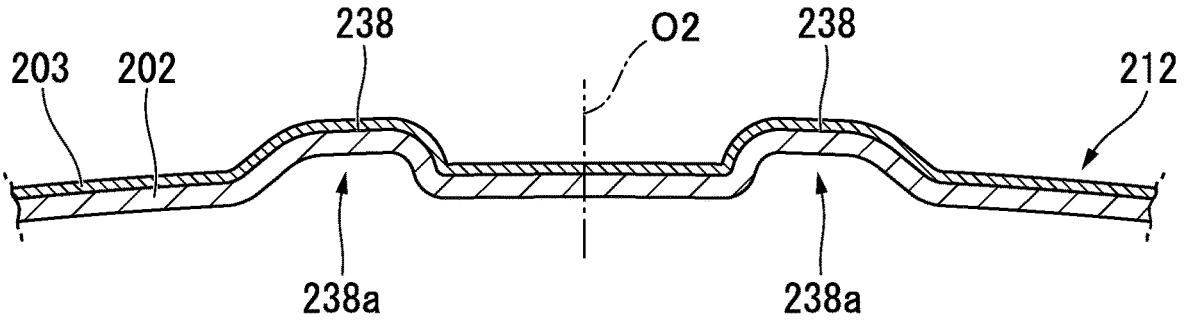
FIG. 23 is a cross-sectional view taken along 23-23 line of the bottle bottom portion shown in FIG. 18.
Figure 24:
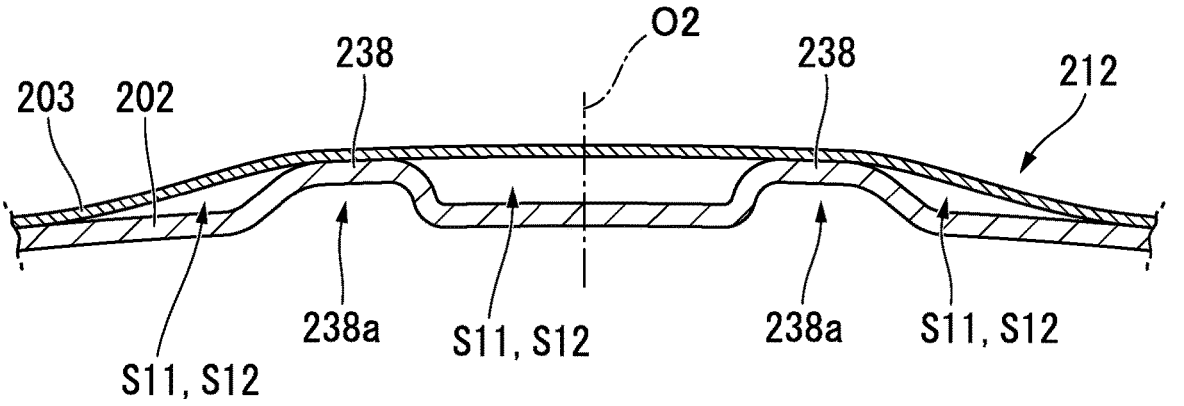
FIG. 24 is a cross-sectional view taken along 23-23 line of the bottle bottom portion shown in FIG. 18 and is a view showing a state where an inner layer is separated from the bottom section of an outer layer and thereafter is laminated again thereon.

As shown in FIGS. 18 and 23, the projecting part 238 is formed in a hollow shape whose inside opens outward of the laminated bottle 201. The projecting part 238 is formed by a part of the bottle bottom portion 212 projecting inward of the bottle in the bottle axis O2 direction, and the inside of the projecting part 238 is configured as a crossing recess 238*a* which opens downward. The width of the projecting part 238 gradually decreases inward from outside of the bottle in the bottle axis O2 direction. In addition, the upper side of FIGS. 23 and 24 is the upper side of the bottle in the vertical direction.

At least part of the projecting part 238 extends in a direction (a cross direction) crossing the extending direction of the intake slit 231, and in the example shown in the drawings, extends in the orthogonal direction (the direction being orthogonal to the extending direction of the intake slit 231). The entire projecting part 238 extends in the orthogonal direction, and in this embodiment, linearly extends in the orthogonal direction. The projecting part 238 is provided in each of a plurality of areas within the bottle bottom portion 212 which are disposed so that the intake slit 231 is interposed between the plurality of areas. The projecting part 238 is arranged in each of the first-side area and the second-side area, and the projecting parts 238 are disposed so that the intake slit 231 is interposed between the projecting parts 238 in the orthogonal direction. A plurality of projecting parts 238 (two projecting parts 238 in the example shown in the drawings) are formed in each of the first-side area and the second-side area, and the plurality of projecting parts 238 are disposed at intervals in the extending direction. The two projecting parts 238 extend parallel to each other.

The projecting parts 238 are arranged next to the intake slit 231 in the orthogonal direction. The end (the end close to the bottle axis O2) of the projecting part 238 positioned on an inner side of the bottle in the orthogonal direction is connected to the end (the end close to the bottle axis O2) of the second projection 237*a* positioned on an inner side of the bottle in the extending direction, and the inside of the crossing recess 238*a* communicates with the inside of the second recess 237. A connection body configured in which the projecting part 238 and the second projection 237*a* are connected to each other is formed in an L-shape in plan view obtained by viewing the laminated bottle 201 in the bottle axis O2 direction. The end of the projecting part 238 positioned on an outer side of the bottle in the orthogonal direction is connected to the grounding portion 212*a* from inside of the bottle in the orthogonal direction.

(Operation of Laminated Bottle)

Next, a case where contents are discharged from the discharge container 242 including the laminated bottle 201 having the above configurations is described.

In this case, as shown in FIG. 16, the cover 245 of the discharge cap 241 is rotated around the hinge part 260, thereby opening the discharge port 240, and thereafter, for example, squeeze deformation (resilient deformation) is applied to the outer layer 202 of the laminated bottle 201, whereby the inner layer 203 is deformed together with the outer layer 202 while reducing the volume of the inner layer 203, and the internal pressure of the inner layer 203 is increased. Therefore, the valve body 248 separates from the diameter-decreasing part 254, the inside of the inner layer 203 and the discharge port 240 are communicated with each other through the communication passageway 259, and the contents contained in the inner layer 203 are discharged from the discharge port 240 through the communication passageway 259.

Thereafter, when increase of the internal pressure of the inner layer 203 stops or the internal pressure thereof decreases by stopping or releasing the squeeze deformation of the laminated bottle 201, the valve body 248 returns to the original position thereof and is seated on the diameter-decreasing part 254, and thus discharge of the contents is stopped.

At this time, when the squeeze deformation of the laminated bottle 201 is released, although the outer layer 202 begins to deform and returns to the original shape thereof, outside air does not easily flow into the inner layer 203 through the diameter-decreasing part 254 because the valve body 248 is seated on the diameter-decreasing part 254, whereby a negative pressure occurs in a space between the outer layer 202 and the inner layer 203, and thus outside air is imported into the space between the outer layer 202 and the inner layer 203 through the intake slit 231. Therefore, as shown by dashed double-dotted lines in FIG. 16, even when the outer layer 202 returns to the original shape thereof, the volume-reduction deformation of the inner layer 203 can be maintained by the inner layer 203 being separated from the outer layer 202. At this time, since the holding rib 230 formed in the bottom section of the outer layer 202 pinches and integrally holds the inner layer 203, it is possible to efficiently prevent large lift of the inner layer 203. Furthermore, in this embodiment, since the fixing part 235, which is positioned on a side of the bottle opposite to the holding rib 230 in the bottle radial direction across the bottle axis O2 and extends in the bottle axis O2 direction on the entire length of the bottle body portion 211, is also disposed in the lower end part of the bottle body portion 211 connected to the bottle bottom portion 212, the fixing part 235 can prevent lift of the inner layer 203 as well as the holding rib 230. In addition, since the fixing part 235 in this embodiment is positioned on a side of the bottle opposite to the holding rib 230 in the bottle radial direction across the bottle axis O2 and is provided in both of the bottle body portion 211 and the bottle bottom portion 212, it is possible to further efficiently prevent lift of the inner layer 203.

In the above way, in a state where an intermediate space is formed between the outer layer 202 and the inner layer 203 by separating the inner layer 203 from the outer layer 202, when squeeze deformation is applied again to the outer layer 202 of the laminated bottle 201 in order to discharge the contents, the internal pressure of the intermediate space is increased, and thus the outer layer 202 indirectly presses the inner layer 203 via the intermediate space (via gas inside the intermediate space), thereby causing volume-reduction deformation to the inner layer 203. Additionally, at this time, if the internal pressure (internal gas) of the intermediate space is released outward of the bottle through the intake slit 231, the inner circumferential surface of the outer layer 202 can contact the outer circumferential surface of the inner layer 203 by shrinking or eliminating the intermediate space, and thus the outer layer 202 can directly press the inner layer 203, thereby causing volume-reduction deformation to the inner layer 203.

As described above, according to the laminated bottle 201 of this embodiment, since the bottom section of the outer layer 202 is provided with the projecting part 238 as shown in FIG. 23, it is possible to make the adhesion strength between the outer layer 202 and the inner layer 203 differ between an area in which the projecting part 238 is arranged and other areas within the bottom section, and to form in the bottle bottom portion 212, the distribution of the adhesion strength between the outer layer 202 and the inner layer 203. Therefore, it is possible to easily form a starting-point part serving as the starting point of separation between the inner layer 203 and the outer layer 202 at the time of causing volume-reduction deformation to the inner layer 203, and to reliably separate the inner layer 203 from the outer layer 202.

Since at least part of the projecting part 238 extends in the orthogonal direction, it is possible to form the starting-point part in the orthogonal direction so that the starting-point part is along the projecting part 238. For example, as shown in FIG. 24, separation spaces S11 formed between the inner layer 203 and the outer layer 202 by the separation occurring in the starting-point part can be extended within the bottle bottom portion 212 from the opening edge part of the intake slit 231 toward the outer circumferential edge part of the bottle.

In addition, since the projecting part 238 is arranged next to the intake slit 231 in the orthogonal direction, outside air can be promptly imported into the separation space S11 from the intake slit 231.

As a result, at the time of causing volume-reduction deformation to the inner layer 203, it is possible to form the separation space S11 extending along the projecting part 238 within the bottle bottom portion 212, and to easily make outside air imported from the intake slit 231 flow toward the outer circumferential edge part of the bottle bottom portion 212 through the separation space S11. That is, outside air can be smoothly imported into the space between the inner layer 203 and the outer layer 202 from the intake slit 231. Therefore, it is possible to obtain appropriate discharge of the contents, the improvement of the operability of the bottle, the prevention of breakage of the inner layer 203, or the like.

In this kind of laminated bottle 201, after part of the contents contained in the inner layer 203 have been discharged and the inner layer 203 has performed volume-reduction deformation, the inner layer 203 may be deformed toward the bottom section of the outer layer 202 due to the load of the contents remaining inside the inner layer 203, and may be laminated again onto the outer layer 202.

Additionally, in order to adjust the degree of force required for separating the inner layer 203 from the outer layer 202, after the laminated bottle 201 has been molded and before contents are contained in the inner layer 203, for example, air inside the inner layer 203 is exhausted to outside of the bottle and volume-reduction deformation is caused to the inner layer 203, thereby separating the inner layer 203 from the outer layer 202, and thereafter air is supplied into the inner layer 203 and swelling deformation is caused to the inner layer 203, thereby laminating the inner layer 203 again onto the outer layer 202, whereby the degree of adhesion between the outer surface of the inner layer 203 and the inner surface of the outer layer 202 may be adjusted.

As described above, in this kind of laminated bottle 201, after the inner layer 203 has performed the volume-reduction deformation and has separated from the outer layer 202, due to a load added to the inner layer 203 from the contents, air supplied into the inner layer 203, or the like, the inner layer 203 may be laminated again onto the bottom section of the outer layer 202.

At this time, since the projecting parts 238 are formed in the bottom section of the outer layer 202, at the time the inner layer 203 is laminated again onto the bottom section of the outer layer 202, as shown in FIG. 24, the surfaces of the projecting parts 238 of the outer layer 202 can be prevented from being brought into close contact with surfaces of the inner layer 203, whereby it is possible to easily form intermediate gaps S12 therebetween. In this laminated bottle 201, since the intermediate gap S12 can be formed in the orthogonal direction along the projecting part 238 similar to the separation space S11, when volume-reduction deformation is caused again to the inner layer 203, outside air imported from the intake slit 231 can easily flow through the intermediate gap S12 toward the outer circumferential edge part of the bottle bottom portion 212. Thus, even in a case where the bottom section of the inner layer 203 has been laminated again onto the bottom section of the outer layer 202 after the inner layer 203 has separated therefrom, outside air can be smoothly imported into a space between the inner layer 203 and the outer layer 202 from the intake slit 231.

Since the projecting part 238 linearly extends in the orthogonal direction, the separation space S11 and the intermediate gap S12 can be linearly formed in the orthogonal direction, and outside air can easily and smoothly flow through the separation space S11 and the intermediate gap S12.

Since the plurality of projecting parts 238 are arranged so that the intake slit 231 is interposed between the projecting parts 238, the separation spaces S11 and the intermediate gaps S12 can be formed in a wide range of the bottle bottom portion 212, and outside air can be further smoothly imported into a space between the inner layer 203 and the outer layer 202 from the intake slit 231.

Since the bottom section of the outer layer 202 is provided with the surrounding wall 234, as shown in FIG. 21, when the finger F2 of a user or the supporting surface (not shown) on which the laminated bottle 201 is put contacts the bottle bottom portion 212, the surrounding wall 234 can prevent the finger F2 or the supporting surface from reaching the intake slit 231. Accordingly, water, dust or the like can be prevented from entering a space between the outer layer 202 and the inner layer 203 through the intake slit 231, and blockage of the intake slit 231 by filling the intake slit 231 with water, dust or the like can be prevented. Thus, it is possible to reliably cause volume-reduction deformation to the inner layer 203.

The bottom wall surface of the first recess 236 is provided with the intake slit 231, and the side wall surface of the first recess 236 forms the surrounding wall 234. Therefore, it is possible to simplify the structure and manufacture of the laminated bottle 201.

Since the intake slit 231 is formed in the bottom wall surface of the first recess 236, an area of the bottom section of the outer layer 202 in which the intake slit 231 is formed can be reinforced with the recess and rib effect of the first recess 236. Therefore, an unexpected increase of the opening area of the intake slit 231 due to an external force added to the outer layer 202 at the time the inner layer 203 performs volume-reduction deformation can be limited, and thus the inner layer 203 can accurately perform the volume-reduction deformation.

Since the intake slit 231 is formed in the bottle bottom portion 212, the intake slit 231 can be hidden, and the bottle body portion 211 can have a smooth surface on the entire circumference thereof. Accordingly, it is possible to prevent deterioration in appearance or in decoration acceptability of the laminated bottle 201.

Since the pair of second recesses 237 extend parallel to the intake slit 231 and are disposed next to the intake slit 231 so that the intake slit 231 is interposed between the second recesses 237, an unexpected increase of the opening area of the intake slit 231 can be prevented by reinforcing the bottom section of the outer layer 202 with the recess and rib effect of the second recesses 237, and the intake slit 231 can become unnoticeable by disposing the second recesses 237 in the bottom section of the outer layer 202 so that the intake slit 231 is interposed between the second recesses 237. Accordingly, it is possible to improve the appearance of the laminated bottle 201, and to easily design the laminated bottle 201 to have an excellent design.

Since the intake slit 231 is interposed between the pair of the second recesses 237, for example, as shown in FIG. 21, at the time the finger F2 of a user contacts the bottle bottom portion 212, it is possible to cause large flexural deformation to areas of the outer layer 202 in which the second recesses 237 are formed, while the deformation of each of the second recesses 237 is maintained to be small. Thus, in a case where the surrounding wall 234 is formed as shown in this embodiment, the finger F2 can be reliably prevented from reaching the intake slit 231.

Since the lift of the inner layer 203 can be efficiently limited by the holding rib 230 being formed in the bottom section of the outer layer 202, the volume-reduction deformation of the inner layer 203 can be accurately controlled. Accordingly, it is possible to prevent a discharge failure or an increase in the amount of contents remaining.

In addition, since the outer layer 202 is formed to accept squeeze deformation, it is possible to increase the internal pressure of the inner layer 203 by applying the squeeze deformation to the outer layer 202, and thus to discharge through the bottle mouth portion 210, the contents contained in the inner layer 203. Therefore, the laminated bottle 201 can be applied to various uses.

Since the holding rib 230 and the intake slit 231 are formed in the recessed portion 212*b* of the bottle bottom portion 212 positioned on an inner side of the bottle than the grounding portion 212*a*, even if the holding rib 230 is formed projecting outward of the bottle, the laminated bottle 201 can be stably put on the supporting surface. In addition, the inflow of outside air through the intake slit 231 is not easily disturbed, and water, dust or the like is less likely to enter a space between the outer layer 202 and the inner layer 203 through the intake slit 231.

Since the intake slit 231 is formed in the bottle radial direction radiating from the bottle axis O2, during the manufacture of the laminated bottle 201, the intake slit 231 can be easily formed in the outer layer 202. Furthermore, since it is only necessary to form the holding rib 230 on the extended line L2 from the intake slit 231 along the extended line L2, the holding rib 230 and the intake slit 231 can be easily formed at the same time.

Since the holding rib 230 is provided on the extended line L2 of the intake slit 231 and extends along the extended line L2, it is possible to easily and accurately adjust the length of the intake slit 231 by altering the length of the holding rib 230. Therefore, for example, when a space between the outer layer 202 and the inner layer 203 has a negative pressure, it is possible to easily and accurately control the degree of opening of the intake slit 231, and to prevent unexpected large opening of the intake slit 231.

Since the holding rib 230 and the fixing part 235 hold on the outer layer 202, two parts of the inner layer 203 positioned to be opposite to each other in the bottle radial direction across the bottle axis O2, it is possible to crush the inner layer 203 flatwise and uniformly in the vicinity of the center of the bottle in accordance with the volume-reduction deformation thereof, and to further reduce the amount of contents remaining.

As shown in FIGS. 16 and 17, since one fixing part 235 is formed in the bottle body portion 211 and is formed into a strip shape extending in the bottle axis O2 direction, the outer layer 202 and the inner layer 203 can be separated from each other in a wide area corresponding to approximately the entire area of the bottle body portion 211 in the bottle circumferential direction except for a part of the bottle body portion 211 in which the fixing part 235 is formed. Thus, when outside air imported into a space between the outer layer 202 and the inner layer 203 from the intake slit 231 reaches the bottle body portion 211, it is possible to prevent the outside air from concentrating into a part of the bottle body portion 211 in the bottle circumferential direction, and to easily make the outside air reach every part on the enter circumference of the bottle. Therefore, the import of air from the intake slit 231 can be smoothly performed.

(Fourth Embodiment)

Hereinafter, a fourth embodiment of the laminated bottle of the present invention is described with reference to the drawings.

(Structure of Laminated Bottle)

Figure 25:
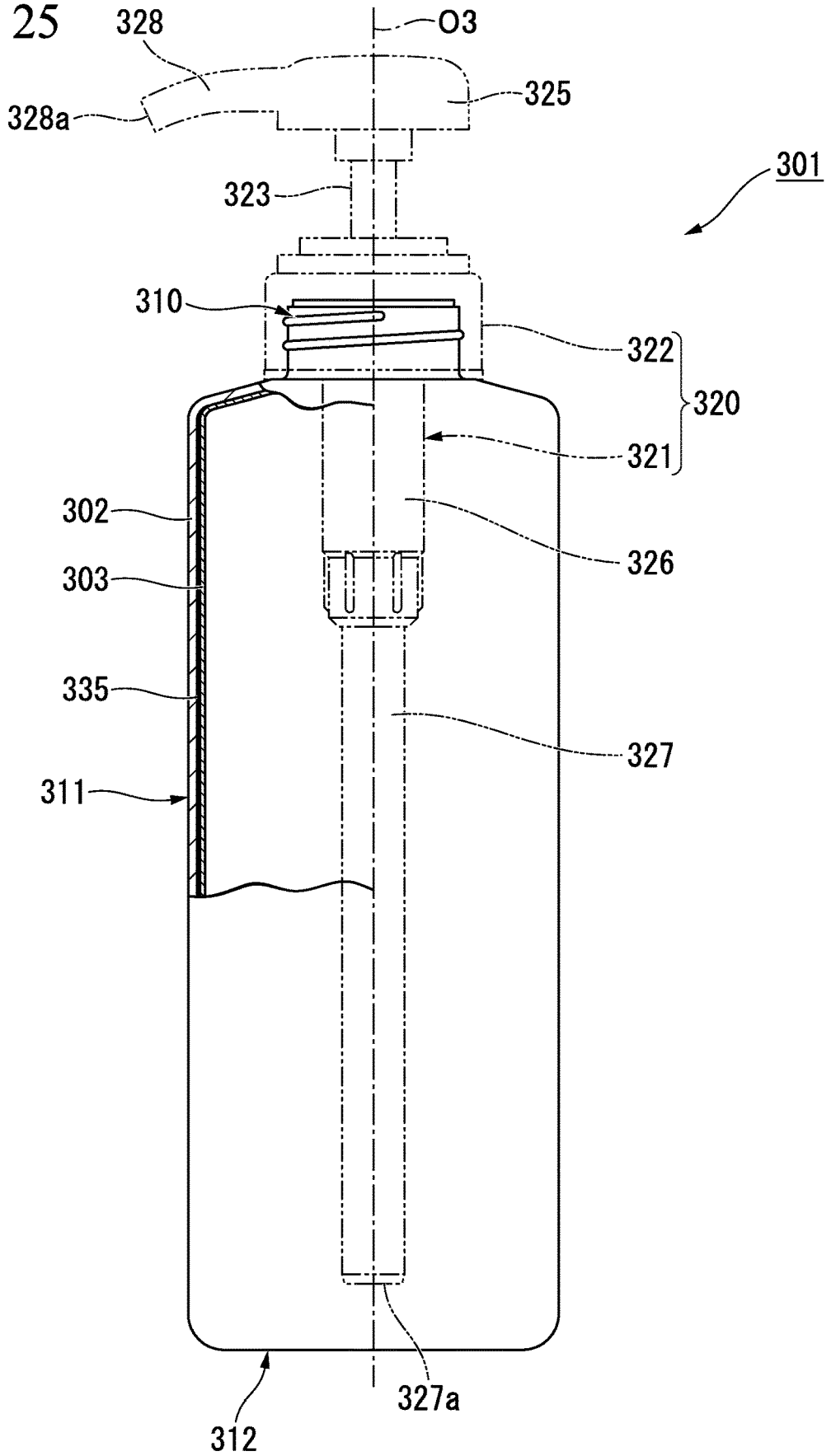
FIG. 25 is a view showing a fourth embodiment of the laminated bottle of the present invention and is a side view (partial cross-sectional view) showing a state where a dispenser is attached to the bottle.
Figure 26:
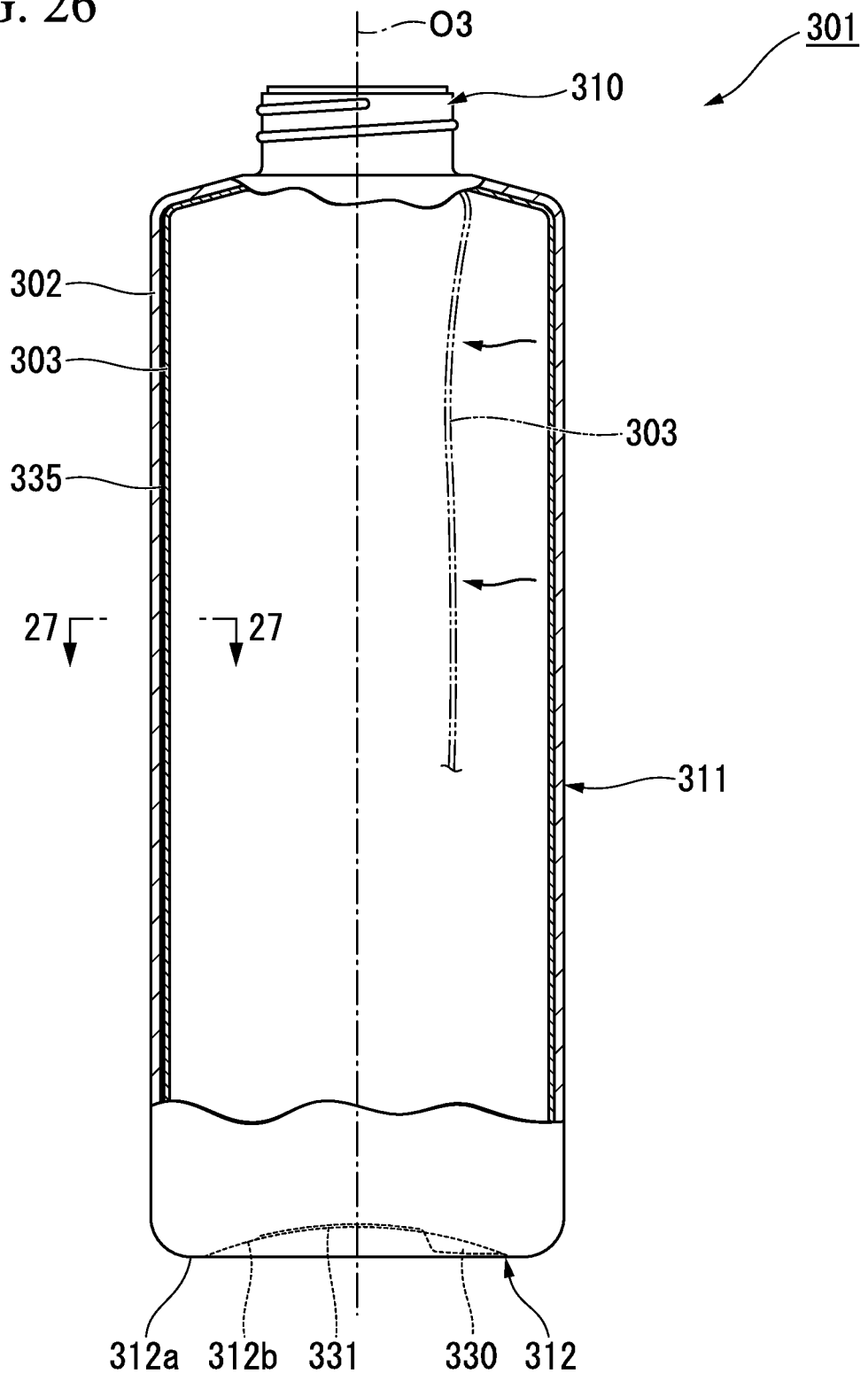
FIG. 26 is a cross-sectional view (partial side view) of the laminated bottle shown in FIG. 25.
Figure 27:
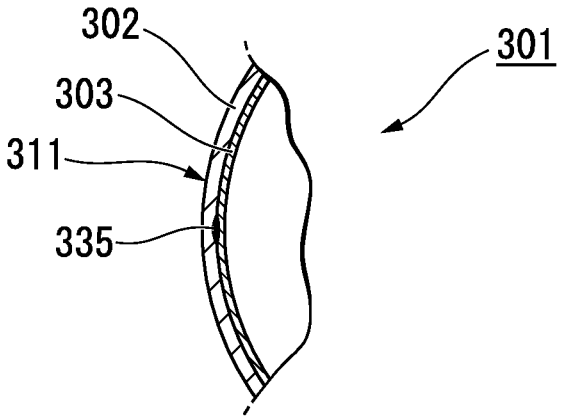
FIG. 27 is a cross-sectional view taken along 27-27 line in FIG. 26.

As shown in FIGS. 25 to 27, a laminated bottle 301 of this embodiment includes an outer layer 302, and a flexible inner layer 303 in which contents (not shown) are contained and which is configured to perform volume-reduction deformation (shrinkage deformation) in accordance with a decrease in the amount of contents. The laminated bottle 301 is a delamination bottle (a lamination-separable container) formed in a cylindrical shape with a bottom, in which the inner layer 303 is laminated onto an inner surface of the outer layer 302 and is separable from the inner surface.

In this embodiment, the "outer layer" denotes an outer container which forms an outer portion of the laminated bottle 301, and the "inner layer" denotes an inner container (inner bag) which forms an inner portion of the laminated bottle 301.

The outer layer 302 and the inner layer 303 are formed of, for example, a polyester resin such as a polyethylene terephthalate resin or a polyethylene naphthalate resin, a polyolefin resin such as a polyethylene resin or a polypropylene resin, a polyamide resin such as nylon, or an ethylene vinyl alcohol copolymer resin. A combination of these resins is used so that the outer layer 302 and the inner layer 303 are separable from each other (so that these layers have no compatibility).

The laminated bottle 301 includes a bottle mouth portion 310, a bottle body portion 311, and a bottle bottom portion 312 which are continuously provided in this order in a bottle axis O3 direction. In this embodiment, the side of the bottle close to the bottle mouth portion 310 in the bottle axis O3 direction is called the upper side thereof, the side of the bottle close to the bottle bottom portion 312 in the bottle axis O3 direction is called the lower side thereof, a direction orthogonal to the bottle axis O3 is called a bottle radial direction, and a direction going around the bottle axis O3 is called a bottle circumferential direction. The bottle axis O3 denotes the central axis of the laminated bottle 301.

The bottle mouth portion 310 is attached with a dispenser 320. The dispenser 320 is a pump-type dispenser which discharges contents using a pump. The dispenser 320 includes a dispenser main body 321, and an attachment cap 322 which screws the dispenser main body 321 on the bottle mouth portion 310.

The dispenser main body 321 includes a pump portion having an erect stem 323 capable of being pushed downward in a state where an upward force is always added to the stem 323, and a push head 325 attached to the upper end part of the stem 323.

The pump portion is an extruder which extrudes contents by the stem 323 being pushed down. The pump portion has a cylindrical pipe 326 integrally attached to the attachment cap 322, and a piston pipe (not shown) inserted into the cylindrical pipe 326 and being movable vertically.

The stem 323 is attached to the upper part of the piston pipe and communicates with the piston pipe. The piston pipe and the stem 323 always receive an upward force from a coil spring (not shown).

The lower end part of the cylindrical pipe 326 is attached with a suctioning pipe 327 extending to the vicinity of the bottle bottom portion 312 of the laminated bottle 301.

The push head 325 is an operation member formed in a cylindrical shape with a top, which is used to push down the stem 323.

The push head 325 is provided with a discharge nozzle 328 having a discharge port 328*a* which communicates with the stem 323 and opens outward of the bottle in the bottle radial direction.

As shown in FIGS. 26 to 29, the bottle bottom portion 312 includes a grounding portion 312*a* and a recessed portion 312*b*. The grounding portion 312*a* is connected to the bottle body portion 311 and is positioned at the outer circumferential edge part of the bottle bottom portion 312. The recessed portion 312*b* is connected to the grounding portion 312*a* from inside of the bottle in the bottle radial direction and is positioned on an inner side of the bottle than the grounding portion 312*a*.

As shown in FIGS. 26 to 33, a bottom section of the outer layer 302 positioned at the bottle bottom portion 312 is provided with a holding rib 330 pinching and integrally holding the inner layer 303, an intake slit 331 (an intake hole, an intake gap) allowing outside air to be imported into a space between the outer layer 302 and the inner layer 303, first recess 336 and second recesses 337 which are recessed inward of the bottle in the bottle axis O3 direction, and projecting parts 338 projecting inward of the laminated bottle 301. The holding rib 330, the intake slit 331, the first recess 336, the second recesses 337 and the projecting parts 338 are formed in the recessed portion 312*b* of the bottle bottom portion 312.

Figure 28:
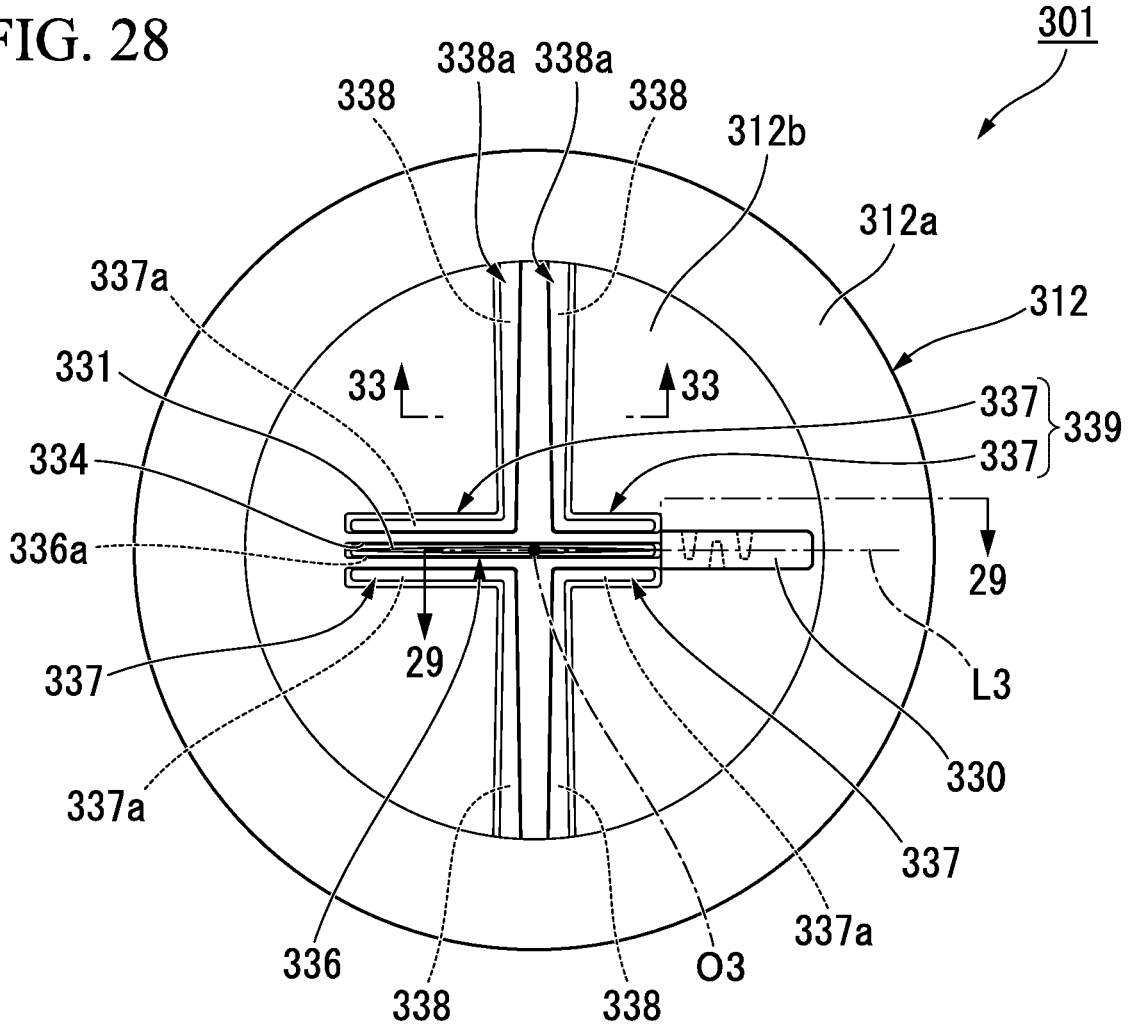
FIG. 28 is a bottom view of a bottle bottom portion of the laminated bottle shown in FIG. 26.
Figure 29:
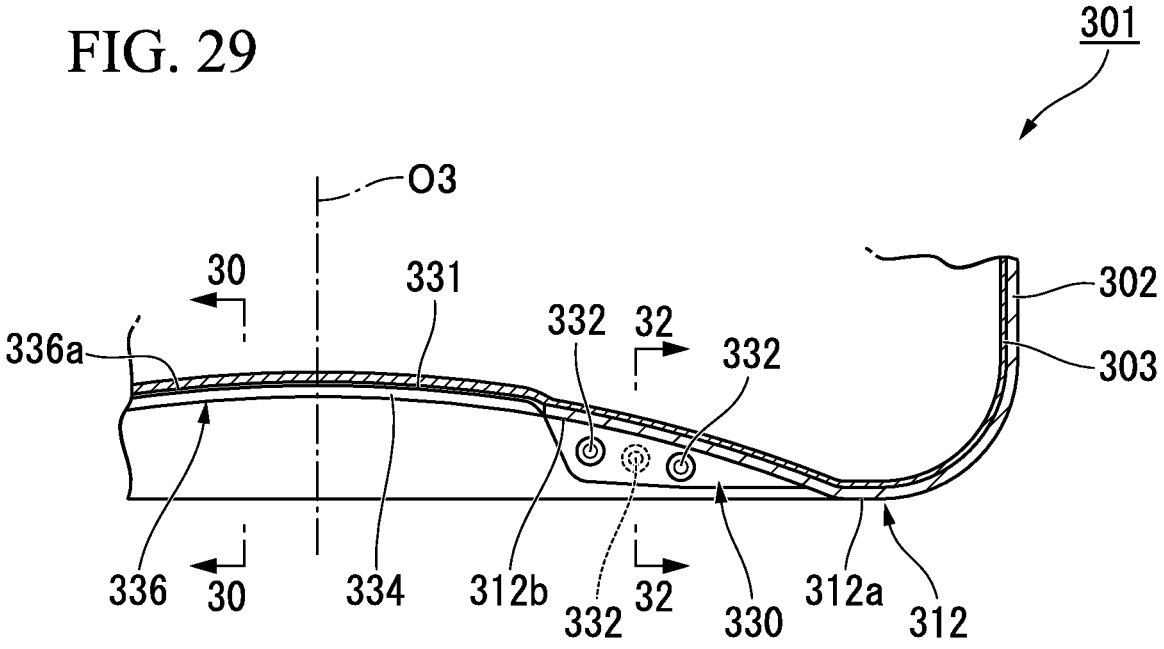
FIG. 29 is a cross-sectional view taken along 29-29 line of the bottle bottom portion shown in FIG. 28.

As shown in FIGS. 28 and 29, the first recess 336 linearly extends in the bottle radial direction and traverses the bottle axis O3. Two end parts of the first recess 336 in the bottle radial direction are separated inward in the bottle radial direction from the grounding portion 312*a*.

The intake slit 331 is formed in a bottom wall surface (a bottom wall) of the first recess 336. The intake slit 331 is a linearly extending slit, and extends on the entire length (on the entire length in the longitudinal direction) of the bottom wall surface of the first recess 336 and traverses the bottle axis O3 in the bottle radial direction. The extending direction of the intake slit 331 is the same as the extending direction of the first recess 336.

In this embodiment, the bottom section of the outer layer 302 is provided with a surrounding wall 334 which is disposed in an opening edge part of the intake slit 331 on the entire circumference thereof and extends outward of the bottle in the bottle axis O3 direction so as to surround the periphery of the intake slit 331. In the example shown in the drawings, the surrounding wall 334 is formed of a side wall surface (a side wall) of the first recess 336 and continuously encircles the periphery of the intake slit 331 on the entire circumference thereof.

A pair of second recesses 337 extend parallel to the intake slit 331 and are disposed next to the intake slit 331 so that the intake slit 331 is interposed between the second recesses 337. The pair of second recesses 337 extend in the extending direction of the intake slit 331 and are disposed so that the first recess 336 is interposed between the second recesses 337 in the orthogonal direction (the up-and-down direction of FIG. 28) to the extending direction. The lengths and widths of the pair of second recesses 337 are equivalent to each other, the length of the second recess 337 is less than the length of the first recess 336, and the width of the second recess 337 is equivalent to the width of the first recess 336.

Two pairs of second recesses 337 are disposed at an interval in the extending direction. A recess row 339 configured of two second recesses 337 which are disposed at an interval in the extending direction is formed in each of a first-side area and a second-side area, the first-side area (for example, an upper-side area of the first recess 336 in FIG. 28) being positioned on a first side of the first recess 336 in the orthogonal direction within the bottom section of the outer layer 302, and the second-side area (for example, a lower-side area of the first recess 336 in FIG. 28) being positioned on a second side of the first recess 336 in the orthogonal direction within the bottom section of the outer layer 302.

Figure 30:
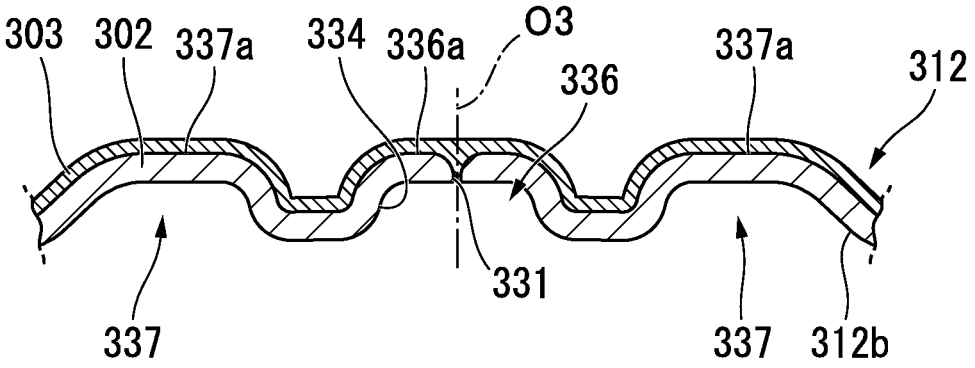
FIG. 30 is a cross-sectional view taken along 30-30 line of the bottle bottom portion shown in FIG. 29.
Figure 31:
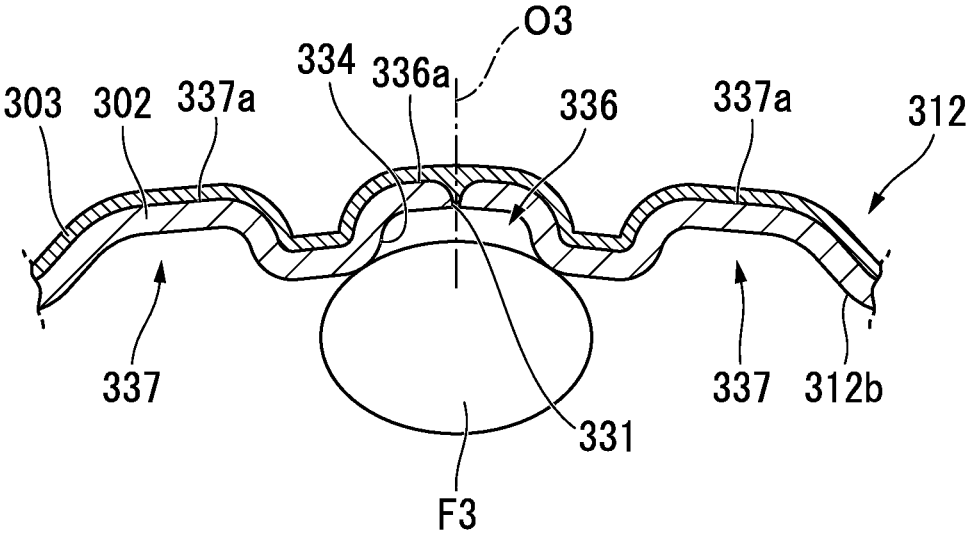
FIG. 31 is a cross-sectional view taken along 30-30 line of the bottle bottom portion shown in FIG. 29 and is a view showing a state where a finger of a user contacts the bottle bottom portion.

As shown in FIGS. 30 and 31, the width of each of the first recess 336 and the second recesses 337 gradually decreases inward from outside of the bottle in the bottle axis O3 direction. The width of each of the first recess 336 and the second recesses 337 is set to be less than the width of a finger of a user, and a finger F3 cannot enter the first recess 336 or the second recess 337.

The first recess 336 and the second recesses 337 are recessed by parts of the bottle bottom portion 312 projecting inward of the bottle in the bottle axis O3 direction, and parts of the outer layer 302, in which the first recess 336 and the second recesses 337 are formed, form a first projection 336*a* and second projections 337*a*, respectively.

As shown in FIGS. 28 and 29, the holding rib 330 projects downward (outward of the bottle) from the recessed portion 312*b*. The holding rib 330 has a rib height such that the holding rib 330 is accommodated in the internal space of the recessed portion 312*b*.

The holding rib 330 is formed on the extended line L3 from the intake slit 331 formed in the bottom wall surface of the first recess 336 and is formed along the extended line L3. The holding rib 330 extends in the above extending direction, and the length in the extending direction of the holding rib 330 is less than the radius of the bottle bottom portion 312. Only one holding rib 330 is provided at a position apart from the bottle axis O3 (at a position different from the bottle axis O3). The inner end part of the holding rib 330 positioned on an inner side of the bottle in the bottle radial direction extends so as to be a linear shape inclining relative to the bottle axis O3.

Figure 32:
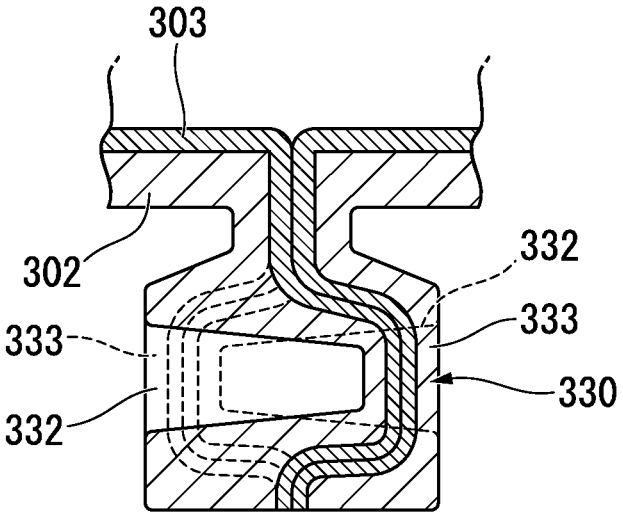
FIG. 32 is a cross-sectional view taken along 32-32 line of a holding rib shown in FIG. 29.

The outer layer 302 and the inner layer 303 are molded through, for example, blow molding into a lamination-separable state, and thereafter, as shown in FIG. 32, an external force is added to a part of the bottom section of the outer layer 302 from two sides of the part in a bottle radial direction in a state where the part of the bottom section of the outer layer 302 pinches a part of a bottom section of the inner layer 303, whereby the parts are united to each other, and thus the holding rib 330 is formed. The holding rib 330 may be formed by pinch-off parts of molds pinching a part to be formed into the holding rib 330 at the time of blow molding. In this case, the extended line L3 is disposed at an equivalent position to a parting line of the molds, and the holding rib 330 is formed on and along the parting line.

As shown in FIG. 32, at the time of forming the holding rib 330, using pins provided on the pinch-off parts and projecting therefrom, recessed holes 332 having a horizontal-hole shape may be formed to be arranged in the extending direction of the holding rib 330 so that adjacent recessed holes 332 open in opposing directions. That is, the recessed holes 332 are alternately formed on two side surfaces of the holding rib 330. In this case, pressure-uniting parts 333 (intruding parts), in which the outer layer 302 and the inner layer 303 are united to each other through pressure, can be alternately disposed along the holding rib 330, and thus the reliability of holding the inner layer 303 can be efficiently improved.

As shown in FIGS. 26 and 27, a part of the outer layer 302 in the bottle circumferential direction and a part of the inner layer 303 in the bottle circumferential direction are fixed to each other via a fixing part 335. The fixing part 335 is, for example, a bonding layer, and bonds the inner layer 303 to the outer layer 302 so that the inner layer 303 is inseparable from the outer layer 302. The fixing part 335 is formed in a strip shape extending in the bottle axis O3 direction on the entire length (the entire length in the longitudinal direction) of the bottle body portion 311, and is positioned on a side of the bottle opposite to the holding rib 330 in the bottle radial direction across the bottle axis O3.

Figure 33:
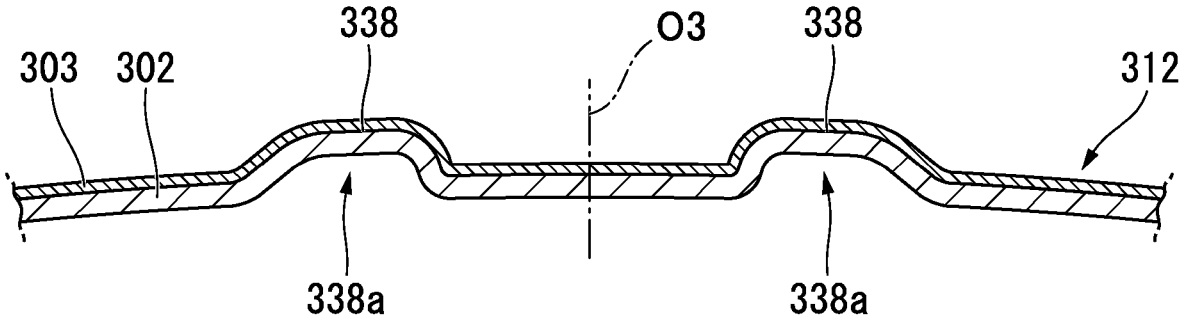
FIG. 33 is a cross-sectional view taken along 33-33 line of the bottle bottom portion shown in FIG. 28.
Figure 34:
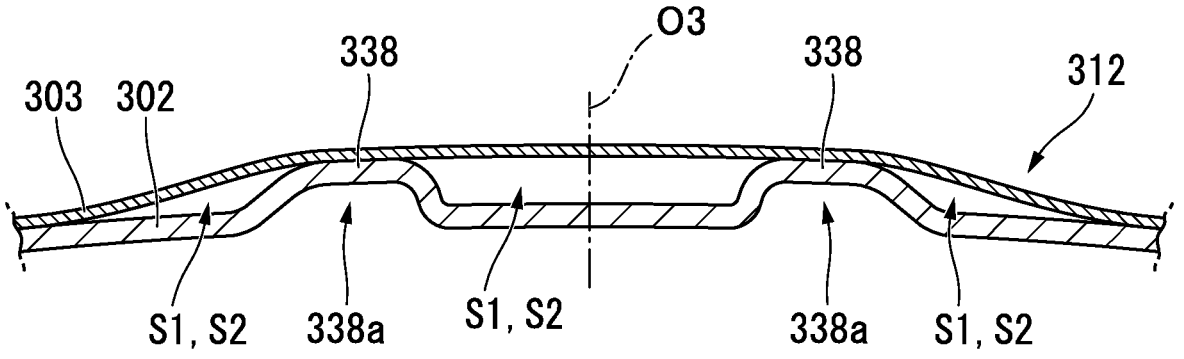
FIG. 34 is a cross-sectional view taken along 33-33 line of the bottle bottom portion shown in FIG. 28 and is a view showing a state where an inner layer is separated from the bottom section of an outer layer and thereafter is laminated again thereon.

As shown in FIGS. 28 and 33, the projecting part 338 is formed in a hollow shape whose inside opens outward of the laminated bottle 301. The projecting part 338 is formed by a part of the bottle bottom portion 312 projecting inward of the bottle in the bottle axis O3 direction, and the inside of the projecting part 338 is configured as a crossing recess 338*a* which opens downward. The width of the projecting part 338 gradually decreases inward from outside of the bottle in the bottle axis O3 direction. In addition, the upper side of FIGS. 33 and 34 is the upper side of the bottle in the vertical direction.

At least part of the projecting part 338 extends in a direction (a cross direction) crossing the extending direction (the extending direction of the intake slit 331), and in the example shown in the drawings, extends in the orthogonal direction (the direction being orthogonal to the extending direction of the intake slit 331). The entire projecting part 338 extends in the orthogonal direction, and in this embodiment, linearly extends in the orthogonal direction. The projecting part 338 is provided in each of a plurality of areas within the bottle bottom portion 312 which are disposed so that the intake slit 331 is interposed between the plurality of areas. The projecting part 338 is arranged in each of the first-side area and the second-side area, and the projecting parts 338 are disposed so that the intake slit 331 is interposed between the projecting parts 338 in the orthogonal direction. A plurality of projecting parts 338 (two projecting parts 338 in the example shown in the drawings) are formed in each of the first-side area and the second-side area, and the plurality of projecting parts 338 are disposed at intervals in the extending direction. The two projecting parts 338 extend parallel to each other.

The projecting parts 338 are arranged next to the intake slit 331 in the orthogonal direction.

The end (the end close to the bottle axis O3) of the projecting part 338 positioned on an inner side of the bottle in the orthogonal direction is connected to the end (the end close to the bottle axis O3) of the second projection 337*a* positioned on an inner side of the bottle in the extending direction, and the inside of the crossing recess 338*a* communicates with the inside of the second recess 337. A connection body configured by the projecting part 338 and the second projection 337*a* connecting to each other is formed in an L-shape in plan view obtained by viewing the laminated bottle 301 in the bottle axis O3 direction. The end of the projecting part 338 positioned on an outer side of the bottle in the orthogonal direction is connected to the grounding portion 312*a* from inside of the bottle in the orthogonal direction.

(Operation of Laminated Bottle)

Next, a case where contents are discharged using the dispenser 320 attached to the laminated bottle 301 having the above configurations is described.

In this case, the stem 323 is pushed down by a push-down operation of the push head 325, and thus the contents contained in the inner layer 303 are suctioned up from a suctioning port 327*a* which opens at the lower end of the suctioning pipe 327. Then, the suctioned contents are injected into the discharge nozzle 328 of the push head 325 through the stem 323. Therefore, it is possible to discharge the contents outward of the bottle through the discharge port 328*a* of the discharge nozzle 328.

When the contents are suctioned up, although the inner layer 303 begins to perform volume-reduction deformation as shown by dashed double-dotted lines in FIG. 26, the original shape of the outer layer 302 is maintained, whereby a negative pressure occurs in a gap between the inner layer 303 and the outer layer 302. Thus, outside air is imported into the gap between the outer layer 302 and the inner layer 303 through the intake slit 331. Therefore, only the inner layer 303 can be separated from the outer layer 302 in accordance with discharge of the contents without deforming the outer layer 302, thereby causing volume-reduction deformation of the inner layer 303. At this time, since the holding rib 330 formed in the bottom section of the outer layer 302 pinches and integrally holds the inner layer 303, lift of the inner layer 303 during the volume-reduction deformation thereof can be efficiently prevented. Furthermore, in this embodiment, since the fixing part 335, which is positioned on a side of the bottle opposite to the holding rib 330 in the bottle radial direction across the bottle axis O3 and extends in the bottle axis O3 direction on the entire length of the bottle body portion 311, is also disposed in the lower end part of the bottle body portion 311 connected to the bottle bottom portion 312, the fixing part 335 can prevent lift of the inner layer 303 as well as the holding rib 330.

As described above, according to the laminated bottle 301 of this embodiment, since the bottom section of the outer layer 302 is provided with the projecting part 338 as shown in FIG. 33, it is possible to make the adhesion strength between the outer layer 302 and the inner layer 303 differ between an area in which the projecting part 338 is arranged and other areas within the bottom section, and to form in the bottle bottom portion 312, the distribution of the adhesion strength between the outer layer 302 and the inner layer 303. Therefore, it is possible to easily form a starting-point part serving as the starting point of separation between the inner layer 303 and the outer layer 302 at the time the inner layer 303 is subjected to volume-reduction deformation, and to reliably separate the inner layer 303 from the outer layer 302.

Since at least part of the projecting part 338 extends in the orthogonal direction, it is possible to form the starting-point part in the orthogonal direction so that the starting-point part is along the projecting part 338. For example, as shown in FIG. 34, separation spaces S1 formed between the inner layer 303 and the outer layer 302 by the separation occurring in the starting-point part can be extended within the bottle bottom portion 312 from the opening edge part of the intake slit 331 toward the outer circumferential edge part of the bottle.

In addition, since the projecting part 338 is arranged next to the intake slit 331 in the orthogonal direction, outside air can be promptly imported into the separation space S1 from the intake slit 331.

As a result, at the time of causing volume-reduction deformation to the inner layer 303, it is possible to form the separation space S1 extending along the projecting part 338 within the bottle bottom portion 312, and to easily make outside air imported from the intake slit 331 flow toward the outer circumferential edge part of the bottle bottom portion 312 through the separation space S1. That is, outside air can be smoothly imported into the space between the inner layer 303 and the outer layer 302 from the intake slit 331. Therefore, it is possible to obtain appropriate discharge of the contents, the improvement of the operability of the bottle, the prevention of breakage of the inner layer 303, or the like.

In this kind of laminated bottle 301, after part of the contents contained in the inner layer 303 have been discharged and the inner layer 303 has performed volume-reduction deformation, the inner layer 303 may be deformed toward the bottom section of the outer layer 302 due to the load of contents remaining inside the inner layer 303, and may be laminated again onto the outer layer 302.

Additionally, in order to adjust the degree of force required for separating the inner layer 303 from the outer layer 302, after the laminated bottle 301 has been molded and before contents are contained in the inner layer 303, for example, air inside the inner layer 303 is exhausted to outside of the bottle and volume-reduction deformation is caused to the inner layer 303, thereby separating the inner layer 303 from the outer layer 302, and thereafter air is supplied into the inner layer 303 and swelling deformation is caused to the inner layer 303, thereby laminating the inner layer 303 again onto the outer layer 302, whereby the degree of adhesion between the outer surface of the inner layer 303 and the inner surface of the outer layer 302 may be adjusted.

As described above, in this kind of laminated bottle 301, after the inner layer 303 has performed the volume-reduction deformation and has separated from the outer layer 302, due to a load added to the inner layer 303 from the contents, air supplied into the inner layer 303, or the like, the inner layer 303 may be laminated again onto the bottom section of the outer layer 302.

At this time, since the projecting parts 338 are formed in the bottom section of the outer layer 302, at the time the inner layer 303 is laminated again onto the bottom section of the outer layer 302, as shown in FIG. 34, the surfaces of the projecting parts 338 of the outer layer 302 can be prevented from being brought into close contact with surfaces of the inner layer 303, whereby it is possible to easily form intermediate gaps S2 therebetween. In this laminated bottle 301, since the intermediate gap S2 can be formed in the orthogonal direction along the projecting part 338 similar to the separation space S1, when volume-reduction deformation is caused again to the inner layer 303, outside air imported from the intake slit 331 can easily flow through the intermediate gap S2 toward the outer circumferential edge part of the bottle bottom portion 312. Thus, even in a case where the bottom section of the inner layer 303 has been laminated again onto the bottom section of the outer layer 302 after the inner layer 303 has separated therefrom, outside air can be smoothly imported into a space between the inner layer 303 and the outer layer 302 from the intake slit 331.

Since the projecting part 338 linearly extends in the orthogonal direction, the separation space S1 and the intermediate gap S2 can be linearly formed in the orthogonal direction, and outside air can easily and smoothly flow through the separation space S1 and the intermediate gap S2.

Since the plurality of projecting parts 338 are arranged so that the intake slit 331 is interposed between the projecting parts 338, the separation spaces S1 and the intermediate gaps S2 can be formed in a wide range of the bottle bottom portion 312, and thus outside air can be further smoothly imported into a space between the inner layer 303 and the outer layer 302 from the intake slit 331.

Since the bottom section of the outer layer 302 is provided with the surrounding wall 334, as shown in FIG. 31, when the finger F3 of a user or the supporting surface (not shown) on which the laminated bottle 301 is put contacts the bottle bottom portion 312, the surrounding wall 334 can prevent the finger F3 or the supporting surface from reaching the intake slit 331. Accordingly, water, dust or the like can be prevented from entering a space between the outer layer 302 and the inner layer 303 through the intake slit 331, blockage of the intake slit 331 by filling the intake slit 331 with water, dust or the like can be prevented, and thus volume-reduction deformation can be reliably caused to the inner layer 303.

The bottom wall surface of the first recess 336 is provided with the intake slit 331, and the side wall surface of the first recess 336 forms the surrounding wall 334. Therefore, it is possible to simplify the structure and manufacture of the laminated bottle 301.

Since the intake slit 331 is formed in the bottom wall surface of the first recess 336, an area of the bottom section of the outer layer 302 in which the intake slit 331 is formed can be reinforced with the recess and rib effect of the first recess 336. Therefore, an unexpected increase of the opening area of the intake slit 331 due to an external force added to the outer layer 302 at the time the inner layer 303 performs volume-reduction deformation can be limited, and thus the inner layer 303 can accurately perform the volume-reduction deformation.

Since the intake slit 331 is formed in the bottle bottom portion 312, the intake slit 331 can be hidden, and the bottle body portion 311 can have a smooth surface on the entire circumference thereof. Accordingly, it is possible to prevent deterioration in appearance or in decoration acceptability of the laminated bottle 301.

Since the pair of second recesses 337 extend parallel to the intake slit 331 and are disposed next to the intake slit 331 so that the intake slit 331 is interposed between the second recesses 337, an unexpected increase of the opening area of the intake slit 331 can be prevented by reinforcing the bottom section of the outer layer 302 with the recess and rib effect of the second recesses 337, and the intake slit 331 can become unnoticeable by disposing the second recesses 337 in the bottom section of the outer layer 302 so that the intake slit 331 is interposed between the second recesses 337. Accordingly, it is possible to improve the appearance of the laminated bottle 301, and to easily design the laminated bottle 301 to have an excellent design.

Since the intake slit 331 is interposed between the pair of the second recesses 337, for example, as shown in FIG. 31, at the time the finger F3 of a user contacts the bottle bottom portion 312, it is possible to cause large flexural deformation to areas of the outer layer 302 in which the second recesses 337 are formed, while the deformation of each second recess 337 is maintained to be small. Thus, in a case where the surrounding wall 334 is formed as shown in this embodiment, the finger F3 can be reliably prevented from reaching the intake slit 331.

Since the lift of the inner layer 303 can be efficiently limited by the holding rib 330 being formed in the bottom section of the outer layer 302, in a case where the laminated bottle 301 is attached with the dispenser 320 having the suctioning pipe 327 extending to the vicinity of the bottle bottom portion 312 as shown in this embodiment, the inner layer 303 can be prevented from blocking the suctioning port of the suctioning pipe 327. Additionally, the volume-reduction deformation of the inner layer 303 can be accurately controlled. Thus, it is possible to prevent a discharge failure or an increase in the amount of contents remaining.

Since the holding rib 330 and the intake slit 331 are formed in the recessed portion 312*b* of the bottle bottom portion 312 positioned on an inner side of the bottle than the grounding portion 312*a*, even if the holding rib 330 is formed projecting outward of the bottle, the laminated bottle 301 can be stably put on the supporting surface. In addition, the inflow of outside air through the intake slit 331 is not easily disturbed, and water, dust or the like is less likely to enter a space between the outer layer 302 and the inner layer 303 through the intake slit 331.

Since the intake slit 331 is formed in the bottle radial direction radiating from the bottle axis O3, during the manufacture of the laminated bottle 301, the intake slit 331 can be easily formed in the outer layer 302. Furthermore, since it is only necessary to form the holding rib 330 on the extended line L3 from the intake slit 331 along the extended line L3, the holding rib 330 and the intake slit 331 can be easily formed at the same time.

Since the holding rib 330 and the fixing part 335 hold on the outer layer 302, parts of the inner layer 303 positioned to be opposite to each other in the bottle radial direction across the bottle axis O3, it is possible to crush the inner layer 303 flatwise and properly in the vicinity of the center of the bottle in accordance with the volume-reduction deformation thereof, and to further reduce the amount of contents remaining.

As shown in FIGS. 25 to 27, since one fixing part 335 is formed in the bottle body portion 311 and is formed into a strip shape extending in the bottle axis O3 direction, the outer layer 302 and the inner layer 303 can be separated from each other in a wide area corresponding to approximately the entire area of the bottle body portion 311 in the bottle circumferential direction except for a part of the bottle body portion 311 in which the fixing part 335 is formed. Thus, when outside air imported into a space between the outer layer 302 and the inner layer 303 from the intake slit 331 reaches the bottle body portion 311, it is possible to prevent the outside air from concentrating into a part of the bottle body portion 311 in the bottle circumferential direction, and to easily make the outside air reach every part on the enter circumference of the bottle. Therefore, the import of air from the intake slit 331 can be smoothly performed.

The technical scope of the present invention is not limited to the third and fourth embodiments, and various modifications can be adopted within the scope of and not departing from the gist of the present invention.

Although in the third and fourth embodiments, the plurality of projecting parts 238 or 338 are formed in each of the first-side area and the second-side area, the present invention is not limited thereto. For example, only one projecting part may be formed in each of the first-side area and the second-side area.

Although in the third and fourth embodiments, the plurality of projecting parts 238 or 338 are arranged so that the intake slit 231 or 331 is interposed therebetween, the present invention is not limited thereto. For example, one or more projecting part may be disposed in only one of the first-side area and the second-side area.

In addition, although in the third and fourth embodiments, the projecting part 238 or 338 linearly extends in the orthogonal direction, the present invention is not limited thereto. For example, a projecting part may extend in the orthogonal direction so as to be a curved line in plan view.

Although in the third and fourth embodiments, the projecting part 238 or 338 extends in the orthogonal direction, the configuration of the projecting part of the above embodiments may be changed into another configuration that a projecting part extends in a cross direction crossing the extending direction. For example, a projecting part may extend in a direction crossing both of the extending direction and the orthogonal direction. In this case, two projecting parts formed in the first-side area (or in the second-side area) may be disposed so that the separation between the two projecting parts gradually increases (or decreases) outward from the center of the bottle in the bottle radial direction in plan view.

Although in the third and fourth embodiments, the entire projecting part 238 or 338 extends in the orthogonal direction, the configuration of the projecting part of the above embodiments may be changed into another configuration that at least part of a projecting part extends in the above cross direction. For example, a projecting part may be formed in a spiral shape extending in the circumferential direction.

Although in the third and fourth embodiments, one fixing part 235 or 335 is provided at a part of the bottle body portion 211 or 311 positioned on a side of the bottle opposite to the holding rib 230 or 330 in the bottle radial direction across the bottle axis O2 or O3, the present invention is not limited thereto. For example, a plurality of fixing parts may be provided in the bottle, and the position of a fixing part may be different from that of the above embodiments.

A fixing part formed in a strip shape extending in the bottle axis direction may continuously extend on the entire range thereof in the bottle axis direction, or may discontinuously extend thereon. That is, the fixing part may be configured of one strip on the entire range thereof in the bottle axis direction, or may be configured of a plurality of strip pieces which are disposed at intervals on the entire range of the fixing part in the bottle axis direction. Furthermore, the fixing part may be configured of a plurality of thin strips which extend in the bottle axis direction and are disposed to be close to each other in the bottle circumferential direction.

The bottle may be provided with no fixing part 235 or 335 or no second recess 237 or 337.

Furthermore, an annular ridge, which is disposed at the opening edge part of an intake slit on the entire circumference thereof and projects outward of the bottle in the bottle axis direction so as to surround the periphery of the intake slit, may be provided in the bottom section of an outer layer, instead of the first recess 236 or 336. That is, another configuration may be suitably adopted that a surrounding wall, which is disposed at the opening edge part of an intake slit on the entire circumference thereof and extends outward of the bottle in the bottle axis direction so as to surround the periphery of the intake slit, is formed in the bottom section of an outer layer. In addition, the bottle may be provided with no surrounding wall.

Although in the third and fourth embodiments, the holding rib 230 or 330 extends on the extended line L2 or L3 of the intake slit 231 or 331 along the extended line L2 or L3, the present invention is not limited thereto. For example, a holding rib may extend so as to cross the above extended line. Furthermore, an intake slit may be formed to be parallel to a holding rib. That is, the configuration of the holding rib of the above embodiments may be changed into another configuration that a holding rib is formed within the bottom section of an outer layer at a position different from an intake slit.

Furthermore, although in the third and fourth embodiments, only one holding rib 230 or 330 is provided at a position different from the bottle axis O2 or O3, the present invention is not limited thereto, and two or more holding ribs may be provided in the bottle.

Although in the third and fourth embodiments, the intake slit 231 or 331 extends in the bottle radial direction, the present invention is not limited thereto. For example, an intake slit may extend so as to cross the bottle radial direction.

Furthermore, a component of the third and fourth embodiments can be replaced with another well-known component within the scope of and not departing from the gist of the present invention, and the above modifications may be combined with each other.

(Fifth Embodiment)

Hereinafter, a fifth embodiment of the laminated bottle of the present invention is described with reference to the drawings.

(Structure of Laminated Bottle)

Figure 35:
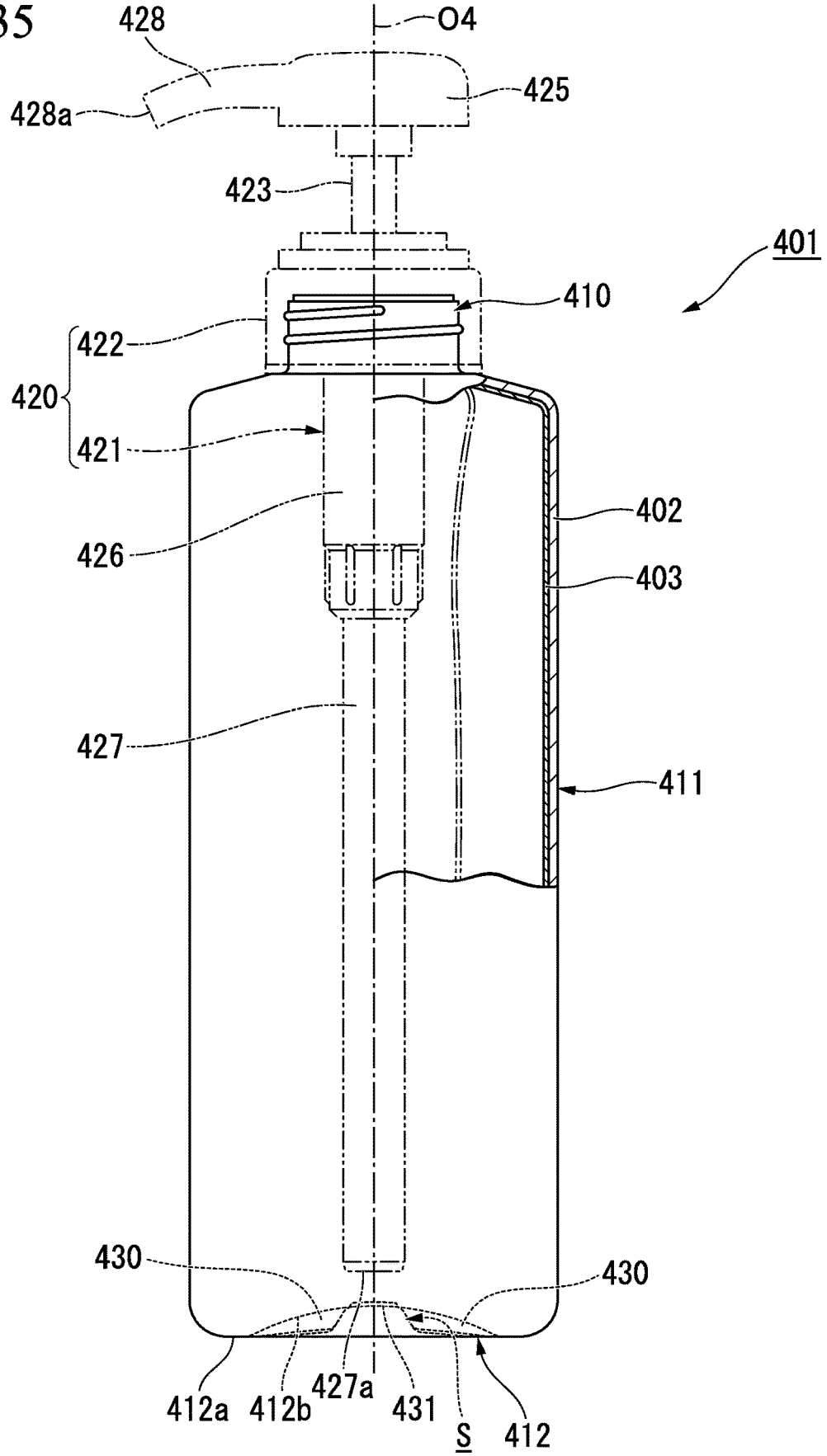
FIG. 35 is a view showing a fifth embodiment of the laminated bottle of the present invention and is a side view (partial cross-sectional view) showing a state where a dispenser is attached to the bottle.

As shown in FIG. 35, a laminated bottle 401 of this embodiment includes an outer layer 402, and a flexible inner layer 403 in which contents (not shown) are contained and which is configured to perform volume-reduction deformation (shrinkage deformation) in accordance with a decrease in the amount of the contents. The laminated bottle 401 is a delamination bottle (a lamination-separable container) formed in a cylindrical shape with a bottom, in which the inner layer 403 is laminated onto an inner surface of the outer layer 402 and is separable from the inner surface.

In this embodiment, the "outer layer" denotes an outer container which forms an outer portion of the laminated bottle 401, and the "inner layer" denotes an inner container (inner bag) which forms an inner portion of the laminated bottle 401.

The outer layer 402 and the inner layer 403 are formed of for example, a polyester resin such as a polyethylene terephthalate resin or a polyethylene naphthalate resin, a polyolefin resin such as a polyethylene resin or a polypropylene resin, a polyamide resin such as nylon, or an ethylene vinyl alcohol copolymer resin. A combination of these resins is used so that the outer layer 402 and the inner layer 403 are separable from each other (so that these layers have no compatibility).

The laminated bottle 401 includes a bottle mouth portion 410, a bottle body portion 411, and a bottle bottom portion 412 which are continuously provided in this order in a bottle axis O4 direction. In this embodiment, the side of the bottle close to the bottle mouth portion 410 in the bottle axis O4 direction is called the upper side thereof, the side of the bottle close to the bottle bottom portion 412 in the bottle axis O4 direction is called the lower side thereof, a direction orthogonal to the bottle axis O4 is called a bottle radial direction, and a direction going around the bottle axis O4 is called a bottle circumferential direction. The bottle axis O4 denotes the central axis of the laminated bottle 401.

The bottle mouth portion 410 is attached with a dispenser 420. The dispenser 420 is a pump-type dispenser which discharges contents using a pump. The dispenser 420 includes a dispenser main body 421, and an attachment cap 422 which screws the dispenser main body 421 on the bottle mouth portion 410.

The dispenser main body 421 includes a pump portion having an erect stem 423 capable of being pushed downward in a state where an upward force is always added to the stem 423, and a push head 425 attached to the upper end part of the stem 423.

The pump portion is an extruder which extrudes contents by the stem 423 being pushed down. The pump portion has a cylindrical pipe 426 integrally attached to the attachment cap 422, and a piston pipe (not shown) inserted into the cylindrical pipe 426 and being movable vertically.

The stem 423 is attached to the upper part of the piston pipe and communicates with the piston pipe. The piston pipe and the stem 423 always receive an upward force from a coil spring (not shown).

The lower end part of the cylindrical pipe 426 is attached with a suctioning pipe 427 extending to the vicinity of the bottle bottom portion 412 of the laminated bottle 401.

The push head 425 is an operation member formed in a cylindrical shape with a top, which is used to push down the stem 423.

The push head 425 is provided with a discharge nozzle 428 having a discharge port 428*a* which communicates with the stem 423 and opens outward of the bottle in the bottle radial direction.

Figure 36:
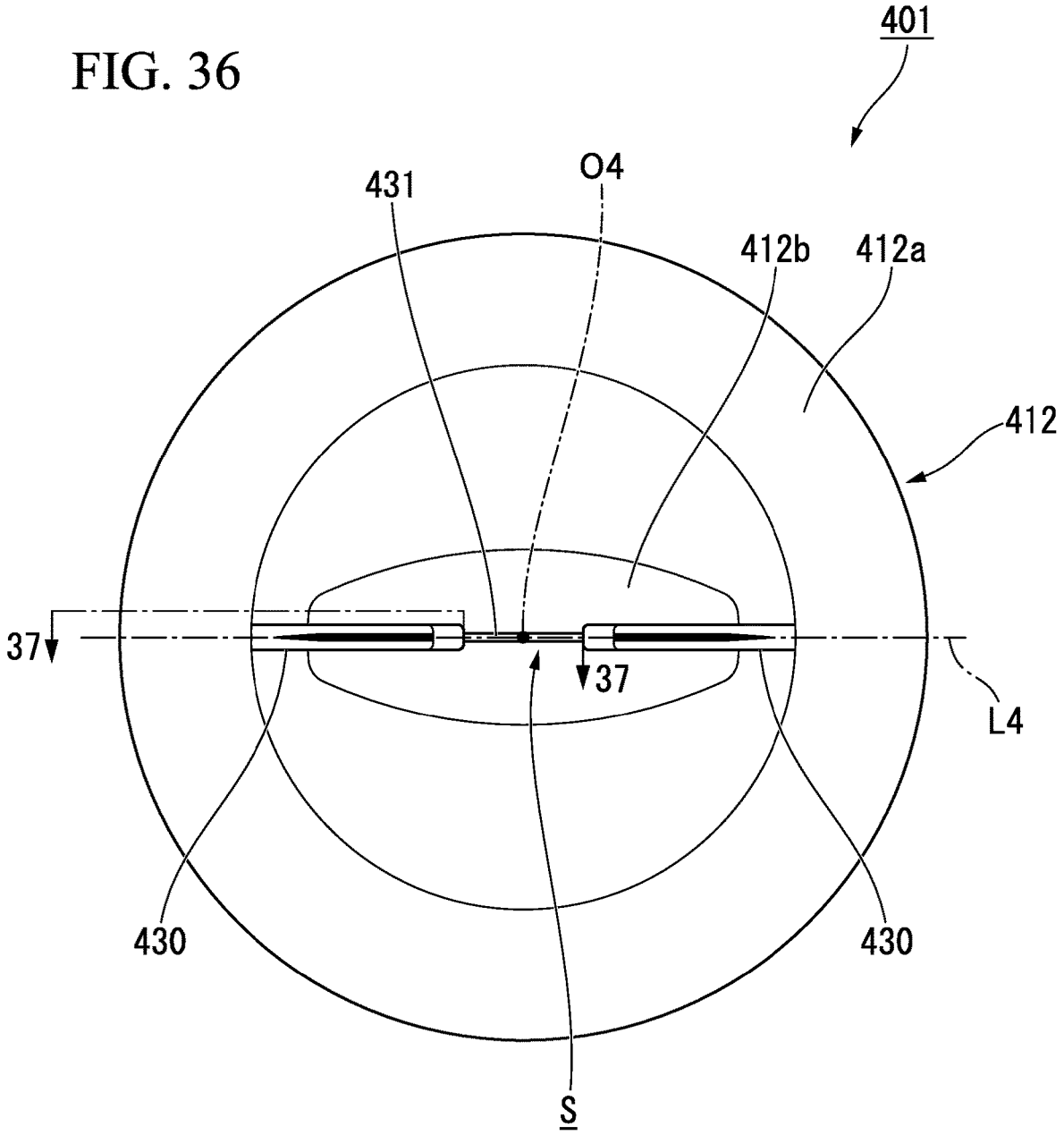
FIG. 36 is a bottom view of a bottle bottom portion of the laminated bottle shown in FIG. 35.
Figure 37:
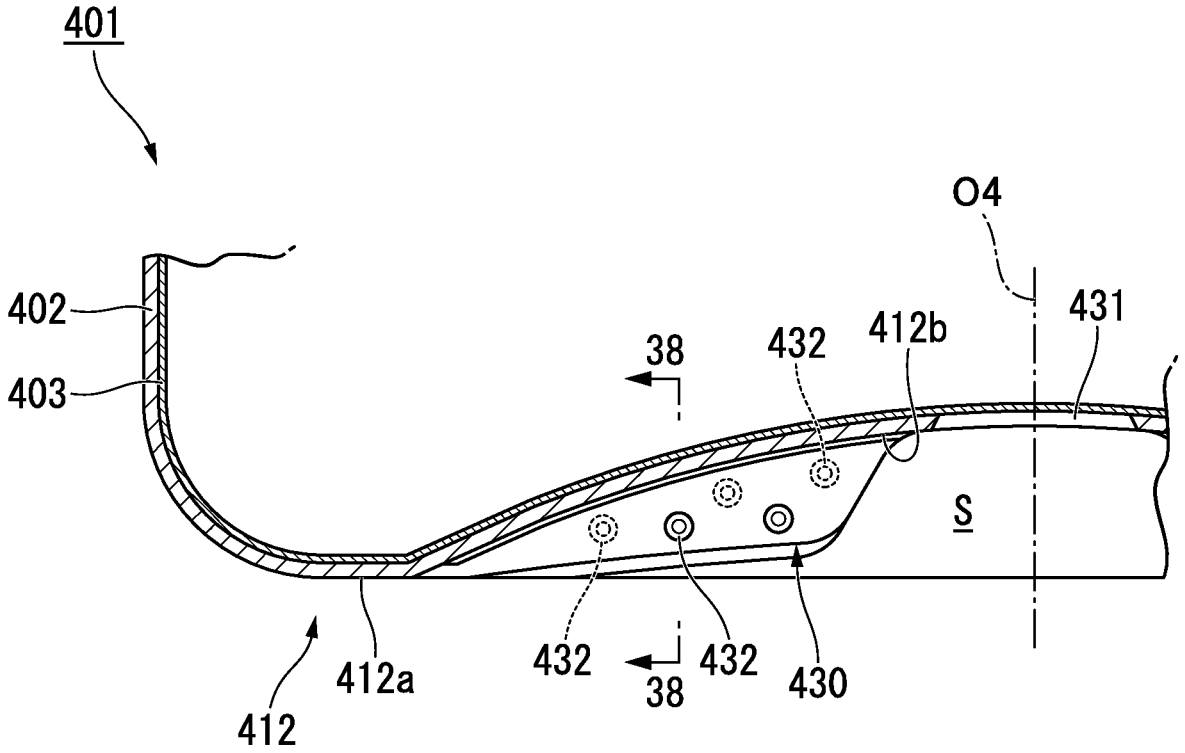
FIG. 37 is a cross-sectional view taken along 37-37 line of the bottle bottom portion shown in FIG. 36.

As shown in FIGS. 35 to 37, the bottle bottom portion 412 includes a grounding portion 412*a* and a recessed portion 412*b*. The grounding portion 412*a* is connected to the bottle body portion 411 and is positioned at the outer circumferential edge part of the bottle bottom portion 412. The recessed portion 412*b* is connected to the grounding portion 412*a* from inside of the bottle in the bottle radial direction and is positioned on an inner side of the bottle than the grounding portion 412*a*.

A bottom section of the outer layer 402 positioned at the bottle bottom portion 412 is provided with holding ribs 430 pinching and integrally holding the inner layer 403, and an intake hole 431 (intake gap) allowing outside air to be imported into a space between the outer layer 402 and the inner layer 403. The holding ribs 430 and the intake hole 431 are formed in the recessed portion 412*b* of the bottle bottom portion 412.

The holding ribs 430 project downward (outward of the bottle) from the recessed portion 412*b*. The holding rib 430 has a rib height such that the holding rib 430 is accommodated in the internal space of the recessed portion 412*b*.

In this embodiment, a pair of holding ribs 430 are disposed within the bottom section of the outer layer 402 at an interval such that the bottle axis O4 is interposed between the holding ribs 430 in the bottle radial direction. Each holding rib 430 extends in the bottle radial direction, and the pair of holding ribs 430 are provided on one straight line L4 extending in the bottle radial direction and extend along the straight line L4.

The pair of holding ribs 430 are provided so as to be reflection symmetry with respect to a line which extends in a bottle radial direction and is orthogonal to the bottle axis O4 and to the straight line L4. The outer end part of the holding rib 430 positioned on an outer side of the bottle in the bottle radial direction is connected to the inner circumferential edge of the grounding portion 412*a*, and the inner end part (the end part being close to the bottle axis O4) of the holding rib 430 positioned on an inner side of the bottle in the bottle radial direction extends so as to be a linear shape inclining relative to the bottle axis O4. The inner end parts of the pair of holding ribs 430 face each other so that the bottle axis O4 is interposed between the inner end parts, and the width of a first space S (space) between the inner end parts gradually decreases upward from a lower side of the bottle (inward from outside of the bottle in the bottle axis O4 direction).

The separation between the inner end parts of the pair of holding ribs 430 is set to be less than the width of a finger of a person (a user). When a finger is made to approach the first space S from outside of the bottle in the bottle axis O4 direction, the pad of the finger contacts the inner end parts of the holding ribs 430, and thereby entry of the finger into the first space S is prevented. At this time, the pad of the finger is separated from the central part of the bottom section of the outer layer 402 positioned between the pair of holding ribs 430, and does not contact the central part.

The intake hole 431 is provided in the central part of the outer layer 402 so as to extend along the straight line L4. The intake hole 431 is a linearly extending slit. Two ends of the intake hole 431 in the bottle radial direction are connected to the inner end parts of the holding ribs 430. The intake hole 431 extends in the bottle radial direction so as to connect the inner end parts of the pair of holding ribs 430.

Figure 38:
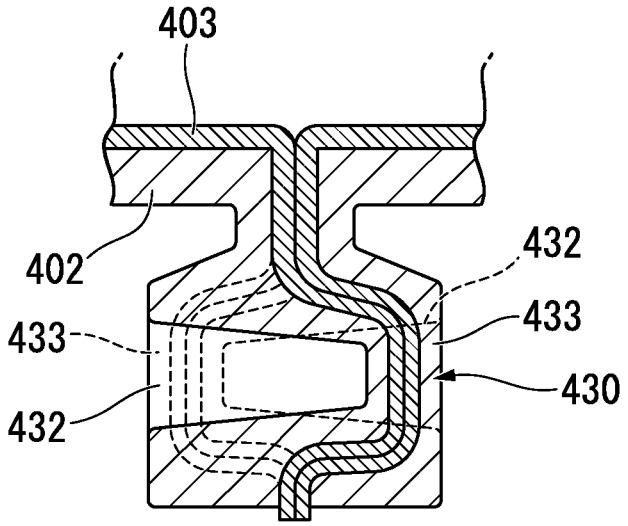
FIG. 38 is a cross-sectional view taken along 38-38 line of a holding rib shown in FIG. 37.

The outer layer 402 and the inner layer 403 are molded through, for example, blow molding into a lamination-separable state, and thereafter, as shown in FIG. 38, an external force is added to a part of the bottom section of the outer layer 402 from two sides of the part in a bottle radial direction in a state where the part of the bottom section of the outer layer 402 pinches a part of a bottom section of the inner layer 403, whereby the parts are united to each other, and thus the holding rib 430 is formed.

It is preferable that the holding rib 430 be formed by pinch-off parts of molds pinching a part to be formed into the holding rib 430 at the time of blow molding. In this case, the straight line L4 is disposed at an equivalent position to a parting line of the molds, and the holding rib 430 is formed on the parting line. In addition, it is further preferable that at the time of forming the holding rib 430, using pins provided on the pinch-off parts so as to project therefrom, recessed holes 432 having a horizontal-hole shape be formed to be arranged in the longitudinal direction of the holding rib 430 so that adjacent recessed holes 432 open in opposing directions. That is, the recessed holes 432 are alternately formed on two side surfaces of the holding rib 430. Therefore, pressure-uniting parts 433 (intruding parts), in which the outer layer 402 and the inner layer 403 are united to each other through pressure, can be alternately disposed along the holding rib 430, and thus the reliability of holding the inner layer 403 can be efficiently improved.

(Operation of Laminated Bottle)

Next, a case where contents are discharged using the dispenser 420 attached to the laminated bottle 401 having the above configurations is described.

In this case, the stem 423 is pushed down by a push-down operation of the push head 425, and thus the contents contained in the inner layer 403 are suctioned up from a suctioning port 427*a* which opens at the lower end of the suctioning pipe 427. Then, the suctioned contents are injected into the discharge nozzle 428 of the push head 425 through the stem 423. Therefore, the contents can be discharged outward of the bottle through the discharge port 428*a* of the discharge nozzle 428.

When the contents are suctioned up, although the inner layer 403 begins to perform volume-reduction deformation as shown by dashed double-dotted lines in FIG. 35, the shape of the outer layer 402 is maintained, whereby a negative pressure occurs in a gap between the inner layer 403 and the outer layer 402. Thus, outside air is imported into the gap between the outer layer 402 and the inner layer 403 through the intake hole 431. Therefore, it is possible to separate the inner layer 403 from the outer layer 402 in accordance with discharge of the contents without deforming the outer layer 402, and to cause volume-reduction deformation to only the inner layer 403.

At this time, since the holding rib 430 formed in the bottom section of the outer layer 402 pinches and integrally holds the inner layer 403, lift of the inner layer 403 during the volume-reduction deformation thereof can be efficiently prevented. Furthermore, since the pair of holding ribs 430 are disposed at an interval across the bottle axis O4 in the bottle radial direction within the bottom section of the outer layer 402, it is possible to reliably hold two areas of the bottom section of the inner layer 403 which are disposed so that the bottle axis O4 is interposed between the two areas. Thus, during the volume-reduction deformation of the inner layer 403, it is possible to prevent lift of one of two areas of the bottom section of the inner layer 403 which are positioned so that the bottle axis O4 is interposed between the two areas, and to accurately control the volume-reduction deformation of the inner layer 403.

As described above, according to the laminated bottle 401 of this embodiment, since the lift of the inner layer 403 can be efficiently limited and the volume-reduction deformation of the inner layer 403 can be accurately controlled, even in a case where the laminated bottle 401 is attached with the dispenser 420 having the suctioning pipe 427 extending to the vicinity of the bottle bottom portion 412 as shown in this embodiment, the inner layer 403 can be prevented from blocking the suctioning port 427*a*. Accordingly, it is possible to prevent a discharge failure or an increase in the amount of contents remaining.

Since the holding ribs 430 hold two areas of the bottom section of the inner layer 403 which are disposed so that the bottle axis O4 is interposed between the two areas, a wide range of the bottom section of the inner layer 403 can be held. Therefore, the other area not held (the area capable of lifting up) of the bottom section of the inner layer 403 can be as small as possible. Thus, the lift of the inner layer 403 together with the contents remaining in the bottom section of the inner layer 403 can be prevented, and it can also be expected to effect a decrease of remaining quantity of the contents in this regard.

The pair of holding ribs 430 are provided on one straight line L4 extending in the bottle radial direction so as to extend along the straight line L4, and each holding rib 430 is formed in the bottle radial direction radiating from the bottle axis O4. Therefore, during the manufacture of the laminated bottle 401, the holding ribs 430 can be easily formed in the outer layer 402, and can easily pinch the inner layer 403, thereby reliably holding the inner layer 403. Furthermore, since it is only necessary to form the intake hole 431 on the straight line L4 on which the pair of holding ribs 430 are disposed, the holding ribs 430 and the intake hole 431 can be easily formed at the same time.

Since the intake hole 431 is formed in the bottle bottom portion 412, the intake hole 431 can be hidden during the normal placement of the bottle, and the bottle body portion 411 can have a smooth surface on the entire circumference thereof. Accordingly, it is possible to prevent deterioration in appearance or in decoration acceptability of the bottle.

Since the intake hole 431 is provided at the central part of the bottom section of the outer layer 402 so as to extend along the straight line L4, while the pair of holding ribs 430 efficiently limits lift of the inner layer 403, outside air imported from the intake hole 431 positioned between the holding ribs 430 can reach every part between the inner layer 403 and the outer layer 402 uniformly in the bottle circumferential direction, and the inner layer 403 can further accurately perform volume-reduction deformation.

As described above, since two areas of the bottom section of the inner layer 403 positioned so that the bottle axis O4 is interposed between the two areas in the bottle radial direction can be reliably held, it is possible to reliably prevent lift of another area of the bottom section of the inner layer 403 which is positioned between the above two areas and faces the intake hole 431, as well as the two areas. In addition, since the intake hole 431 is disposed between the pair of holding ribs 430, unexpected expansion of the intake hole 431 in the bottle radial direction along the straight line L4 can be limited, and for example, it is possible to secure appearance of the laminated bottle 401. Furthermore, even in a case where the contents are discharged by applying squeeze deformation to the laminated bottle 401 in the bottle radial direction and a large external force is added to the outer layer 402 during discharge of the contents, the above-described expansion of the intake hole 431 can be limited. Therefore, it is possible to secure appearance of the laminated bottle 401, and when the squeeze deformation is caused to the laminated bottle 401, large part of outside air which has been imported into a space between the outer layer 402 and the inner layer 403 can be efficiently prevented from flowing back into outside of the bottle through the intake hole 431, and thus the contents can be smoothly discharged.

Since the holding ribs 430 and the intake hole 431 are formed in the recessed portion 412*b* of the bottle bottom portion 412 positioned on an inner side of the bottle than the grounding portion 412*a*, even if the holding ribs 430 are formed projecting outward of the bottle, the laminated bottle 401 can be stably put on the supporting surface. In addition, the inflow of outside air through the intake hole 431 is not easily disturbed, and water, dust or the like is less likely to enter a space between the outer layer 402 and the inner layer 403 through the intake hole 431.

The technical scope of the present invention is not limited to the fifth embodiment, and various modifications can be adopted within the scope of and not departing from the gist of the present invention.

For example, the outer layer 402 may be a container capable of accepting squeeze deformation, and volume-reduction deformation may be caused to the inner layer 403 by the squeeze deformation of the outer layer 402.

Figure 39:
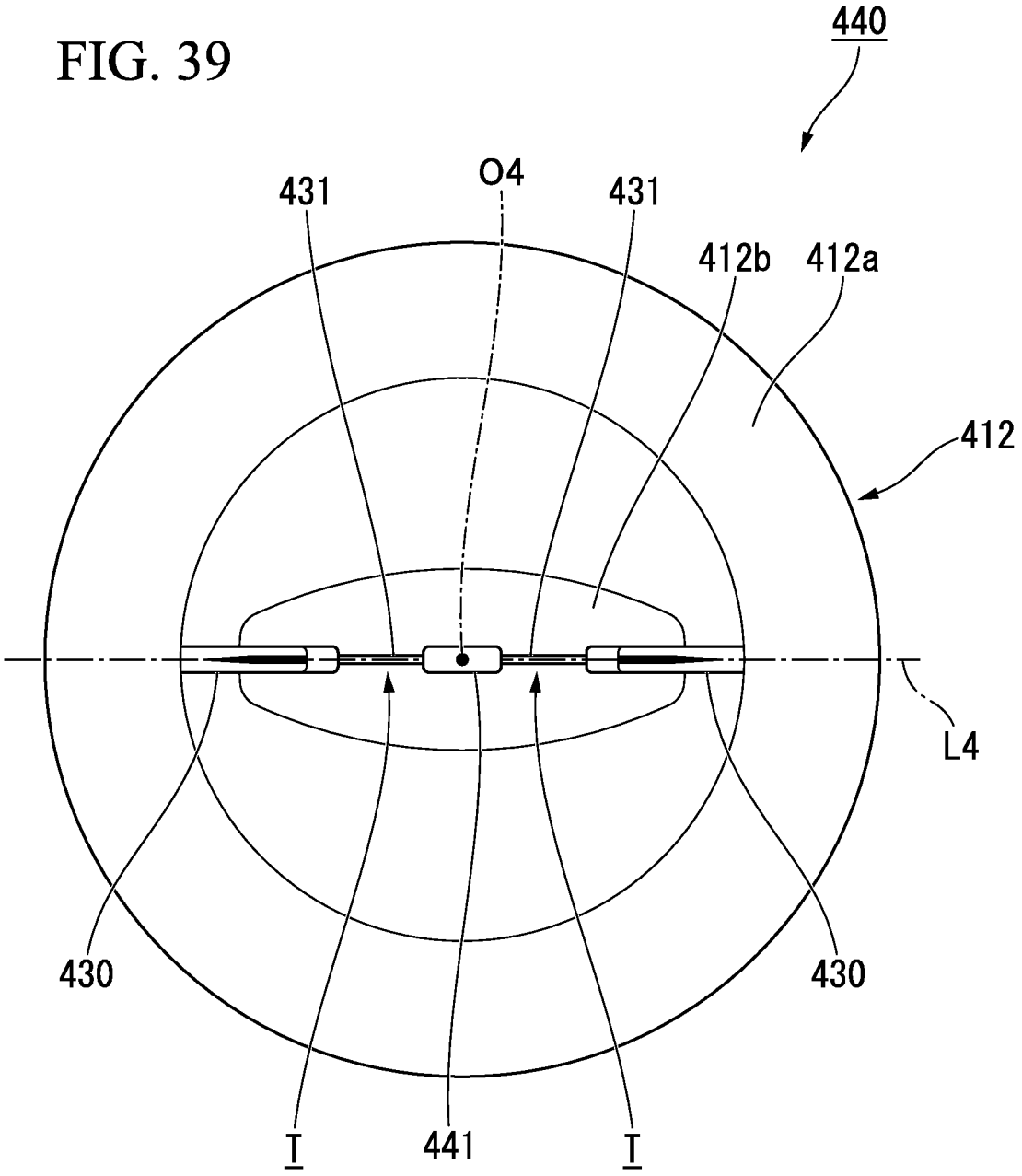
FIG. 39 is a view showing a modification of the fifth embodiment of the laminated bottle of the present invention and is a bottom view of the bottle bottom portion.

Although in the fifth embodiment, the intake hole 431 extends in the bottle radial direction so as to connect the inner end parts of the pair of holding ribs 430, the present invention is not limited thereto. For example, a laminated bottle 440 shown in FIG. 39 may be formed.

In this laminated bottle 440, the bottom section of the outer layer 402 is provided with an auxiliary rib 441 pinching and integrally holding the inner layer 403. The auxiliary rib 441 is arranged in the central part of the bottom section of the outer layer 402 at the same position as the bottle axis O4. The auxiliary rib 441 is provided on the straight line L4 so as to extend along the straight line L4. The length of the auxiliary rib 441 in the bottle radial direction is less than the length of the holding rib 430 in the bottle radial direction.

The side end parts of the auxiliary rib 441 in the bottle radial direction face in the bottle radial direction, the inner end parts of the holding ribs 430. The separation between the side end part of the auxiliary rib 441 and the inner end part of the holding rib 430 is set to be less than the width of a finger of a person (a user). When a finger is made to approach from outside of the bottle in the bottle axis O4 direction, a second space T (space) provided between the side end part of the auxiliary rib 441 and the inner end part of the holding rib 430, the pad of the finger contacts the side end part of the auxiliary rib 441 and the inner end part of the holding rib 430, and thus entry of the finger into the second space T is prevented. At this time, the pad of the finger is separated from a middle part positioned between the auxiliary rib 441 and the holding rib 430 within the bottom section of the outer layer 402, and does not contact the middle part.

The intake hole 431 is provided in the middle part of the outer layer 402 so as to extend along the straight line L4. A pair of intake holes 431 are disposed at an interval such that the bottle axis O4 is interposed between the intake holes 431 in the bottle radial direction. Two ends of the intake hole 431 in the bottle radial direction are connected to the side end part of the auxiliary rib 441 and to the inner end part of the holding rib 430. The intake hole 431 extends in the bottle radial direction so as to connect the side end part of the auxiliary rib 441 and the inner end part of the holding rib 430.

In this case, since the pair of intake holes 431 are provided in the bottle, the proper opening area of the intake holes 431 can be secured, and outside air can be reliably imported into a space between the outer layer 402 and the inner layer 403.

In addition, since the auxiliary rib 441 is provided between the pair of intake holes 431, the lift of the inner layer 403 can also be efficiently prevented.

Although in the fifth embodiment, the intake hole 431 is provided in the central part of the bottom section of the outer layer 402 so as to extend along the straight line L4, the present invention is not limited thereto. For example, an intake hole may extend so as to cross the straight line L4. In addition, an intake hole may be formed in a part of the bottom section of the outer layer different from the central part so as to be parallel to the holding rib, and may be formed in the bottle body portion. Another configuration that an intake hole is formed in a part of the outer layer may be suitably adopted.

Although in the fifth embodiment, the pair of holding ribs 430 are provided on one straight line L4 extending in the bottle radial direction so as to extend along the straight line L4, the present invention is not limited thereto. For example, each holding rib may extend so as to cross the bottle radial direction.

Furthermore, a component in the first to fifth embodiments can be replaced with another well-known component within the scope of and not departing from the gist of the present invention, and the first to fifth embodiments and the above modifications may be suitably combined with each other.

INDUSTRIAL APPLICABILITY

The present invention can be applied to a laminated bottle including an outer layer and a flexible inner layer which is laminated onto an inner surface of the outer layer and is separable from the inner surface.

DESCRIPTION OF REFERENCE SIGNS

1, 101, 201, 301, 401, 440 laminated bottle
2, 102, 202, 302, 402 outer layer
3, 103, 203, 303, 403 inner layer
12, 112, 212, 312, 412 bottle bottom portion
12*a*, 112*a*, 412*a* grounding portion
12*b*, 112*b*, 412*b* recessed portion
30, 130, 230, 330, 430 holding rib
31, 131, 431 intake hole
231, 331 intake slit
34, 134, 234, 334 surrounding wall
35, 135, 235, 335 fixing part
36, 136, 236, 336 first recess
37, 137, 237, 337 second recess
L, L1, L2, L3 extended line
L4 straight line
O, O1, O2, O3, O4 bottle axis

The invention claimed is:

1. A laminated bottle formed in a cylindrical shape with a bottom, the laminated bottle comprising:

an outer layer; and a flexible inner layer in which contents are contained and which is configured to perform volume-reduction deformation in accordance with a decrease of the contents, wherein the inner layer is laminated onto an inner surface of the outer layer and is separable from the inner surface, and a bottom section of the outer layer positioned at a bottle bottom portion is provided with:

a holding rib pinching and holding the inner layer, recessed holes being alternately formed on two side surfaces of the holding rib, and a first recess disposed at a position different from the holding rib, a bottom wall of the first recess is provided with an intake hole disposed at a position different from the holding rib and allowing outside air to be imported into a space between the outer layer and the inner layer, a side wall of the first recess forms a surrounding wall surrounding the intake hole and extending outward of the bottle in a bottle axis direction, the holding rib being provided extending in a bottle radial direction, the intake hole being provided on an extended line from the holding rib within the bottom section, and extending along the extended line, and the bottom section being provided with a pair of second recesses extending parallel to the intake hole and disposed such that the intake hole is interposed between the second recesses.

2. The laminated bottle according to claim 1, wherein the bottle bottom portion includes:

a grounding portion positioned at an outer circumferential edge part of the bottle bottom portion, and a recessed portion connected to the grounding portion from inside of the bottle in a bottle radial direction and positioned on an inner side of the bottle than the grounding portion, and the holding rib and the intake hole are formed in the recessed portion.

3. The laminated bottle according claim 1, wherein the holding rib is disposed at a position different from a bottle axis, a part of the outer layer in a bottle circumferential direction and a part of the inner layer in the bottle circumferential direction are fixed to each other through a fixing part, and the fixing part is positioned on a side of the bottle opposite to the holding rib in a bottle radial direction across the bottle axis.

4. The laminated bottle according to claim 1, wherein the outer layer is configured to accept squeeze deformation.

* * * * *